US006438346B2

(12) United States Patent
Kamimura et al.

(10) Patent No.: US 6,438,346 B2
(45) Date of Patent: Aug. 20, 2002

(54) DEVELOPING DEVICE, PRINTING DEVICE, AND CHARGING METHOD THROUGH CONTACT

(75) Inventors: Taisuke Kamimura; Katsumi Adachi; Kiyoshi Toizumi, all of Nara; Toshimitsu Goto, Yamatokoriyama; Masamitsu Sakuma, Hirakata, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/864,365

(22) Filed: May 25, 2001

(30) Foreign Application Priority Data

May 25, 2000 (JP) ..... 2000-154752
Apr. 18, 2001 (JP) ..... 2001-120210

(51) Int. Cl.[7] ..... G03G 15/08
(52) U.S. Cl. ..... 399/281; 399/284
(58) Field of Search ..... 399/279, 281, 399/284, 290, 252, 253, 265, 266

(56) References Cited

U.S. PATENT DOCUMENTS 5,953,571 A * 9/1999 Thompson ..... 399/290
6,272,305 B1 * 8/2001 Liu ..... 399/266
6,311,035 B1 * 10/2001 Liu et al. ..... 399/133 X

FOREIGN PATENT DOCUMENTS

JP 406258894 * 9/1994
JP 7281473 10/1995

OTHER PUBLICATIONS

"Photoinduced Electrification at the Contact Interface between Photosensitive Layer and Insulator Films", Y.Shirai et al., Journal of the Chemical Society of Japan, 1992, No. 2, pp. 215 to 220.

* cited by examiner

*Primary Examiner*—Sophia S. Chen
*Assistant Examiner*—Hoan Tran

(57) ABSTRACT

The developing device X includes: toner T that contacts an electrostatic latent image on a photosensitive drum D; a charging roller 4 for charging the toner through contact; and an ultraviolet irradiator 5 for charging the toner by shining ultraviolet light onto a sleeve 41 of the charging roller from a position on the back of the sleeve 41 via a roller 42. The sleeve of the charging roller contains material that changes its molecular structure under ultraviolet irradiation by the ultraviolet irradiator in such a manner to charge the toner. Deterioration of a charged member (toner) can be prevented, and so is fusion of the charged member with the charging means. Reliability in the developing process proves.

16 Claims, 26 Drawing Sheets

CROSS SECTION ALONG LINE A-A'

CROSS SECTION ALONG LINE A-A'

CONVENTIONAL DEVELOPING CHAMBER
(FOR USE WITH SINGLE COMPONENT TONER)

CONVENTIONAL DEVELOPING CHAMBER
(FOR USE WITH DOUBLE COMPONENT TONER)

DEVELOPING DEVICE, PRINTING DEVICE, AND CHARGING METHOD THROUGH CONTACT

FIELD OF THE INVENTION

The present invention relates to developing devices for use in electrophotographic printing devices, such as copying machines, printers, and facsimiles, and also to printing devices incorporating such a developing device and charging methods through contact for use in such developing devices.

BACKGROUND OF THE INVENTION

A typical electrophotographic image forming device (electrophotographic device), such as a copying machine, a printer, or a facsimile, includes an LSU, a photosensitive drum, and a developing device. The LSU shines a laser on the rotatable photosensitive drum to form an electrostatic latent image on the surface of the photosensitive drum. The developing device supplies toner to the photosensitive drum to develop (visualize) the electrostatic latent image.

Equipped with a developing roller positioned side by side to the photosensitive drum, the developing device is adapted to gradually apply toner to the entire electrostatic latent image on the photosensitive drum by supplying toner to the surface of the developing roller and rotating the developing roller in a reverse direction to the photosensitive drum.

In this kind of developing device, the toner is electrostatically attracted to the electrostatic latent image on the photosensitive drum to develop the image. To realize this, the toner must be charged by one method or another.

For example, a developing device using non-magnetic, single-component toner is provided with a supply roller located opposite to the developing roller and a layer-thickness-restricting blade (blade) located downstream to the supply roller (downstream with respect to the direction of rotation of the developing roller) as shown in FIG. 29.

The supply roller gradually supplies toner to the surface of the rotatable developing roller, and the blade restricts the thickness of the toner layer formed by strings of toner particles standing on the developing roller. Also, the blade is adopted to rub the toner on the developing roller to charge the toner. In this manner, the toner used in the development is charged.

The charging method is employed not only in developing devices using single-component non-magnetic toner, but also in those using single-component magnetic toner (toner containing magnetic particles).

Another example is a developing device using a double-component developing agent containing toner and carrier, in which the toner and carrier are agitated and mixed in a toner vessel before they are supplied to the developing roller as shown in FIG. 30. The toner is charged by means of friction developing between them, similarly to the previous example.

Nevertheless, the configuration in which toner is charged by means of friction (mechanical rubbing) with a blade requires a great difference in speed between the toner and the blade to sufficiently charge the toner. A result is mechanical/thermal load being imposed on the toner and the blade in direct proportion to the speed difference.

If the speed difference is made greater to sufficiently charge the toner, the mechanical/thermal load on the toner and the blade increases too. This leads to such problems that the toner deteriorates or is damaged, particularly, in terms of charging properties. Another potential drawback is that the toner, having softened due to frictional heat (rubbing heat), fuses with the blade, the developing roller, etc., to cause the developing device to malfunction.

The other configuration in which toner is charged by means of friction with carrier, similarly to the first configuration, requires high speed agitation, as well as a great difference in speed between the toner and the blade, to sufficiently charge the toner. The toner and the carrier are hence put under excessive mechanical/thermal load. This again leads to such problems that the toner deteriorates, particularly, in terms of charging properties or the toner and the carrier are damaged. Another potential drawback is that the toner, having softened due to frictional heat, fuses to the carrier to degrade toner quality and thus image quality.

As detailed in the foregoing, it can be safely concluded that the developing device in which the toner is charged by means of friction between the toner and the blade or carrier has such a shortcoming that the toner, blade, carrier, and developing device itself are subject to damage.

SUMMARY OF THE INVENTION

The present invention has an objective to offer such a developing device that the toner and the device itself deteriorate only to a limited extent.

In order to achieve the objective, the developing device in accordance with the present invention is a developing device for visualizing an electrostatic latent image held and transported on the latent image carrier and includes:

- a charged member for developing an electrostatic latent image to a visual image;
- a charging section for charging the charged member through contact; and
- an irradiation section for shining light onto the charging section to charge the charged member by means of the light shone.

In other words, in this developing device, the charged member for developing an electrostatic latent image into visual image is caused to contact the charging section and the irradiation section to shine light onto the charging section to charge the charged member.

In this case, since the charged member is charged by means of light shone by the irradiation section onto the charging section, there is no need to charge the charged member by means of rubbing of the developing roller with the layer-thickness-restricting blade. Therefore, the stress experienced by the charged member due to mechanical rubbing is suppressed, and deterioration of the charged member becomes preventable. Besides, the arrangement can prevent the charged member from fusing with the charging section (the developing roller, the layer-thickness-restricting blade, etc.) due to rubbing heat. Reliability in the developing device thus improves.

Alternatively, the developing device in accordance with the present invention (the present developing device), in order to achieve the objective, may be a developing device, for use in an electrophotographic device, for developing an electrostatic latent image on a latent image carrier with charged developing material and includes:

- a charging section including charging material radicalized under light irradiation; and
- a light irradiation section for irradiating light onto the charging section, wherein

- the device is specified to charge the developing material by causing the radicalized charging material to contact the developing material.

The present developing device is a developing device for use in a copying machine, printer, facsimile, or other electrophotographic printing device, to develop an electrostatic latent image with toner, ink, or other developing material. Here, the electrostatic latent image refers to an image produced on a photosensitive body or paper (recording paper) according to a potential distribution.

Further, the present developing device is specified to charge the developing material used in the development of an electrostatic latent image, so as to develop it in a satisfactory manner.

Especially, the present developing device includes: a charging section composed of charging material radicalized under light irradiation; and a light irradiation section for shining light onto the charging section. The present developing device is specified to charge the developing material by causing the radicalized charging material to contact the developing material.

Here, radicalizing charging material refers to turning the charging material into radicals (reactive active species) by exciting it and thus changing it in structure. In other words, the charging material is activated on molecular levels and changed into radicals which is an isomer.

The radical is a strong oxidizer and removes an electron from material that comes into contact with it. The radicalized charging material is specified to remove electrons from developing material that comes into contact and thus charge the developing material to a desired charge level.

The present developing device is specified in this manner so that the charging material is radicalized under light irradiation and used to charge the developing material.

Hence, in the present developing device, the developing material can be charged without experiencing frictional forces; therefore, the developing material is prevented from deteriorating due to frictional heat, and so is the device from becoming dirty with the developing material that has softened due to frictional heat.

For a fuller understanding of the nature and advantages of the invention, reference should be made to the ensuing detailed description taken in conjunction with the accompanying drawings.

DESCRIPTION OF THE EMBODIMENTS

The following will describe embodiments of the present invention in reference to drawings.

[Embodiment 1]

Figure 1:
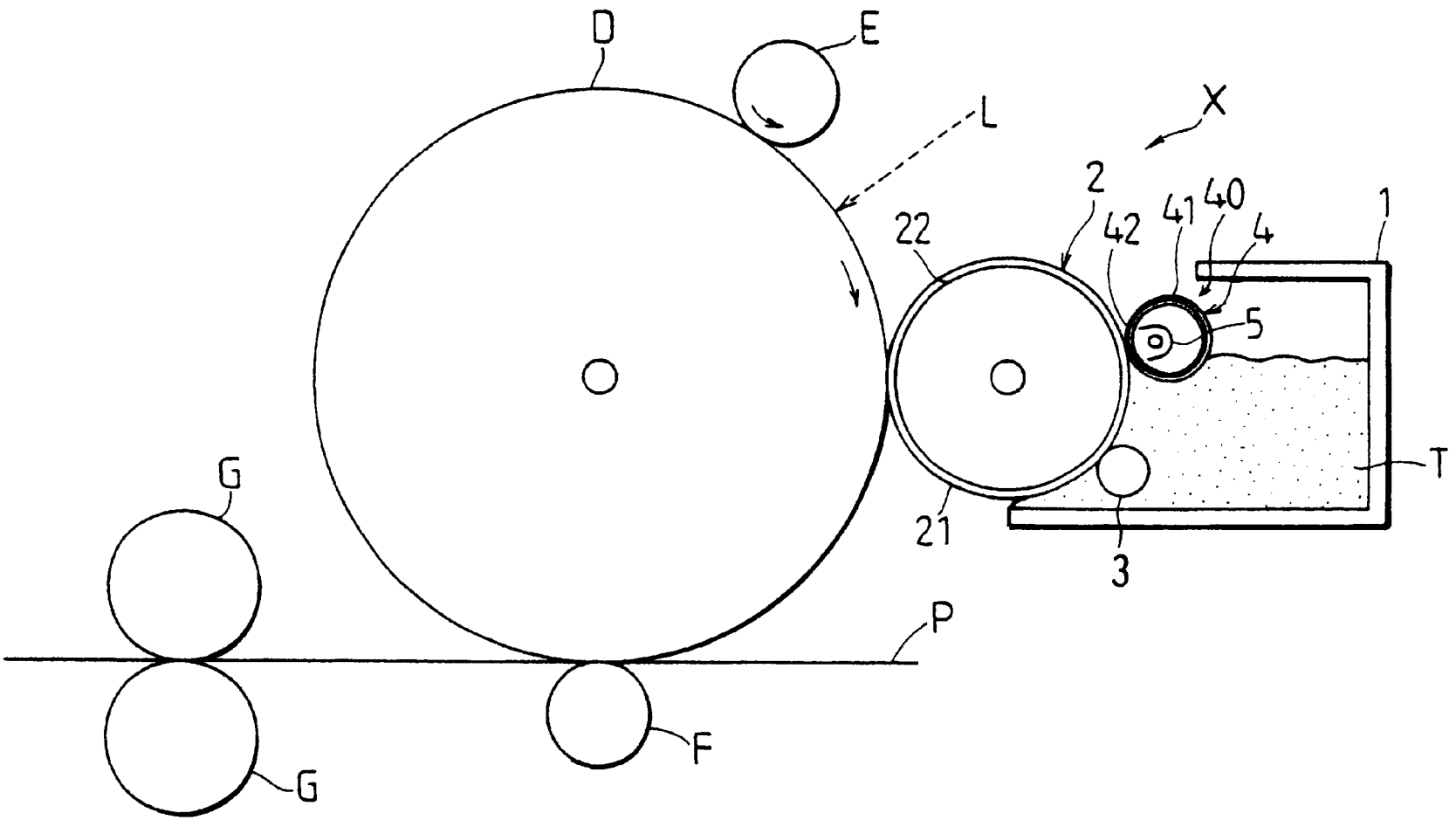
FIG. 1 is a vertical cross-sectional view showing a developing device and its neighborhood in accordance with embodiment 1 of the present invention.

FIG. 1 is a cross-sectional view showing, as an example, a developing device in accordance with embodiment 1 of the present invention.

In the developing device X of FIG. 1, toner T composed of a single-component developing agent as a charged member is used. The developing device X includes a developing chamber 1 shaped like a container to hold the toner T; a developing roller 2 housed rotatably in a lower part of the developing chamber 1; a supply roller 3, rotatably provided side by side to the developing roller 2 so that the external circumferential surfaces of the two rollers oppose each other under the developing roller 2 on one side (right-hand side in FIG. 1) of the developing roller 2, for supplying the toner T in the developing chamber 1 to the external circumferential surface of the developing roller 2; a toner-charging roller 4 as charging means, rotatably provided side by side to the developing roller 2 so that the external circumferential surfaces of the two rollers oppose each other above the developing roller 2 on one side of the developing roller 2, for charging the toner T in the developing chamber 1 through contact; and an ultraviolet irradiator 5 as irradiation means for shining ultraviolet light (light) onto the toner-charging roller 4 to charge the toner T.

The developing roller 2 is constituted by a cylindrical sleeve 21 made of a non-magnetic substance and a magnet roller 22 provided inside the sleeve 21. The magnet roller 22 has magnetic poles (not shown) divided by lines radially extending from its center and arranged side by side along the direction of rotation (indicated by an arrow in FIG. 1). In this case, the developing roller 2 is rotatable as the sleeve 21 is rotatable relative to the magnet roller 22 in a fixed state.

The magnetic poles in the magnet roller 22 are, namely, the one located opposite to the surface of the supply roller 3 to cause the toner T supplied by the supply roller 3 to adhere to the developing roller 2; the one located adjacent to this magnetic pole with respect to the direction of rotation of the sleeve 21 to form a developing brush on the surface of the sleeve 21 (on the developing roller 2) by strings of the toner (particles) T adhering to the developing roller 2 like teeth of a brush; the one located adjacent to the magnetic pole with respect to the direction of rotation of the sleeve 21 to transport the developing brush while keeping it adhering onto the developing roller 2; the one located, adjacent to the magnetic pole with respect to the direction of rotation of the sleeve 21, in a developing position where it faces the surface of a photosensitive drum D as a latent image carrier to transport an electrostatic latent image on it; and the one adjacent to the magnetic pole with respect to the direction of rotation of the sleeve 21 to strip a part of the toner T (developing brush) that is not directly involved in development from the surface of the developing roller 2 by means of magnetic relationship with the magnetic pole facing the surface of the supply roller 3. In this case, at the magnetic pole in a development position, the surface of the photosensitive drum D is rubbed using the developing brush to cause the toner to adhere to the electrostatic image on the surface of the photosensitive drum D to develop (visualize) it as a toner image.

The toner-charging roller 4 contains a material that changes its molecular structure under ultraviolet irradiation, such as a photochromism compound, a photopolymerized compound, or a photooxidative substance and is provided with a light-transparent cylindrical sleeve 41 and a cylindrical, light-transparent roller 42 provided inside the sleeve 41. In the toner-charging roller 4, the sleeve 41 and the roller 42 constitute transport means 40 for rotating with relative rotation of the sleeve 41 to the roller 42 in a fixed state and thus moving the surface of the sleeve 41 where it contacts the toner T in the direction of rotation. In this case, it is specified that the toner T contacts the toner-charging roller 4 and falls off the contact surface of the toner-charging roller 4 after the contact.

Further, a gap (not shown) is formed between the external circumferential surface of the sleeve 41 of the toner-charging roller 4 and the external circumferential surface of the developing roller 2 so that the toner can be transported through the gap. The toner-charging roller 4 has another function as layer thickness restricting means to restrict the layer thickness (the distance of the gap) of the toner T transported to the gap formed with the external circumferential surface of the developing roller 2 by specifying a facing position with respect to the external circumferential surface of the developing roller 2.

The ultraviolet irradiator 5 is provided in the roller 42 inside the toner-charging roller 4. The ultraviolet irradiator 5 shines ultraviolet light (light) from a position opposite to the toner T with respect to the toner-charging roller 4 toward the gap between the external circumferential surface of the sleeve 41 of the toner-charging roller 4 and the external circumferential surface of the developing roller 2, to charge the toner T transported to the gap.

In FIG. 1, P is paper, E is a charging roller charging the photosensitive drum D to form an electrostatic latent image on the external circumferential surface of the photosensitive drum D, F is a transfer-use discharging roller for transferring, onto the paper P, the toner image (visual image) developed on the external circumferential surface of the photosensitive drum D, and G is a pair of vertically adjacent fixing rollers for fixing the transferred toner image onto the paper P. The arrow depicted in broken lines in FIG. 1 represents a laser beam L emitted from a laser scanner unit (not shown) to produce an electrostatic latent image on the external circumferential surface of the photosensitive drum D.

Figure 2:
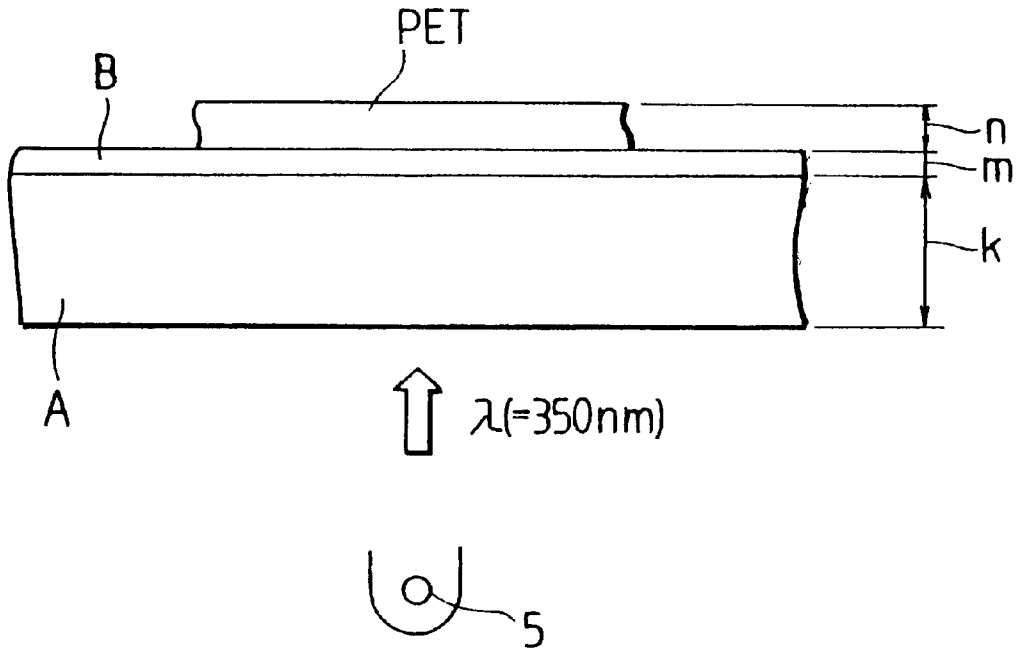
FIG. 2 is an explanatory view showing, as an example, a charging method through contact employed in the developing device.

Now, a method of charging through contact will be described, as an example, for use with the developing device X. Specifically, in reference to FIG. 2, an experiment in the charging through contact will be described, as an example, in which the toner T is charged as the sleeve 41 of the toner-charging roller 4 changes its molecular structure under ultraviolet irradiation by the ultraviolet irradiator 5.

First, a light-transparent acrylic plate A with a thickness k (=3 mm) was prepared for use in place of the roller 42 in the toner-charging roller 4. A diluted solution prepared by adding a small amount of alcohol to a mixture of imidazole derivative (B-CIM) and toluene ($C_6H_5CH_3$) was applied to the surface (upper side in FIG. 2) of the acrylic plate A using a glass bar and dried naturally, form a charging film B as charging means with a thickness of m (=60 $\mu$m) for use in place of the sleeve 41 in the toner-charging roller 4.

Next, the charging film B was capped with polyethylene terephthalate PET as a charged member in place of the toner T with a thickness n (=100 $\mu$m).

The ultraviolet irradiator 5 then shines ultraviolet light with a wavelength, $\lambda$ (=350 nm) from a position on the back of the acrylic plate A (the lower side in FIG. 2) onto the charging film B. The irradiation lasted one minute with an energy of 30 mW/cm$^2$ to 40 mW/cm$^2$.

The polyethylene terephthalate PET was charged to +30 V.

From this, it is now known that the toner T can be charged by causing the toner T in contact with electrostatic latent image on the photosensitive drum D to contact the external circumferential surface of the sleeve 41 in the toner-charging roller 4 and irradiating the sleeve 41 (toner-charging roller 4) with the ultraviolet light from the ultraviolet irradiator 5.

This eliminates the need to charge the toner T by means of rubbing of the developing roller with the layer-thickness-restricting blade. Therefore, the stress (toner damage) experienced by the toner T because of mechanical rubbing can be controlled to prevent toner deterioration, and the toner T can be prevented from fusing with the toner-charging roller 4 (developing roller, layer-thickness-restricting blade, etc.) due to frictional heat. Further, since the sleeve 41 of the toner-charging roller 4 contains material (for example, a photochromism compound, a photopolymerized compound, and a photooxidative substance, etc.) that changes its molecular structure under ultraviolet irradiation by the ultraviolet irradiator 5 in such a manner to charge the toner T, the toner T can be actively charged by inducing change in molecular structure of the toner-charging roller 4. Consequently, the developing device X is improved in terms of reliability.

Further, since the external circumferential surface of the sleeve 41 of the toner-charging roller 4 with respect to the toner T moves in the direction of rotation, the toner T is charged on a continuously renewed part of the external circumferential surface of the sleeve 41 of the toner-charging roller 4, resulting in improved charging properties and reliability of the toner T. Further, since the toner falls off the external circumferential surface of the sleeve 41 of the toner-charging roller 4 after contact, the amount of toner T (charging amount) that contacts the external circumferential surface of the sleeve 41 of the toner-charging roller 4 is restricted, the toner T uniformly contacts the external circumferential surface of the sleeve 41 of the toner-charging roller 4 moving in the direction of rotation, and the stress experienced by the toner T is better restricted to effectively prevent deterioration of the toner T.

Further, the ultraviolet irradiator 5 shines ultraviolet light from a position opposite to the toner with respect to the toner-charging roller 4 toward the gap between the external circumferential surface of the sleeve 41 of the toner-charging roller 4 and the external circumferential surface of the developing roller 2; therefore, the amount of the light from the ultraviolet irradiator 5 can be prevented from decreasing due to the toner T, and the ultraviolet irradiator 5 can be prevented from becoming dirty with the toner T. In addition, the layer thickness of the toner T is restricted between the developing roller 2 and the toner-charging roller 4, the toner T restricted in thickness can be surely charged by the toner-charging roller 4, and the performance of the toner T in charging can be improved. Further, the thickness of the toner T transported to a position between the developing roller 2 and the toner-charging roller 4 is restricted in the gap between the developing roller 2 and the toner-charging roller 4, and the charge of the toner restricted in thickness can be optimized and stabilized. In addition, the amount of toner T adhering to the electrostatic latent image can be optimized and stabilized. Further, by specifying a position where the toner-charging roller 4 faces the external circumferential surface of the developing roller 2, the toner-charging roller 4 can assume another function as layer thickness restricting means to restrict the layer thickness of the toner T transported to the gap formed with the external circumferential surface of the developing roller 2; therefore, no separate layer thickness restricting means needs be provided. The dual role of the roller 4 contributes to reduction in overall cost.

Further, since the toner-charging roller 4 (sleeve 41) used is cylindrical and transparent to light, toner T uniformly contacts the entire external circumferential surface of the toner-charging roller 4; this is very advantageous in attempting improvement of charging performance of the toner T.

[Embodiment 2]

Now, embodiment 2 of the present invention will be described in reference to FIG. 3.

In this embodiment, layer thickness restricting means provided separately without the charging roller assuming a secondary role as layer thickness restricting means. The overall arrangement in embodiment 2 does not differ from embodiment 1 except for the layer thickness restricting means; members common to both embodiments are indicated by the same reference numerals and description thereof is omitted.

Figure 3:
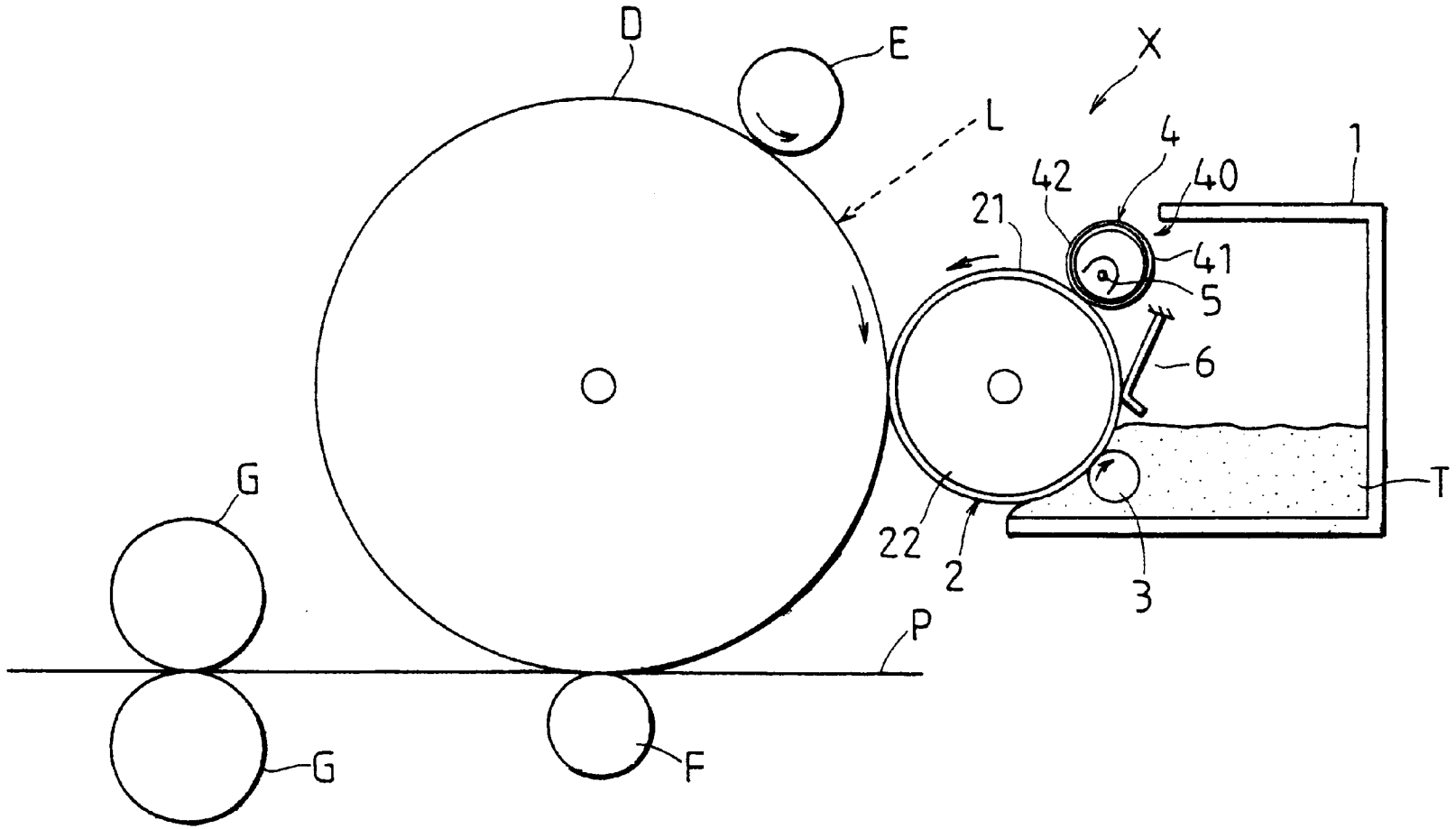
FIG. 3 is a vertical cross-sectional view showing a developing device and its neighborhood in accordance with embodiment 2 of the present invention.

In other words, in the present embodiment, as shown in FIG. 3, the toner-charging roller 4 is positioned inside the developing chamber 1 at its higher part. The toner-charging roller 4 is specified to receive a supply of toner T that will adhere to the developing roller 2 due to the magnetic poles of the magnet roller 22 facing the surface of the supply roller 3.

Upstream to the charging roller 4 with respect to the direction of transport of the toner T is there provided a layer-thickness-restricting blade 6 is provided as layer thickness restricting means for softly contacting, at its tip, the external circumferential surface of the developing roller 2 (sleeve 21) positioned between the supply roller 3 and the charging roller 4.

In this case, the layer-thickness-restricting blade 6 does not particularly need to rub the toner T to charge it; therefore, the tip of the layer-thickness-restricting blade 6 needs to be specified only to softly rub the surface so as to restrict the thickness of the toner T, allowing great reductions in toner damage.

[Embodiment 3]

Figure 4:
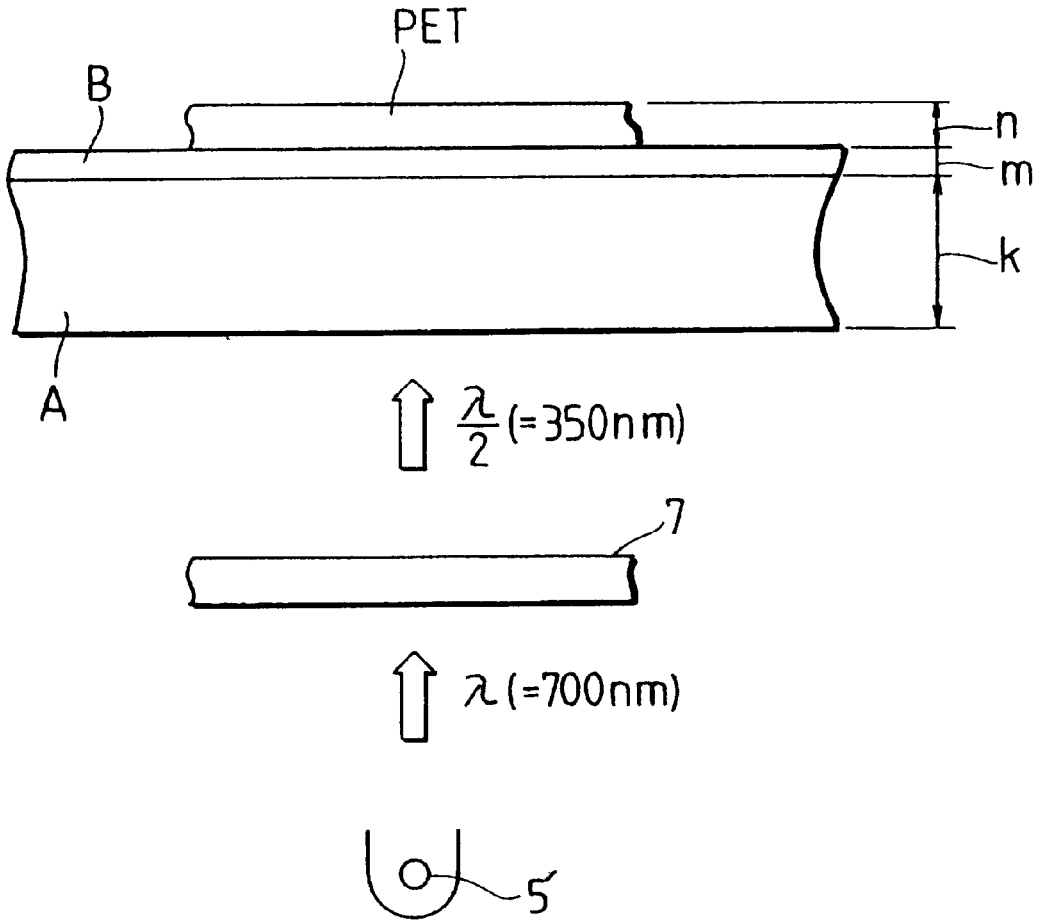
FIG. 4 is an explanatory view showing, as an example, a charging method through contact employed in a developing device in accordance with embodiment 3 of the present invention.

In the previous embodiments, the ultraviolet irradiator 5 shines ultraviolet light with a wavelength, $\lambda$ (=350 nm) from a position on the back of the acrylic plate A onto the charging means B to charge the polyethylene terephthalate PET up to +30 V. Alternatively, a wavelength converter element 7 composed of non-linear optical material may be provided, between the charging means B and the ultraviolet irradiator 5', as wavelength altering means for altering the wavelength of the ultraviolet light shone by the ultraviolet irradiator 5' onto the charging means B as shown in FIG. 4, when the ultraviolet irradiator 5 emitting ultraviolet light with a wavelength $\lambda$ (=350 nm) is hardly available due to cost or some other reasons. When this is the case, the ultraviolet light with wavelength $\lambda$ (=700 nm) emitted by the ultraviolet irradiator 5 is converted to ultraviolet light of a wavelength 350 nm by the wavelength converter element 7 before shone on the charging means B; there is no need to prepare the ultraviolet irradiator 5 that shines ultraviolet light of a wavelength $\lambda$ (=350 nm) which is optimum to the charging means B. An existent ultraviolet irradiator 5' can be used with the emitted ultraviolet light altered in wavelength from original $\lambda$ to half the value $\lambda/2$, allowing for reductions in the cost of the ultraviolet irradiator 5'.

Further, in the previous embodiments, the photosensitive drum D is used as a latent image carrier; needless to say, a photosensitive belt can be used as a latent image carrier.

[Embodiment 4]

The following will describe embodiment 4 of the present invention.

Figure 5:
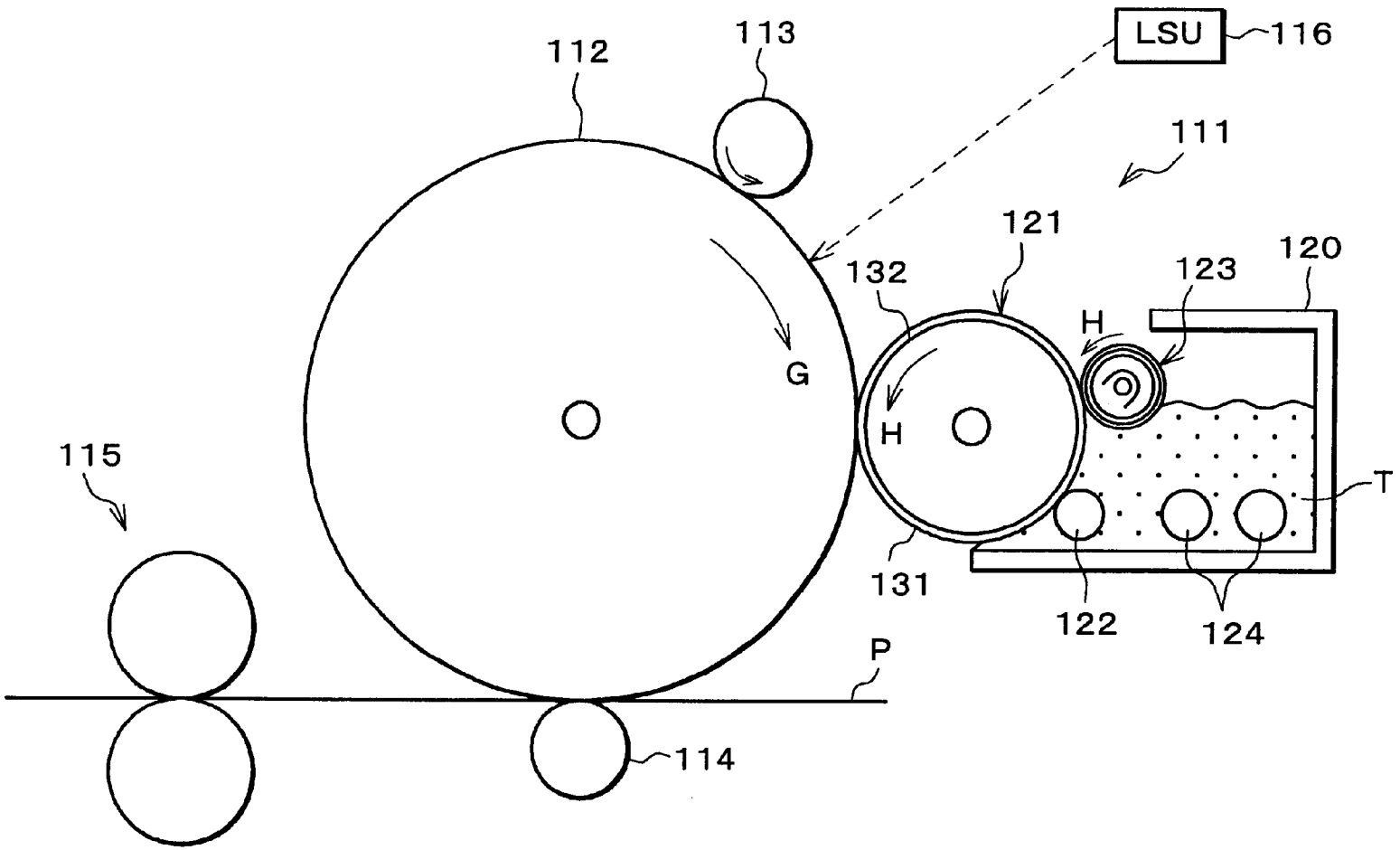
FIG. 5 is an explanatory view showing the configuration of a printing device in accordance with embodiment 4 of the present invention.

FIG. 5 is an explanatory view showing the configuration of a printing device (the present printing device) of the present embodiment. The present printing device is configured to use single-component magnetic toner as a developing material. As shown in FIG. 5, the present printing device is constituted by a developing section 111, a photosensitive drum 112, a charging roller 113, a transfer roller 114, a pair of fixing rollers 115, and an LSU116.

The photosensitive drum (latent image carrier) 112 is a photosensitive body shaped like a drum (roller) and provided with a photosensitive body on the surface and is adapted to be driven to rotate in the direction G. The charging roller 113 is for uniformly charging the surface of the photosensitive drum 112 to a predetermined potential.

The LSU (laser scanner unit) 116 illuminates the charged surface of the photosensitive drum 112 with a laser (represented by a broken line in FIG. 5) and has a function to form an electrostatic latent image on the surface of the photosensitive drum 112 according to external image data input.

The developing section (developing device) 111 is for forming a toner image on the photosensitive drum 112 by developing the electrostatic latent image formed by the LSU 116. The transfer roller (discharging roller for transfer) 114 is for transferring the toner image on the photosensitive drum 112 to paper P. The pair of fixing rollers 115 are for thermally fixing the toner image onto the paper P by applying heat and pressure to the paper P onto which the toner image is transferred.

Figure 6:
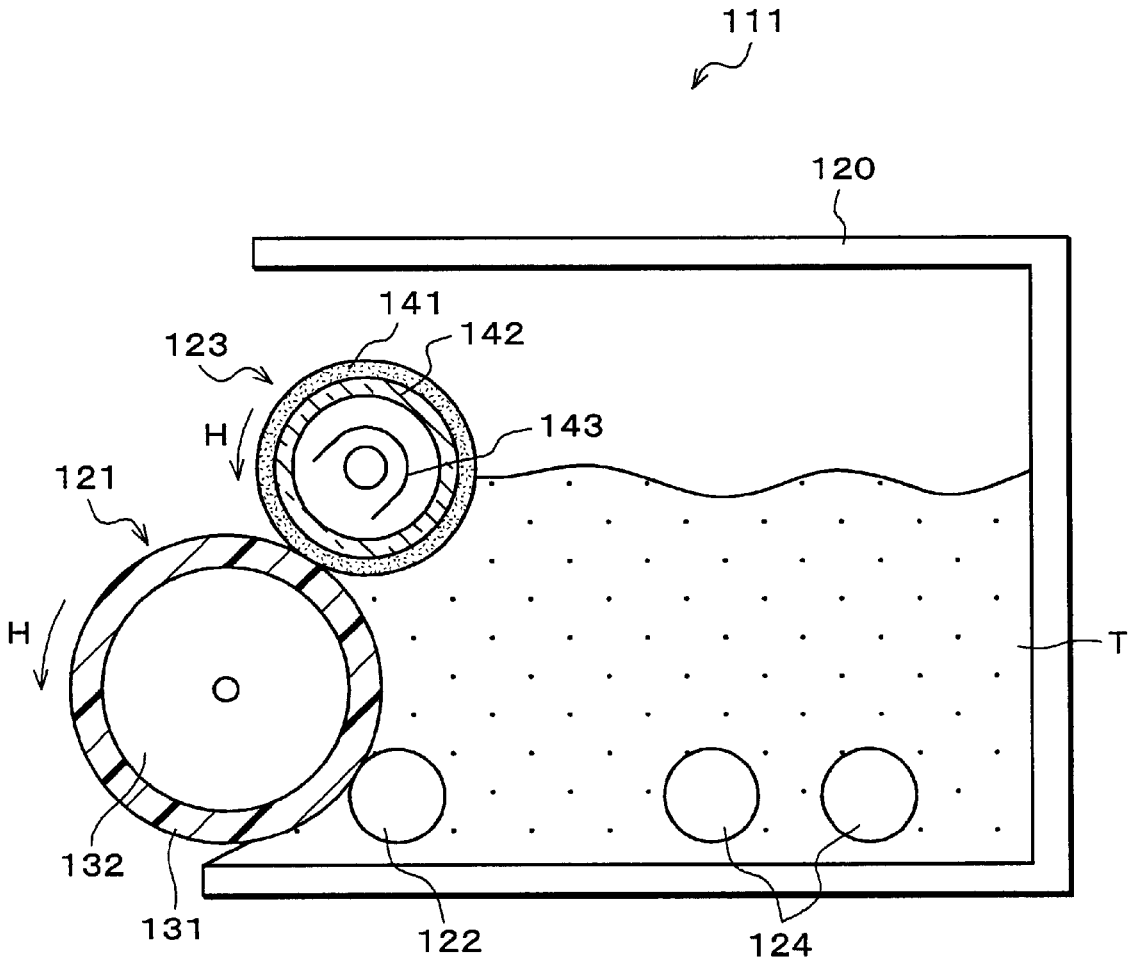
FIG. 6 is an explanatory view showing the configuration of a developing section in the printing device of FIG. 5.

Now, the developing section 111, which is unique to the present printing device, will be described. As shown in FIG. 6, the developing section 111 includes a developing chamber 120, a developing roller 121, a toner supply roller 122, a toner-charging roller 123, and an agitation roller 124.

The developing chamber 120 is a container (toner vessel) to hold the toner T.

The agitation roller 124 is for agitating the toner in the developing chamber 120 to charge the toner to a small degree.

The toner supply roller (supply roller) 122 is a cylindrical rotatable roller made of elastic foaming-rubber material and positioned opposite to the developing roller 121 in the developing chamber 120.

The toner supply roller 122 is under a predetermined bias voltage so as to attract and carry the toner and is adapted to rotate at an equal speed to the developing roller 121 in a reverse direction (represented as H) to the direction (G) of rotation of the developing roller 121 and contact the developing roller 121 with the toner carried on the roller 122.

The toner supply roller 122 is specified to have a rougher surface than the developing roller 121. The rougher the surface, the easier the roller can hold toner on it. Hence, the specification enables the toner supply roller 122 to form a toner layer on the surface (external circumferential surface) of the developing roller 121.

The toner-charging roller (charging section) 123 is a rotatable roller positioned opposite to the developing roller 121 downstream to the toner supply roller 122 with respect to direction H. The toner-charging roller 123 rotates in direction H at an equal to triple the speed of the developing roller 121 while in contact with the developing roller 121 so as to charge a toner layer on the developing roller 121 to a predetermined voltage value by means of charge through contact (detailed later).

The toner-charging roller 123 has another function to restrict the thickness of the toner layer formed on the developing roller 121 to predetermined values (10 $\mu$m to 40 $\mu$m). The toner-charging roller 123 will be described later in details in terms of configuration.

The developing roller (transport section) 121 is a cylindrical rotatable roller made of elastic conducting-rubber material and positioned opposite to the photosensitive drum 112.

The developing roller 121 is specified to rotate (50 mm/s to 150 mm/s) in direction H while in contact with the photosensitive drum 112 while carrying the toner layer formed by the rollers 122, 123 on the roller 121. This causes toner to adhere to, and thereby develop, the electrostatic latent image on the photosensitive drum 112 into a toner image.

Now, the configuration of the developing roller 121 will be described in details.

As shown in FIG. 6, the developing roller 121 includes a cylindrical sleeve 131 of a non-magnetic substance and a magnet roller 132 provided inside the sleeve 131. The developing roller 121 is adapted so that the magnet roller 132 is fixed relative to the present printing device and only the sleeve 131 is rotatable around the magnet roller 132.

The magnet roller 132 has magnetic domains (magnetic poles: none shown) divided by lines radially extending from its center (the magnetic domains are arranged side by side along the direction of rotation (direction H)).

The magnet roller 132 has five magnetic poles (the first to fifth magnetic poles) with mutually different functions.

More specifically, the first magnetic pole faces the toner supply roller 122 and attracts the toner T supplied from the toner supply roller 122 onto the sleeve 131.

The second magnetic pole is adjacent downstream to the first magnetic pole (downstream with respect to direction H) and is for causing the toner T attracted onto the sleeve 131 to form strings of toner particles like the teeth of a brush and thereby form a toner brush (developing brush) on the surface of the sleeve 131.

The third magnetic pole is adjacent downstream to the second magnetic pole and is for holding, and meanwhile transporting, the toner brush on the sleeve 131.

The fourth magnetic pole is adjacent downstream to the third magnetic pole and is placed at a developing position facing the surface of the photosensitive drum 112. In other words, the fourth magnetic pole is for developing (visualizing) the electrostatic latent image by rubbing the surface of the photosensitive drum 112 with the toner brush and thereby causing the toner to adhere.

The fifth magnetic pole is adjacent downstream to the fourth magnetic pole and is for stripping the surface of the sleeve 131 of residual toner T from the development by means of magnetic reaction with the first magnetic pole.

Next, the toner-charging roller 123 will be described which is a unique feature of the developing section 111.

As shown in FIG. 6, the toner-charging roller 123 is provided with a sleeve 141, a base roller 142, and an ultraviolet irradiator 143.

The base roller 142 is made of cylindrical glass or resin that is transparent to light and forms a base of the toner-charging roller 123.

The toner-charging roller 123 is adapted so that the base roller 142 is fixed relative to the present printing device and only the sleeve 141 is rotatable around the base roller 142 in direction H.

The sleeve (charging section, charging layer) 141, formed rotatably on the base roller 142, is cylindrical and transparent to light. The sleeve 141 contains a material that can charge toner in contact with the material when its molecular structure changes under ultraviolet irradiation (e.g., photochromic compounds (photochromic materials), photopolymerized compounds, and photooxidative substances: will be collectively referred to as charging substances).

Figure 7:
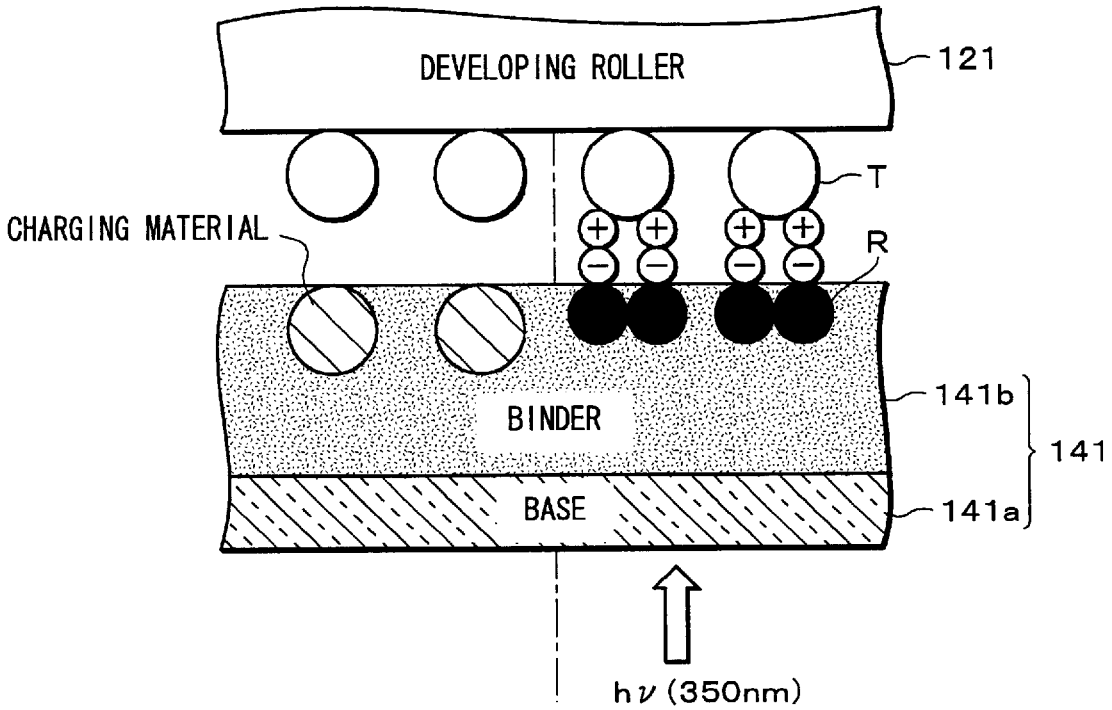
FIG. 7 is an explanatory view showing the mechanism of charging through contact of a toner-charging roller in the developing section of FIG. 6.

FIG. 7 is an explanatory view showing the mechanism of charge through contact by the toner-charging roller 123 (sleeve 141). As can be seen in the figure, the sleeve 141 includes a base (base roller) 141*a* that is transparent to ultraviolet light and a charging layer 141*b*.

The charging layer 141*b* is formed on the base 141*a* by applying binder (inorganic binder) in which charging material is dispersed. Under ultraviolet irradiation, the charging material is excited and changes its structure to become radicals (reactive active species) R. In other words, the charging material is activated on molecular levels and changed into radicals R which are an isomer.

The radical R is a strong oxidizer and removes an electron from material that comes into contact with it. The radical R is specified to oxidize the toner T in the developing section 111 by removing an electron from the toner T, charging the toner T to a desired positive level.

For more details about the charging material, see *Photo-induced Electrification at the Contact Interface between Photosensitive Layer and Insulator Films*, Journal of Chemical Society of Japan, 1992, No. 2, page 215 to 220. This article mentions that the surface of a polymerization layer can be charge through a photopolymerizing reaction of a monomer.

The ultraviolet irradiator (light irradiation section) 143, disposed inside the base roller 142, is a lamp shining ultraviolet light (light) to the sleeve 141 via the base roller 142.

Now, the operation of the developing section 111 will be described.

With the onset of a development process, the agitation roller 124 agitates the toner in the developing chamber 120 to charge the toner to a small degree. Then, the toner supply roller 122 applies the sufficiently agitated toner onto the sleeve 131 of the developing roller 121 rotating in direction H to gradually form a toner layer on the sleeve 131 in the direction of rotation.

The toner layer on the sleeve 131 is transported to a place (nip part) where the toner-charging roller 123 contacts the sleeve 141. The sleeve 141, rotating in direction H, restricts the thickness of the toner layer on the sleeve 131 in the nip part and charges the toner layer through contact.

In other words, the toner-charging roller 123 is designed so that the charging material on the sleeve 141 is excited and changes its structure under ultraviolet irradiation by the ultraviolet irradiator 143 to charge the toner on the sleeve 131 (charge-through-contact process).

Thereafter, the charged toner layer is moved to a position opposite to the photosensitive drum 112 and electrostatically attracted (supplied) to the electrostatic latent image on the photosensitive drum 112. Thus, the electrostatic latent image is developed (visualized) as a toner image.

It is specified so that the toner on the sleeve 131, which has been charged through contact with the sleeve 141, remains on the sleeve 131 without adhering to the sleeve 141 after passing through the nip part. This is achieved by the sleeve 141 having a greater surface roughness than the sleeve 131.

Figure 8:
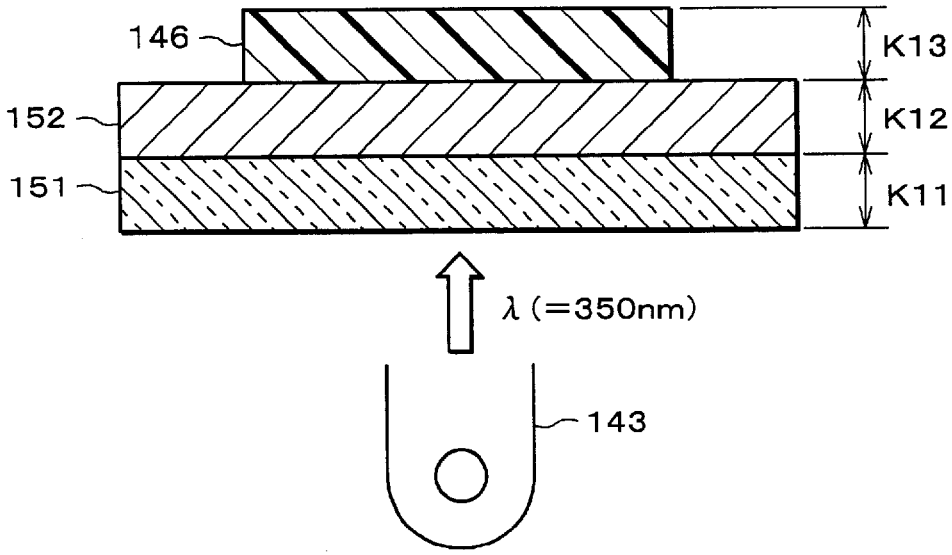
FIG. 8 is an explanatory view showing a sample used in an experiment to verify effects of the charge through contact illustrated in FIG. 7.

Next, an experiment to verify effects of the foregoing charging through contact will be described. FIG. 8 is an explanatory view showing a sample used in the experiment. The sample was a flat panel configured similarly to the toner-charging roller 123 in the developing section 111. To form the sample, a charging film 152 was provided on the surface of a transparent acrylic plate 151 and then capped with PET 146 as shown in FIG. 8.

The transparent acrylic plate 151 (thickness K11=3 mm) was composed of a transparent acrylic resin that was transparent to ultraviolet light, similarly to the base roller 142 and the base 141*a* of the sleeve 141.

To make the charging film 152 (thickness K12=60 nm), a diluted solution prepared by adding a small amount of alcohol to a mixture of toluene ($C_6H_5CH_3$) and imidazole derivative (B-CIM) which was a photochromic compound was applied onto the transparent acrylic plate 151 and dried naturally.

The PET 146 (thickness K13=100 $\mu$m) was composed of polyester resin (polyethylene terephthalate), the same material for the toner used in the present printing device, and molded in a panel-like shape.

In the experiment, the ultraviolet irradiator 143 shone ultraviolet light with a wavelength, $\lambda$ (=350 nm) from a position on the back of the transparent acrylic plate 151 (upward from the bottom, or from the side on which no PET 146 is provided, in FIG. 8). The irradiation lasted one minute with an energy of 30 mW/cm$^2$ to 40 mW/cm$^2$.

After the irradiation, the charge was measured on the contact surface of the PET 146 with the charging film 152.

The result showed that the PET 146 was charged to +30 V.

The result of the experiment verified that in the developing section 111 of the present printing device, the toner layer on the sleeve 131 of the developing roller 121 is charged by the toner-charging roller 123.

In the charge process by the developing section 111, it is specified, as described above, so that the toner T is charged by the toner-charging roller 123 equipped with a charging material. Consequently, there is no need to charge the toner by means of friction; thus, the toner is prevented from deterioration and fusion.

Conventionally, it was specified so that a bias voltage was applied to the blade for charging the toner to develop a difference in potential between the blade and the developing roller to facilitate charging of the toner. This, however, produced Joule heat due to the current flowing through the toner and was a cause to poor toner conditions.

By contrast, in the developing section 111, no bias voltage is applied to the toner-charging roller 123 or the developing roller 121. Toner conditions thereby are prevented deteriorating due to Joule heat.

Further, in the toner-charging roller 123, it is specified so that the contact surface of the sleeve 141 where it contacts the toner T is moved in the direction of rotation by rotating the sleeve 141 in direction H relative to the base roller 142 in a fixed state.

Thus, the toner T is charged on a continuously renewed part of the surface of the sleeve 141, and the toner layer on the developing roller 121 (sleeve 131) can be efficiently charged; thereby, the toner can be prevented from scattering in the device (falling off the developing roller) after the charging process due to insufficient charging.

In the developing section 111, the toner-charging roller 123 is specified to rotate ("counter-rotate") in the same direction as the developing roller 121, i.e., in direction H. In other words, the toner-charging roller 123 is specified to move in an opposite direction to the developing roller 121 in the nip part. The specification enables the toner-charging roller 123 to rotate in such a manner that the toner on the developing roller 121 returns to the interior of the developing section 111 (developing chamber 120) and thereby prevents the toner from scattering in the device.

Further, unlike a situation where the toner-charging roller 123 and the developing roller 121 move in the same direction in the nip part, the toner on the developing roller 121 can be charged on a continuously renewed part of the toner-charging roller 123, which enables the toner to be sufficiently charged even when a part of the toner-charging roller 123 malfunctions.

This enables uniform charging of the toner and better control of scattering of the toner.

Further, since the ultraviolet irradiator 143 is located inside the base roller 142, its amount of light can be reduced by the toner T. The ultraviolet irradiator 143 does not become dirty with the toner T either.

Further, the developing section 111 is designed so that the layer thickness of the toner T on the sleeve 141 can be restricted by the toner-charging roller 123 by suitable specification of the space in the nip part.

Further, the developing section 111 is specified so that the sleeve 141 is irradiated while restricting the layer thickness of the toner; thereby, an excessive amount of toner can be prevented from being charged.

Figure 9:
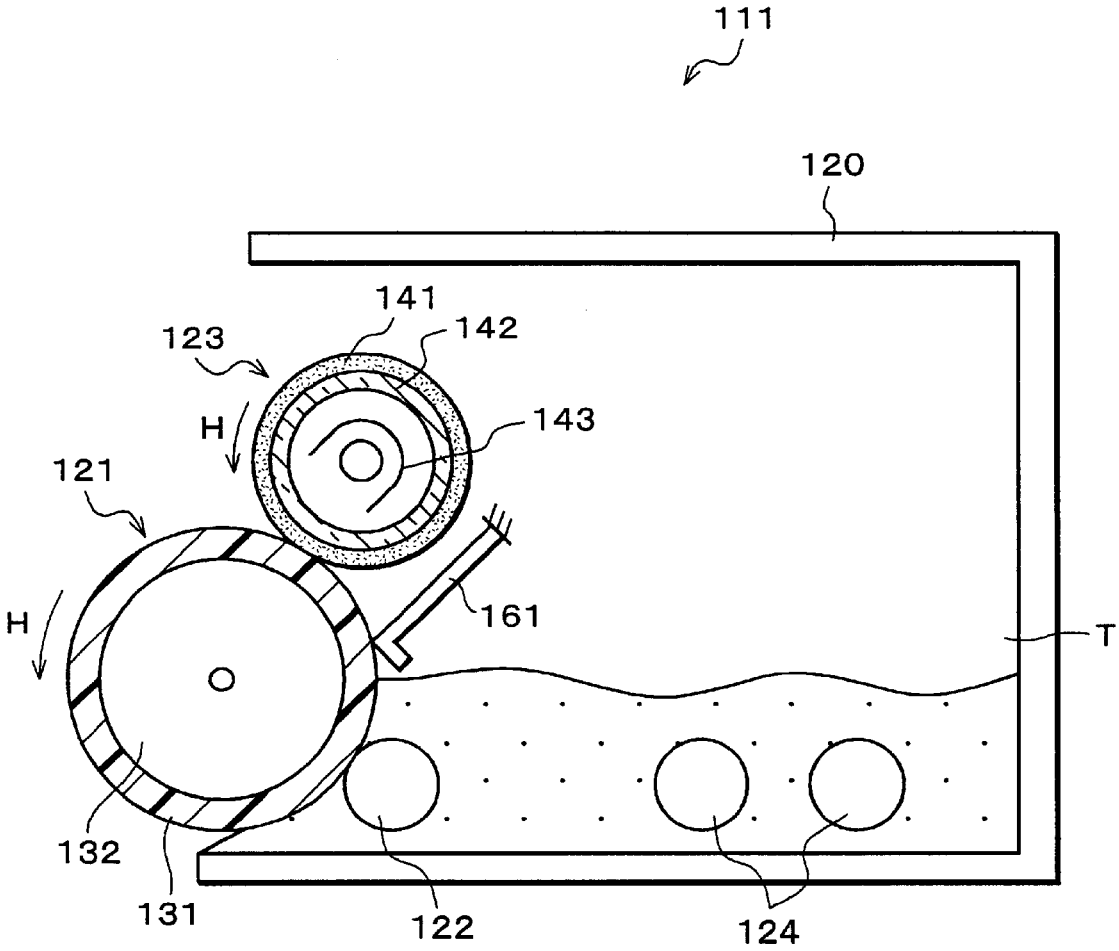
FIG. 9 is an explanatory view showing the configuration of a developing section equipped with a layer-thickness-restricting blade.

As shown in FIG. 9, a layer-thickness-restricting blade 161 may be provided between the toner supply roller 122 and the toner-charging roller 123 in the developing section 111. Since in the developing section 111, the layer-thickness-restricting blade 161 does not need to be biased to charge the toner, the damage made to the toner can be reduced greatly as compared with conventional configurations.

In the present embodiment, the ultraviolet irradiator 143 is used to irradiate the sleeve 141 of the toner-charging roller 123 with ultraviolet light having a wavelength of 350 nm; however, alternatives are possible. One of them is to use a light source capable of producing longer wavelengths (lower energy) to irradiate the sleeve 141 with ultraviolet light.

Figure 10:
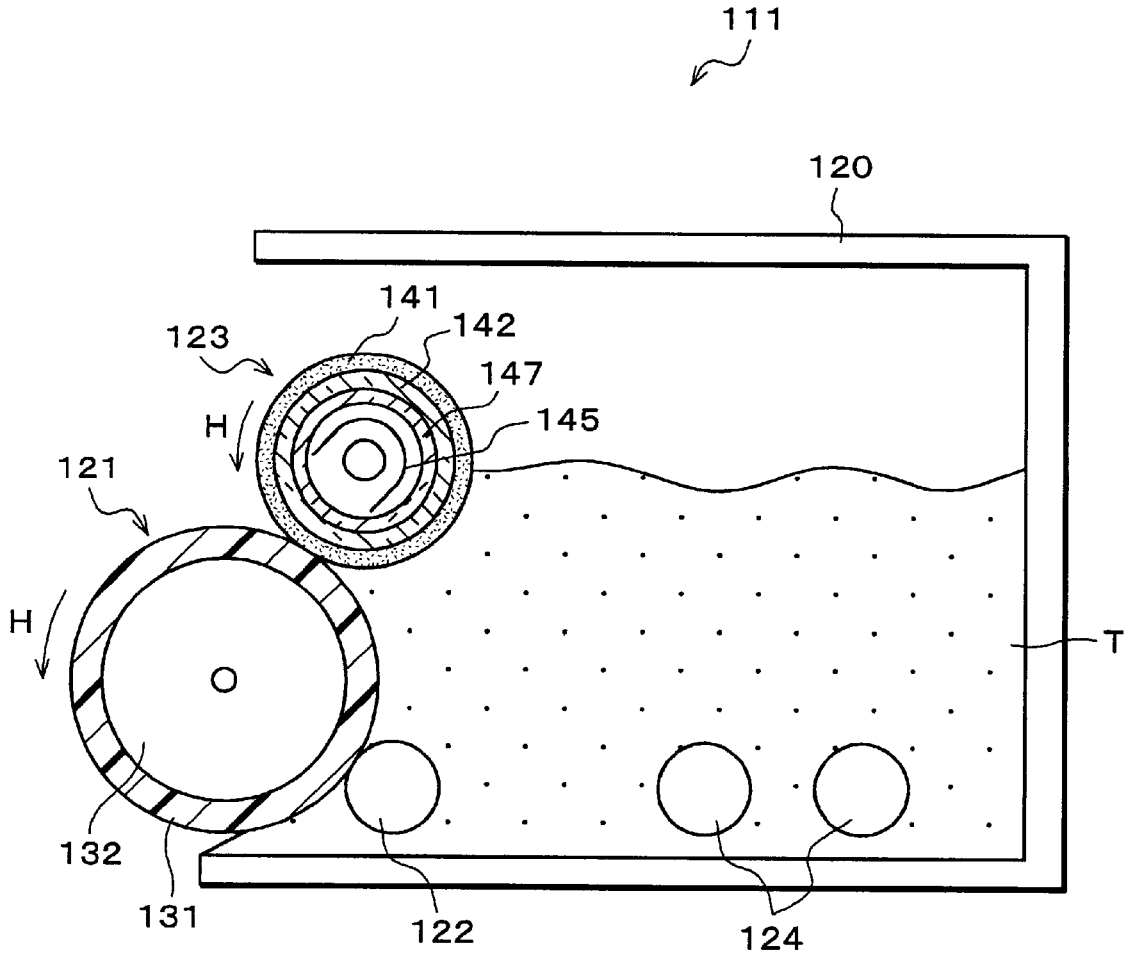
FIG. 10 is an explanatory view showing the configuration of a toner-charging roller equipped with a visual light irradiator.

FIG. 10 is an explanatory view showing a configuration of the toner-charging roller 123 incorporating such an alternative light source. The toner-charging roller 123 in FIG. 10 includes, instead of the ultraviolet irradiator 143, a visual light irradiator (light irradiation section) 145 capable of producing visual light having a wavelength of 700 nm and is provided with a wavelength converter element 147 on the inner wall of the base roller 142.

The wavelength converter element (wavelength altering section) 147 is cylindrical and is composed of non-linear optical material (non-linear optical crystals). The non-linear optical material is capable of producing, from two photons having a predetermined energy, a single photon having double the energy (produces second harmonics).

The provision of such a wavelength converter element 147 enables the visual light emitted with a 700 nm wavelength from the visual light irradiator 145 to be converted to ultraviolet light having a wavelength of 350 nm before shone onto the sleeve 141.

Thus, the visual light irradiator 145, which is inexpensive in comparison with the ultraviolet irradiator 143, can be used to charge the toner, and manufacturing costs of the developing section 111 can be reduced.

Further, in the present embodiment, the photosensitive drum 112 is used as a latent image carrier; alternatives are possible. One of them is to use a photosensitive belt (not shown) in lieu of the photosensitive drum 112.

Figure 11:
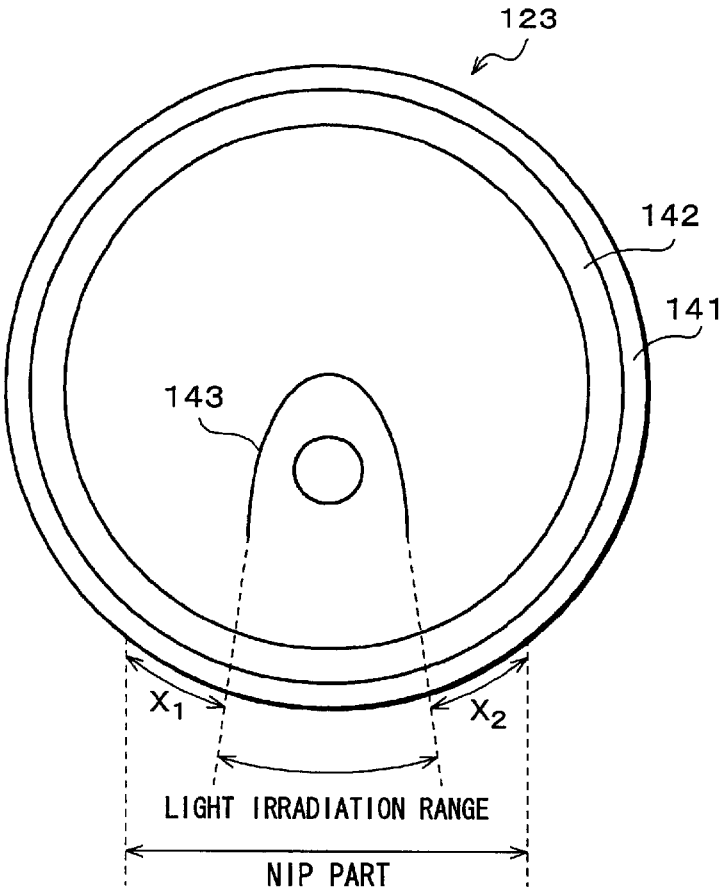
FIG. 11 is an explanatory view showing a nip part and a light irradiation range in the developing section of FIG. 6.

Further, in developing section 111, it is preferable if the nip part, in which the developing roller 121 (sleeve 131) contacts the toner-charging roller 123 (sleeve 141), is wider than the light irradiation range (charging domain sleeve 141) of the ultraviolet irradiator 143 as shown in FIG. 11.

The arrangement enables the toner layer to be restricted in thickness in an upstream part to the nip part (in the region X2) before being charged in the light irradiation range. Thus, the toner can be prevented from being charged unnecessarily and charged efficiently.

It is also preferable if of the two regions X1, X2 that are adjacent to the light irradiation range in the nip part, the region X2 is wider than the region X1 as shown in FIG. 11.

This is because the region X1, if wider than the region X2, cannot sufficiently restrict the toner layer thickness in the region X2 before the charging. Further, after the charging, the entire toner in the toner layer is charged in one polarity; therefore, if the toner layer is pressed in the region X1, toner particles may scatter as they repel one another electrically. By specifying the region X2 wider, the toner layer thickness can be sufficiently restricted, and the scattering of the toner can be brought under control.

It is preferable in the developing section 111 if the toner-charging roller 123 is spaced from the toner supply roller 122 by such a distance that the toner fallen off the toner-charging roller 123 due to the restriction on the toner layer thickness can return to the developing chamber 120 inside the device.

If the toner-charging roller 123 is positioned adjacent to the toner supply roller 122, the toner fallen due to the restriction on the layer thickness adheres directly to the toner supply roller 122 and is charged repeatedly, causing non-uniform charging. The positioning of the two rollers suitably spaced from each other allows the fallen toner to return to the developing chamber 120 where it is mixed with yet-to-be charged toner and thereby loses some of its charge. The toner layer on the developing roller 121 is thus uniformly charged.

Further, as described in the foregoing, the developing section 111 is specified so that the toner on the developing roller 121 is charged by exciting the charging material in the sleeve 141 in the light irradiation range of the ultraviolet irradiator 143.

Further, since the sleeve 141 rotates in direction H, the charging material in the light irradiation range is arranged to gradually renewed.

Accordingly, it is preferable if the developing section 111 is specified so that the charging material that is in an excited state in the light irradiation range will have returned to ground state by the time it reenters the light irradiation range at the end of a single rotation after exiting from the light irradiation range with the rotation of the sleeve 141.

Such an arrangement can maintain the amount of the charging material in an excited state in the light irradiation range at a fixed level and thereby maintain the charge of the toner at a predetermined value (fixed value).

Under these circumstances, the charging material contains a photopolymerization initiator and a chain-transfer agent. The mix ratio dictates the probability for the charging material to change into an excited state. Therefore, in this case, it is preferable if the mix ratio of the photopolymerization initiator and the chain-transfer agent suitably specified so that the charging material is in ground state when it reenters the light irradiation range.

Further, it is preferable if the developing section 111 incorporates such a control section to adjust the speed of rotation of the sleeve 141, the amount of light shone by the ultraviolet irradiator 143, or the amount of the toner on the developing roller 121 transported to the nip part (the amount of toner actually charged) according to the mix ratio of the charging material.

Figure 12:
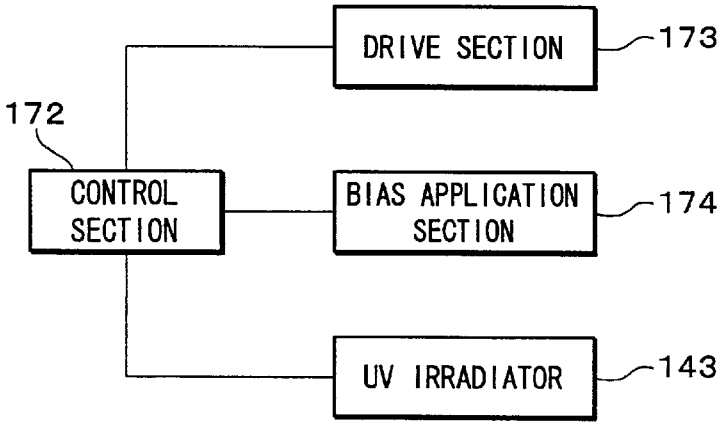
FIG. 12 is an explanatory view showing a control section provided in the developing section of FIG. 6.

FIG. 12 is an explanatory view showing a configuration of such a control section 172. As shown in FIG. 12, the control section 172 is connected to a drive section (such as a motor) 173 for rotating the sleeve 141, the ultraviolet irradiator 143, and a bias application section 174 for applying a bias voltage to the toner supply roller 122. Through the control of these members, the control section 172 can adjust the speed of rotation of the sleeve 141, the amount of light shone by the ultraviolet irradiator 143, and the amount of the toner on the developing roller 121 transported to the nip part.

The use of such a control section 172 readily enables the charging material to be in ground state when reentering the light irradiation range.

The mix ratio of the photopolymerization initiator and the chain-transfer agent will be described in detail later in embodiment 5.

Further, in the present embodiment, throughout the charging process, the sleeve 141 of the toner-charging roller 123 is specified to rotate in direction H while in contact with the sleeve 131 of the developing roller 121. However, the direction and speed of rotation of the sleeve 141 can be freely specified through the control by the control section 172.

For example, the sleeve 141 of the toner-charging roller 123 may be specified to rotate in the direction G ("forward rotation") through the control by the control section 172.

As a result of the arrangement, the sleeve 141 and the sleeve 131 move in the same direction when viewed locally in the nip part, and the toner on the sleeve 131 is prevented from rubbing the surface of the sleeve 141. Thus, the toner can be prevented from deteriorating due to friction with the sleeve 141.

Further alternatives are possible: the control section 172 may be specified so that the sleeve 141 of the toner-charging roller 123 halts during the charging process. In this arrangement, the sleeve 141 does not need to be rotated in synchronism with the sleeve 131, and the charging process becomes less complex.

Further, when this is the case, it is preferable if the control section 172 is specified to rotate the sleeve 141 of the toner-charging roller 123 by a predetermined angle at a predetermined point in time while the developing roller 121 is not moving.

Here, the predetermined point in time may be, as examples, (1) after the charging process is repeatedly performed on the toner on the developing roller 121 a predetermined number of times, (2) when the number of rotation of the developing roller 121 has reached a predetermined value, and (3) when the present printing device has printed a predetermined number of pages.

In other words, in a case where the sleeve 141 is caused to halt, the toner is always charged by the same part of the charging material, and that particular part of the charging material directly involved in the charging deteriorates locally. Therefore, it is preferable if a continuously altering part of the charging material is involved in the charging by rotating the charging roller by a predetermined angle at a predetermined point in time.

Thus, the charging material can be prevented from deteriorating locally. The predetermined number of turns or pages, which serves as a yardstick for the rotation of the charging roller, is specified according to the quality and amount of the light shone, the amount (mix ratio) and kind of the charging material, etc.

Although variable depending on the quality and amount of the light shone onto the charging material and the amount (mix ratio) and kind of the charging material, the predetermined number of rotation of 10000 or the predetermined number of printed pages of 1000 may be suitably employed.

Further, in the arrangement, to rotate the sleeve 141 only by a predetermined angle, it is preferable if the sleeve 141 is rotated in direction H, i.e., in the same direction as the developing roller 121. Thus, the residual, unnecessary toner on the developing roller 121 can be returned to the device, and scattering of the toner can be prevented.

Further, in the arrangement, to rotate the sleeve 141, it is preferable if the sleeve 141 is rotated to sufficiently alter the part of the charging material involved in the charging (by only such an angle to alter the part of the charging material positioned in the light irradiation range).

Thus, it is ensured that the charging material is renewed; local deterioration of the charging material can be satisfactorily prevented.

Alternatively, the sleeve 141 may be rotated to sufficiently alter its part where it contacts the developing roller 121 (nip part). In other words, if the sleeve 141 is caused to halt, the part of the sleeve 141 corresponding to the nip part wears due to friction with the developing roller 121 and the toner. Altering the worn part enables the toner to be charged satisfactorily, and the restriction of the toner layer thickness by the sleeve 141 can be done satisfactorily.

Further, in the present embodiment, the toner in the developing chamber 120 is agitated by the agitation roller 124; alternatively, the agitation roller 124 may be replaced with a mixing paddle to agitate the toner.

[Embodiment 5]

The following will describe embodiment 5 of the present invention. In the present embodiment, for convenience, members of the present embodiment that have the same arrangement and function as members of any one of embodiments 1 to 4, and that are mentioned in that embodiment are indicated by the same reference numerals and description thereof is omitted.

In the present embodiment, a charging material constituting the sleeve 141 of the toner-charging roller 123 will be described.

As described in the foregoing, the developing section 111 is specified to charge the toner on the developing roller 121 by exciting the charging material in the sleeve 141 in the light irradiation range of the ultraviolet irradiator 143.

Further, the charging material contains a photopolymerization initiator and a chain-transfer agent. Chemical formulae (1) and (2) below express the structures of the B-CIM and MBT that can be utilized as the photopolymerization initiator and the chain-transfer agent constituting the sleeve 141 in the developing section 111. Using these materials, the toner on the developing roller 121 can be charged in a satisfactory manner.

B-CIM:$C_{42}H_{28}Cl_2N_4$
2,2'-BIS(2-CHLOROPHENYL)-4,4',
5,5'-TETRAPHENYL-1,2'-BIIMIDAZOLE (1)

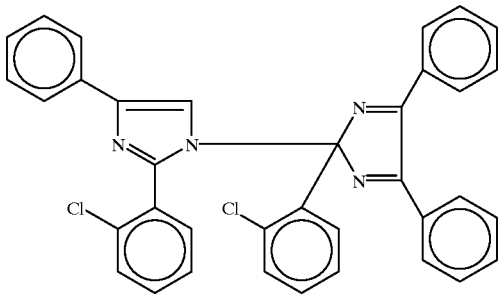

MBT:$C_7H_5NS_2$
2-Mercaptobenzochlazole (2)

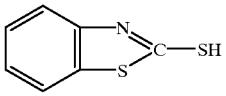

Note that as described in the foregoing, in the developing section 111, the mix ratio of the photopolymerization initiator and the chain-transfer agent (B-CIM and MBT) in the charging material dictates the probability for the charging material to change into an excited state.

It is preferred if the mix ratio of the B-CIM and the MBT in the charging material is set to such a value to sufficiently charge the toner on the developing roller 121. Here, "sufficiently charged toner" refers to toner with specific charge of 5 $\mu$C/g to 25 $\mu$C/g, which are charge levels that ensure development of the electrostatic latent image on the photosensitive drum 112.

Figure 13:
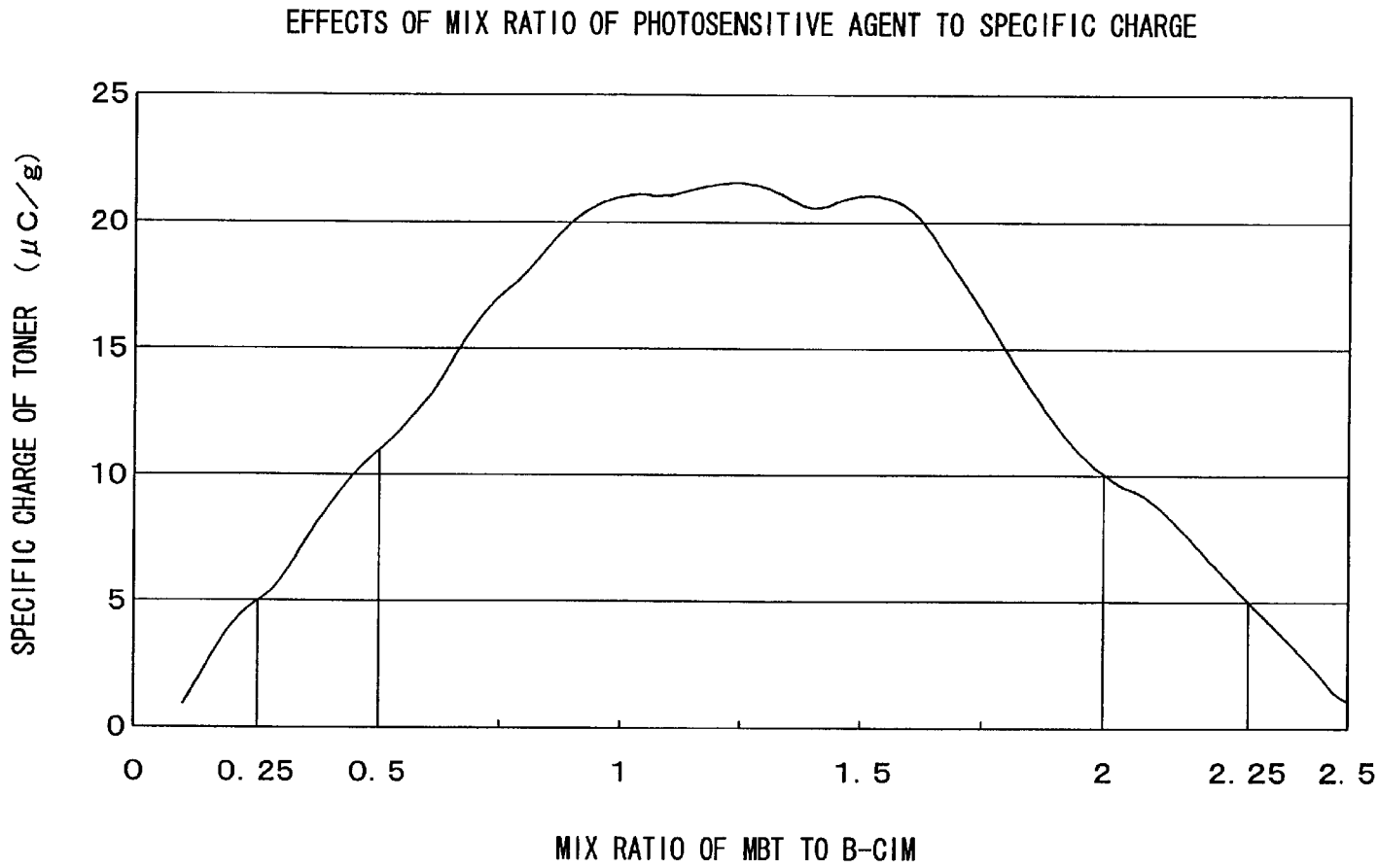
FIG. 13 is a graph showing a relationship between the charge of toner on a developing roller and the mix ratio of MBT to B-CIM in a charging material of a toner-charging roller.

FIG. 13 is a graph showing a relationship between the mix ratio of the MBT to the B-CIM in the charging material in the sleeve 141 and the charge of the toner on the sleeve 131 of the developing roller 121. The charges were measured while the sleeve 141 was rotated in direction H at double the speed of the sleeve 131.

From the graph, it can be said that to achieve charge level of 5 to 25 $\mu$C/g, the mix ratio of the B-CIM and the MBT is preferably set to 1:0.25 to 1:2.25 in terms of mole ratio.

Further, in the developing section 111, it is preferable if the amount of light shone by the ultraviolet irradiator 143 and the number of rotations of the sleeve 141 are controlled by the control section 172 to adjust the charge of the toner on the sleeve 131.

In other words, the control section 172 is specified to increase the charge of the toner by increasing the amount of light shone by the ultraviolet irradiator 143 or by slowing down the rotation of the sleeve 141, if the charge is insufficient even with the charging material having a predetermined mix ratio.

Conversely, if the toner is charged excessively on the sleeve 131, the control section 172 decreases the amount of light shone by the ultraviolet irradiator 143 or increases the speed of rotation of the sleeve 141 to decrease the charge of the toner.

[Embodiment 6]

Now, the following will describe embodiment 6 of the present invention. In the present embodiment, for convenience, members of the present embodiment that have the same arrangement and function as members of any one of embodiments 1 to 5, and that are mentioned in that embodiment are indicated by the same reference numerals and description thereof is omitted.

Figure 14:
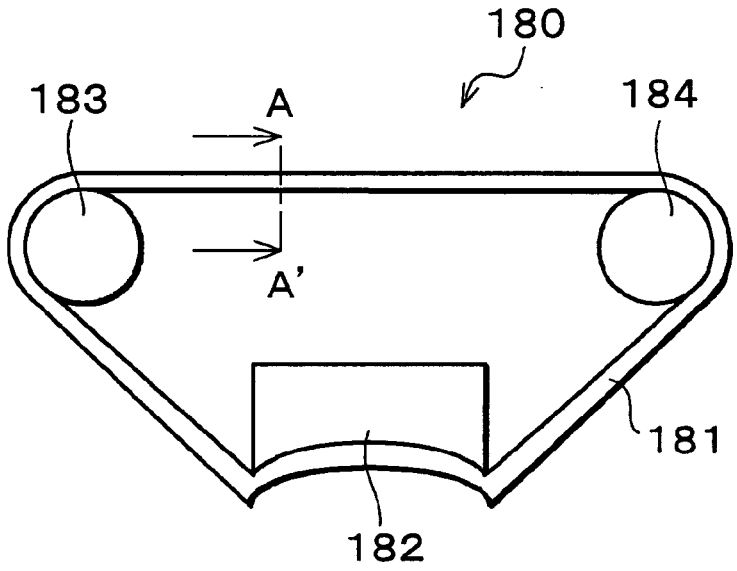
FIG. 14 is an explanatory view showing the configuration of a toner-charging section provided in a developing section of a printing device in accordance with embodiment 6 of the present invention.

A developing section 111 of the present embodiment includes a toner-charging section 180 shown in FIG. 14 in lieu of the toner-charging roller 123 shown in FIG. 6.

As shown in FIG. 14, the toner-charging section (charging section) 180 is provided with a toner-charging belt 181, an organic EL 182, a drive roller 183, and a non-driven roller 184.

Figure 15:
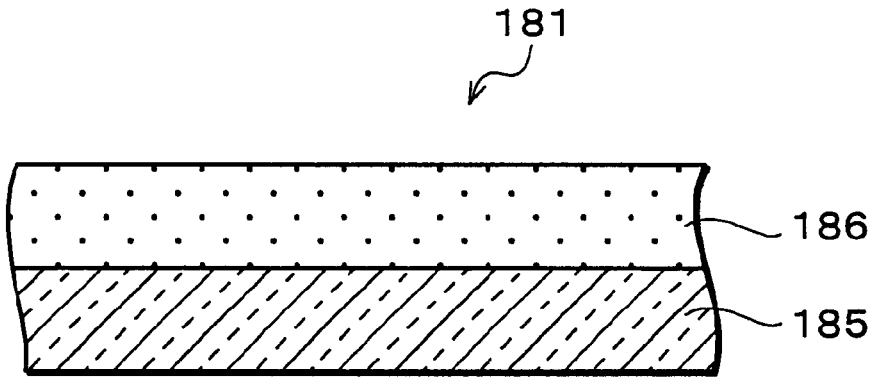
FIG. 15 is an explanatory view showing the configuration of a toner-charging belt in the toner-charging section of FIG. 14.

FIG. 15 is an explanatory drawing (cross-sectional view taken along line A–A' in FIG. 14) showing a structure of the toner-charging belt (charging section) 181. The toner-charging belt 181 is an endless (cyclic) belt constituted by a transparent film 185 and a charging layer 186 and is specified to rotate in direction H ("backward rotation"), i.e., the same direction as the developing roller 121, while in contact with the developing roller 121.

The transparent film (base film) 185 is a member composed of flexible, light-transparent film and serves as a base for the toner-charging roller 123. The charging layer 186 is a film formed outside the transparent film 185 and contains the same charging material as does the sleeve 141 (see embodiment 5).

The organic EL 182 shines ultraviolet light (light) onto the charging layer 186 via the transparent film 185. The organic EL 182 is an absolute-contact-type light source provided in absolute contact with the interior of the transparent film 185.

Further, the bottom of the organic EL 182 curves in accordance with the external shape of the developing roller 121. The toner-charging belt 181 is specified to contact the developing roller 121 where the organic EL 182 curves. In other words, in the toner-charging section 180, the curved part of the organic EL 182 serves as a nip part. The organic EL 182 is further specified to shine light onto the entire nip part.

The drive roller 183 is a drive device for rotating the toner-charging belt 181 in direction H. Further, the non-driven roller 184 is one of the rotation axes to support the rotation of the toner-charging belt 181. Further, the toner-charging section 180 is specified so that the organic EL 182 also serves to support the rotation of the toner-charging belt 181.

As shown in FIG. 14, the toner-charging belt 181 is supported by three members, i.e., the organic EL 182, the drive roller 183, and the non-driven roller 184, in such a manner to form a reverse triangle with the apex deformed by the organic EL 182 (trapezoid).

Now, the operations of the developing section 111 will be described.

With the onset of the development process starts, the toner supply roller 122 gradually forms, in the direction of rotation, a toner layer on the sleeve 131 of the developing roller 121 rotating in direction H. Thereafter, the toner layer on the sleeve 131 is transported to a part (nip part) where the toner-charging section 180 contacts the toner-charging belt 181. The toner-charging belt 181 rotating in direction H restricts the thickness of the toner layer on the sleeve 131 in the nip part and charges the toner layer through contact.

In other words, the toner-charging section 180 is specified to excite the charging material in the toner-charging belt 181 with the ultraviolet light shone by the organic EL 182 to change its structure and to charge the toner on the sleeve 131 (charging-through-contact process).

It is specified so that the charged toner layer is thereafter moved to a position where it faces the photosensitive drum 112 and electrostatically attracted to the electrostatic latent image on the photosensitive drum 112 to develop the electrostatic latent image as a toner image.

Note that it is specified so that the toner on the sleeve 131 charged by the toner-charging belt 181 through contact remains on the sleeve 131 without adhering to the toner-charging belt 181 after passing through the nip part. This is because the surface of the toner-charging belt 181 is rougher than that of the sleeve 131.

As described in the foregoing, the developing section 111 of the present embodiment utilizes no frictional force to charged the toner and can prevent toner deterioration.

Further, the toner-charging belt 181, whose base is a flexible, transparent film 185, is used in addition to the charging roller; therefore, the toner-charging section 180 allows for versatility in shape design and a reduction in size of the developing section 111. In other words, as shown in FIG. 14, in the present embodiment, the toner-charging belt 181 is a reverse triangle with a deformed apex (trapezoid); therefore, the height of the toner-charging belt 181 can be reduced in comparison with a roll-like belt.

Further, in the toner-charging section 180, an absolute-contact-type light irradiator for producing 250 nm to 350 nm wavelengths is used incorporating the organic EL 182. When the organic EL 182 is used in this manner, the toner-charging belt 181 is not damaged by heat even if the organic EL 182 is provided in absolute contact with the toner-charging belt 181. This allows for further reduction in size of the developing section 111.

Further, the organic EL 182 is specified to be provided in absolute contact with the interior of the toner-charging belt 181 in absolute contact and shine light on the entire nip part. The positioning of the organic EL 182 inside the belt allows for further reduction in size of the developing section 111 and prevents the toner fallen off the developing roller 121 from causing the organic EL 182 to become dirty.

Further, the duration of irradiation of the toner-charging belt 181 with the light emitted by the organic EL 182 is equal to the nip width in millimeters divided by the peripheral speed of the developing roller 121 in millimeters per second. To reduce the intensity of light (w/cm$^2$) emitted by the organic EL 182, the nip width (the width of the light irradiation range) is increased, since a greater nip width increases the duration of irradiation of the toner increases.

The toner-charging belt 181 is further specified to be endless (circular) and rotate in direction H while in contact with the developing roller. By causing the toner-charging belt 181 to rotate in this manner, the part of the toner-charging belt 181 where the toner-charging belt 181 contacts the developing roller 121 can be gradually renewed.

In other words, the part of the toner-charging belt 181 that is involved in charging can be renewed, and the charging material in the toner-charging belt 181 can be prevented from deteriorating locally. Since the toner layer on the developing roller 121 is efficiently charged, the toner can be prevented from scattering in the device after the charging process due to insufficient charge.

Further, in the present embodiment, the organic EL 182 is utilized as one of rotation axes of the toner-charging belt 181. The organic EL 182, thus provided to function as a rotation axis, allows for simplification of the device (device structure).

In the present embodiment, the toner-charging belt 181 is specified to rotate in direction H. However, alternatives are possible. One of them is to arrange the toner-charging belt 181 to rotate in the direction G.

Further, if the toner-charging belt 181 is arranged to rotate in the direction G, the toner-charging belt 181 may be specified to rotate by means of frictional force with the developing roller 121. In this arrangement, the toner-charging belt 181 is specified to be driven for rotation by the developing roller 121, and there is no need to provide a driving arrangement for the toner-charging belt 181, which allows for further simplification of the developing section 111.

[Embodiment 7]

The following will describe embodiment 7 of the present invention. In the present embodiment, for convenience, members of the present embodiment that have the same arrangement and function as members of any one of embodiments 1 to 6, and that are mentioned in that embodiment are indicated by the same reference numerals and description thereof is omitted.

Figure 16:
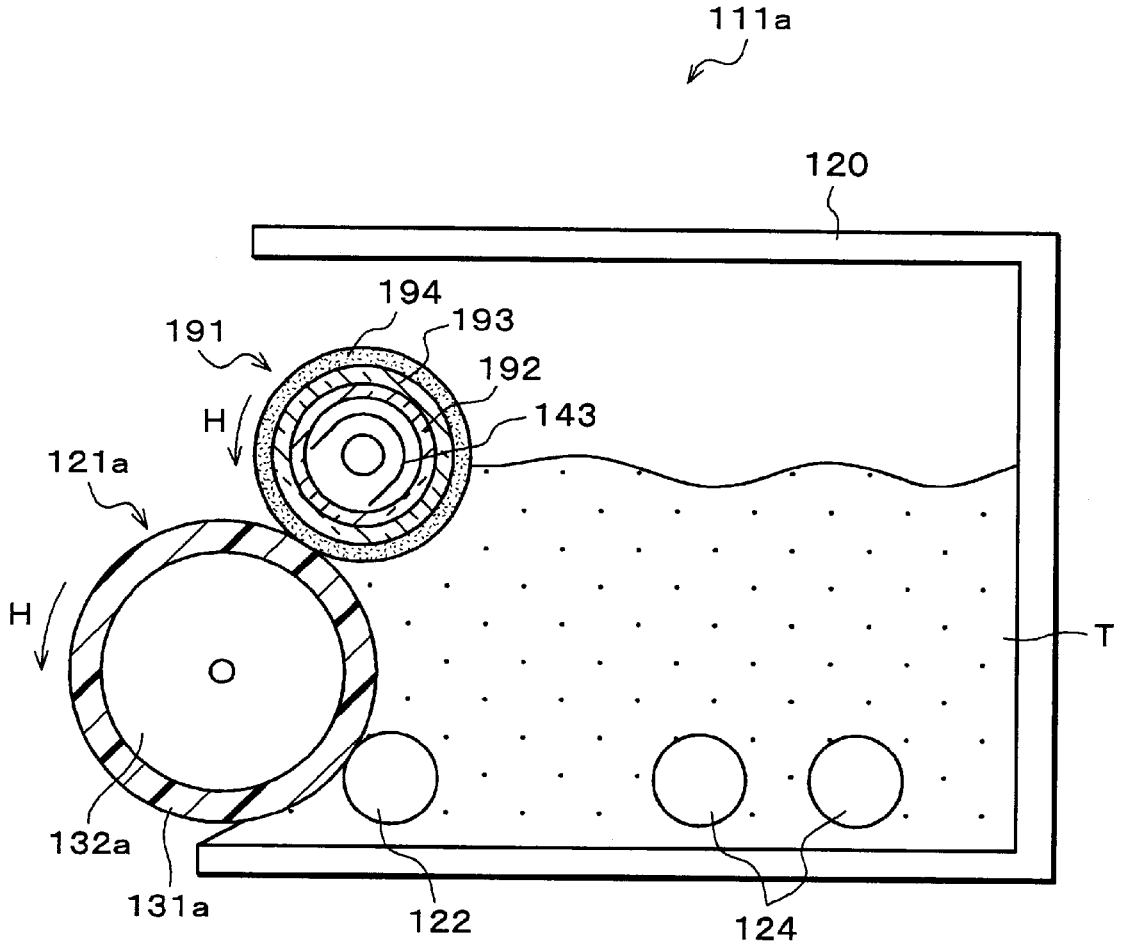
FIG. 16 is an explanatory view showing the configuration of a developing section provided in a printing device in accordance with embodiment 7 of the present invention.

The printing device of the present embodiment (the present printing device) is configured similarly to the printing device in FIG. 5, however, with a developing section 111*a* shown in FIG. 16 replacing the developing section 111 shown in FIG. 6. Further, the developing material is a single-component non-magnetic toner.

Further, the developing section (developing device) 111*a* is configured similarly to the developing section 111, however, with a toner-charging roller 191 and a developing roller 121*a* shown in FIG. 16 replacing the toner-charging roller 123 and the developing roller 121 replaced.

The developing roller (transport section) 121*a* is a rotatable roller disposed opposite to the photosensitive drum 112 (see FIG. 5). As shown in FIG. 16, the developing roller (transport section) 121*a* is cylindrical and includes an Al (aluminum) plain tube 132*a* on which a rubber layer 131*a* is formed of elastic conducting-rubber material. A predetermined developing bias is applied to the plain tube 132*a* in the developing roller 121*a*.

The developing roller 121*a* is specified to rotate in direction H at an equal speed to the photosensitive drum 112 while in contact with the photosensitive drum 112 while carrying the toner layer formed by the rollers 122, 123 on the roller 121*a*. This causes toner to adhere to, and thereby develop, the electrostatic latent image on the photosensitive drum 112 into a toner image.

The toner-charging roller (charging section) 191 is a rotatable roller positioned, similarly to the toner-charging roller 123, opposite to the developing roller 121*a* downstream to the toner supply rollers 122 with respect to direction H. The toner-charging roller 191 rotates in direction H at an equal to triple the speed of the developing roller 121*a* while in contact with the developing roller 121*a* to charge the toner layer on the developing roller 121*a* to a predetermined voltage value through contact.

Further, the toner-charging roller 191 has another function to restrict the thickness of the toner layer on the developing roller 121*a* to predetermined values (10 $\mu$m to 40 $\mu$m).

As shown in FIG. 16, the toner-charging roller 191 includes a base roller 192, a conducting ITO 193, and a charging layer 194.

The base roller 192 is a member composed of transparent acrylic resin permeable to ultraviolet light and forms a base for the toner-charging roller 191. The charging layer 194 is formed on the conducting ITO 193 by applying a binder (inorganic binder) in which the charging material (photochromic compounds, etc.) is distributed. In other words, the charging layer 194 is a layer formed by applying charging material on the conducting ITO 193.

Figure 17:
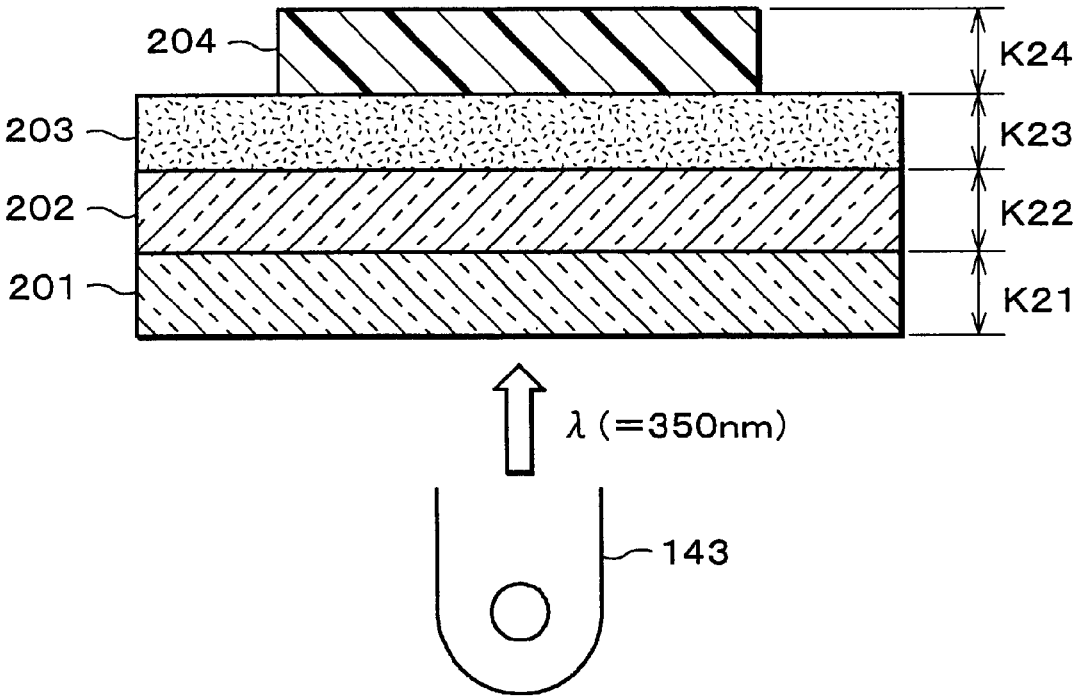
FIG. 17 is an explanatory view showing a sample used in an experiment to verify effects of the charge through contact performed by the developing section of FIG. 16.

Next, an experiment to verify effects of the foregoing charging through contact by means of the toner-charging roller 191 will be described. FIG. 17 is an explanatory view showing a sample used in the experiment. The sample was a flat panel configured similarly to the toner-charging roller 191 in the developing section 111*a*. To form the sample, an ITO film 202 and a photochromic film 203 were formed on the surface of the transparent acrylic plate 201 by coating and then capped with PET 204 as shown in FIG. 17.

The transparent acrylic plate 201 (thickness K21=1 mm to 5 mm) was composed of, similarly to the base roller 192, a transparent acrylic resin permeable to ultraviolet light.

Further, the ITO film 202 (thickness K22= a few dozen nm) and the photochromic film 203 (thickness K23= a few dozen $\mu$m) were composed of the same materials (ITO, B-CIM) as the conducting ITO 193 and the charging layer 194 respectively.

The PET (PES) 204 (thickness K4=10 $\mu$m to 100 $\mu$m) was composed of the polyester resin that was a material of the toner used in the present printing device.

The ultraviolet irradiator 143 shone ultraviolet light with a wavelength of 350 nm from a position on the same side as the transparent acrylic plate 201 onto the back of the sample (the lower side in FIG. 17). The ultraviolet light has an irradiation energy of 0.1 mW/cm$^2$ to 10 mW/cm$^2$ and a duration of a few seconds.

Thereafter, the charge on the surface of the PET 204 where it contacts the photochromic film 203 was measured. Results showed that the contact surface of the PET 204 had potentials of +30 V to +150 V.

It is understood from these results of the experiment that in the developing section 111*a* of the present printing device the toner-charging roller 191 can charge the toner on the developing roller 121*a* in a satisfactory manner if there is no difference in speed between the toner-charging roller 191 and the developing roller 121*a*.

Figure 18:
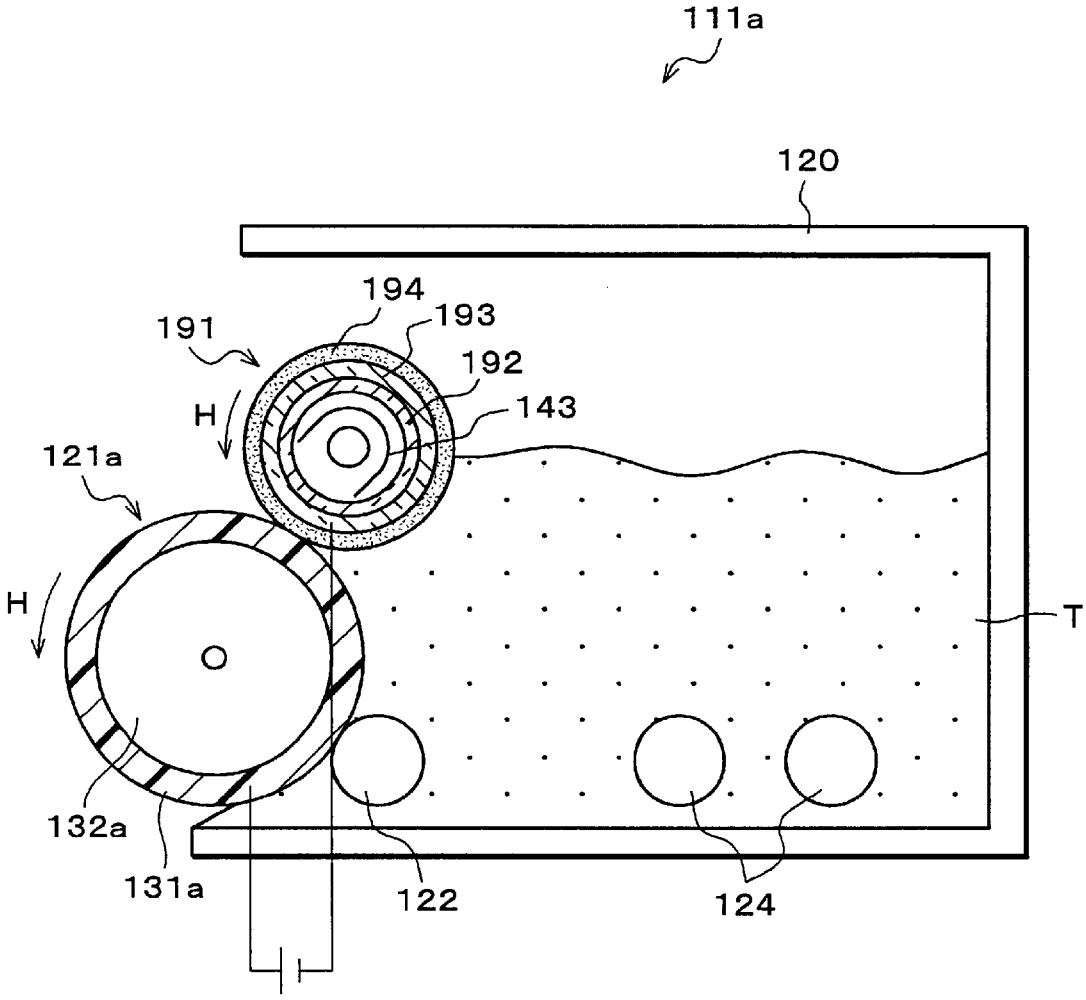
FIG. 18 is an explanatory view showing the configuration of the developing section of FIG. 16 in which a bias voltage is applied to the developing roller to develop a potential difference relative to the toner-charging roller.

Note that a voltage may be applied to bias the developing roller 121*a* relative to the conducting ITO 193 of the toner-charging roller 191 and develop an electric field with an intensity of 0.5 V/m to $2.5\times10^{-7}$ V/m between the rollers in the nip part (minimal space) as shown in FIG. 18. The electric field allows for improvement in efficiency in charging the toner-charging roller 191.

Further, it is preferable if in the developing section 111*a* the charging layer 194 of the toner-charging roller 123 has a surface that is less rough than that of the rubber layer 131*a* of the developing roller 121*a*. For example, if the charging layer 194 has a surface roughness (Ra; mean roughness at the central line) of 0.3 $\mu$m or less, it is preferable to set the surface roughness (Ra) of the rubber layer 131*a* to 0.5 $\mu$m to 2 $\mu$m.

The settings allows for prevention of the toner on the sleeve from adhering to the charging layer 194 when the charging layer 194 contacts the rubber layer 131*a* to charge the toner.

Figure 19:
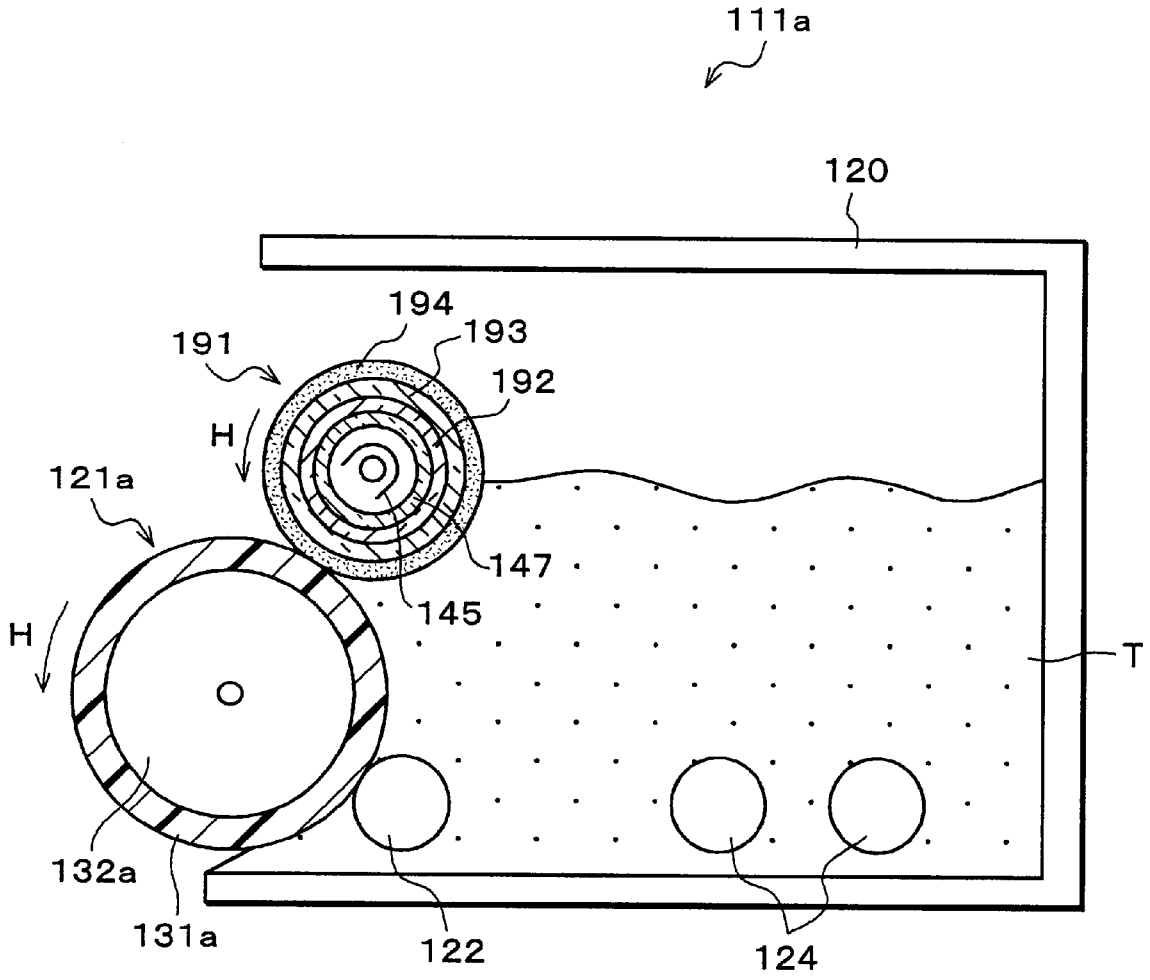
FIG. 19 is an explanatory view showing a configuration in which there is provided a visual light irradiator to the toner-charging roller in the developing section of FIG. 16.

Further, as shown in FIG. 19, a visual light irradiator 145 may be provided in lieu of the ultraviolet irradiator 143, with the wavelength converter element 147 disposed inside the base roller 192. The arrangement allows for reductions in manufacturing cots of the developing section 111*a* because it enables the use of the visual light irradiator 145, which is less expensive than the ultraviolet irradiator 143, to charge the toner.

[Embodiment 8]

The following will describe embodiment 8 of the present invention. In the present embodiment, for convenience, members of the present embodiment that have the same arrangement and function as members of any one of embodiments 1 to 6, and that are mentioned in that embodiment are indicated by the same reference numerals and description thereof is omitted.

Figure 20:
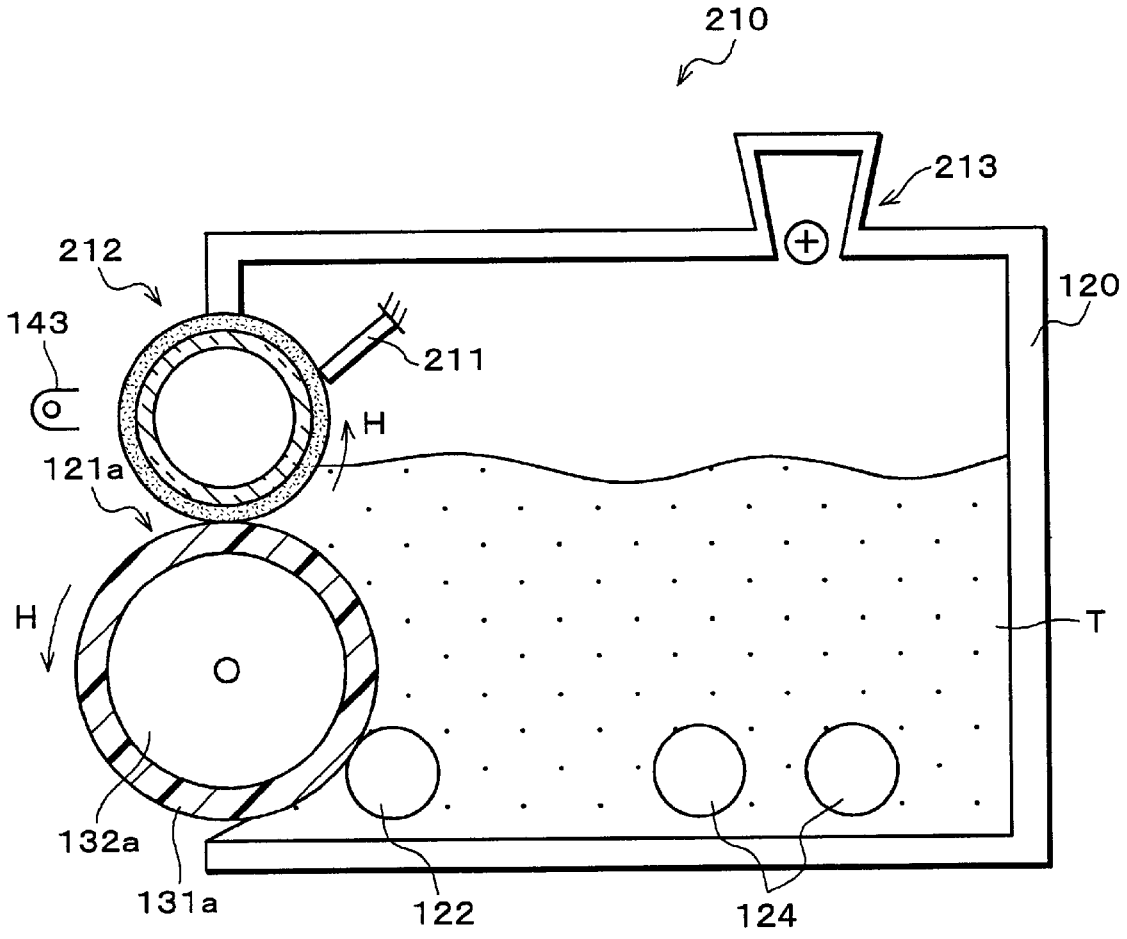
FIG. 20 is an explanatory view showing a configuration of a developing section in a printing device in accordance with embodiment 8 of the present invention.

The printing device of the present embodiment (the present printing device) is configured similarly to the printing device in FIG. 5 however, with a developing section 210 shown in FIG. 20 replacing the developing section 111.

As shown in FIG. 20, the developing section (developing device) 210 includes in addition to the configuration of the developing section 111 shown in FIG. 5, a cleaning blade 211 and a toner supplement port 213, with the toner-charging roller 212 replacing the toner-charging roller 123.

Besides, the ultraviolet irradiator 143 is located inside the toner-charging roller 123 in the developing section 111, but outside the developing chamber 120 in the developing section 210.

The toner-charging roller (charging section) 212 is a rotatable roller positioned, similarly to the toner-charging roller 123, opposite to the developing roller 121*a* downstream to the toner supply roller 122 with respect to direction H. Further, unlike the toner-charging roller 123, the toner-charging roller 212 is disposed right above the developing roller 121*a* so that a part of the roller 212 is located outside the developing chamber 120.

The toner-charging roller 212 rotates in direction H at an equal to triple the speed of the developing roller 121*a* while in contact with the developing roller 121*a* to charge the toner layer on the developing roller 121*a* up to a predetermined voltage value through contact.

Further, the toner-charging roller 212 has another function to restrict the thickness of the toner layer on the developing roller 121*a* to predetermined values (10 $\mu$m to 40 $\mu$m).

Figure 21:
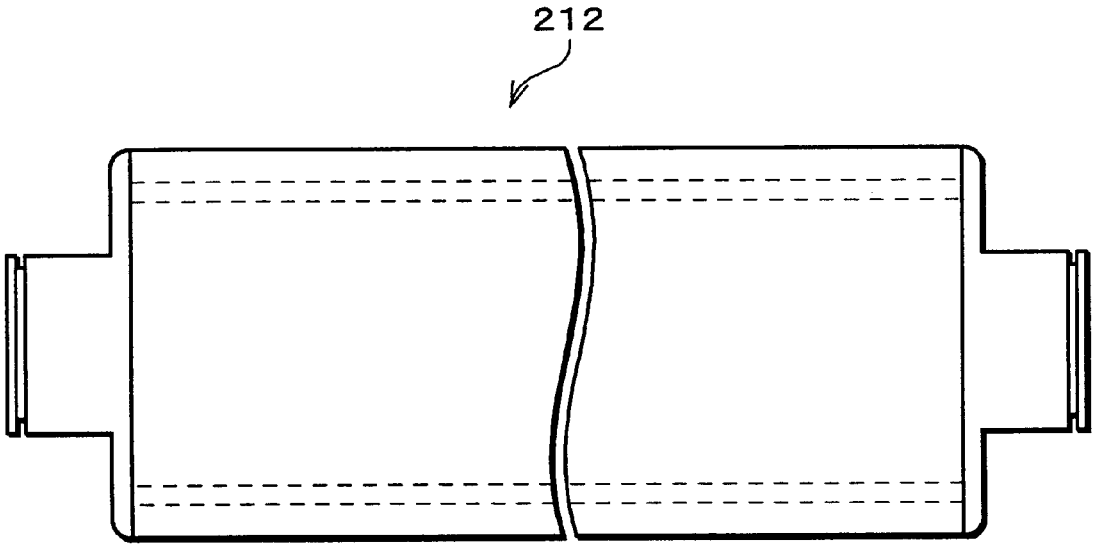
FIG. 21 is an explanatory view showing the external appearance of a toner-charging roller in the developing section of FIG. 20.
Figure 22:
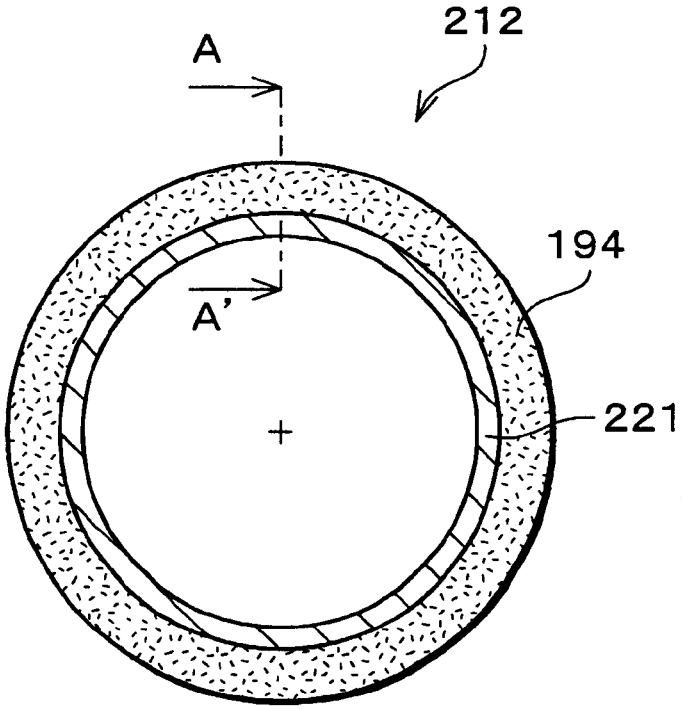
FIG. 22 is an explanatory view showing a cross section of the toner-charging roller of FIG. 21.
Figure 23:
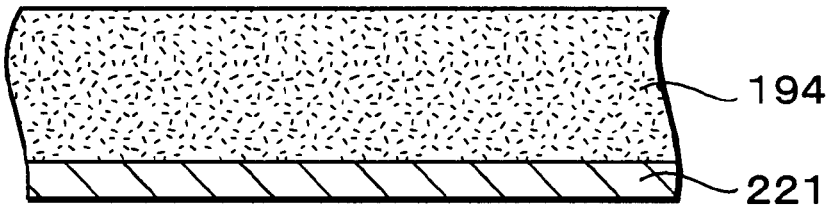
FIG. 23 is an explanatory view showing an alternative cross section of the toner-charging roller of FIG. 21.

FIG. 21 is an explanatory view showing the external appearance of the toner-charging roller 212. FIG. 22 is an explanatory drawing showing the cross-sectional view of the toner-charging roller 212. FIG. 23 is a cross-sectional view taken along line A–A' in FIG. 22.

As shown in these figures, the toner-charging roller 212 includes a core metal layer (base roller) 221 made of aluminum (thickness=0.8 mm) on which a charging layer 194 (thickness=60 $\mu$m) is formed by coating.

The cleaning blade (remover section) 211 scrapes excessive toner off the toner-charging roller 212 and transports it back to the developing chamber 120. The cleaning blade 211 is composed of a material having a lower hardness than (or an equal hardness to) the charging layer 194 so that it does not damage the surface of the charging layer 194.

Further, in the developing section 210, the ultraviolet irradiator 143 is disposed outside the developing chamber 120, upstream to the nip part with respect to direction H.

Figure 24:
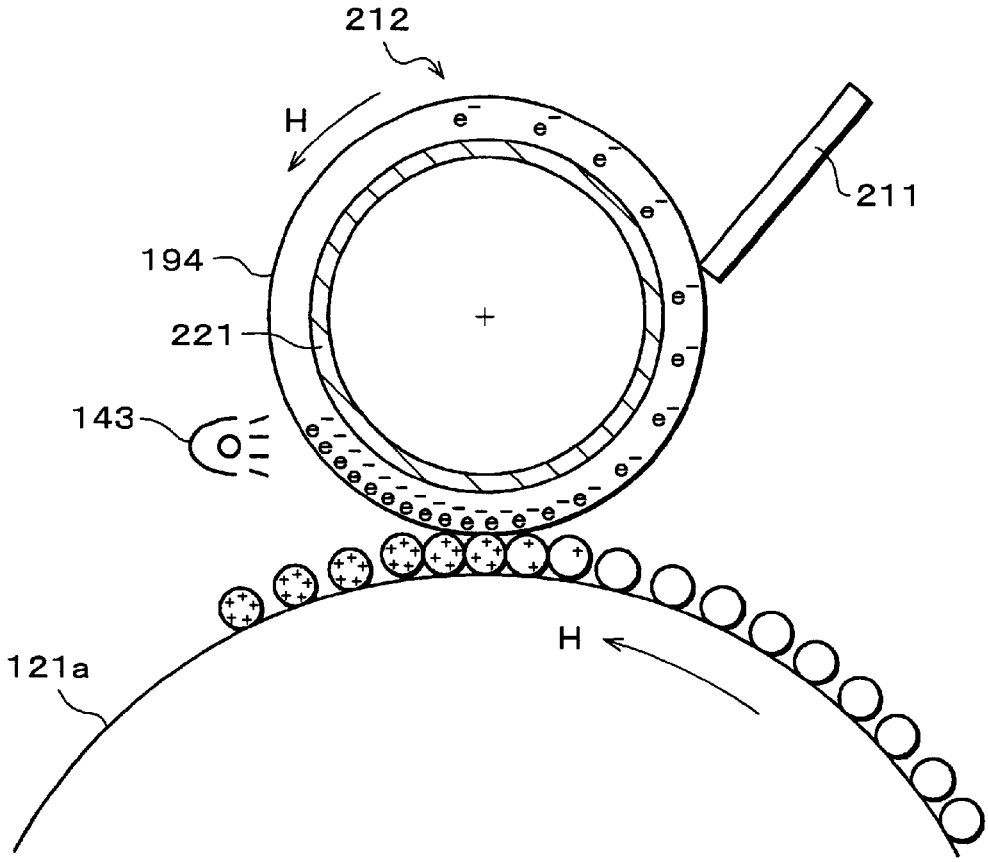
FIG. 24 is an explanatory view showing a mechanism of charge through contact performed in the developing section of FIG. 20.

Therefore, in the developing section 210, as shown in FIG. 24, the charging layer 194 of the toner-charging roller 212 is radicalized in the light irradiation range for the ultraviolet irradiator 143 (a part of the toner-charging roller 212 (charging layer 194) facing the ultraviolet irradiator 143) and transported to the nip part to charge the toner.

Next, the operation of the developing section 210 will be described.

With the onset of a development process, the agitation roller 124 agitates the toner in the developing chamber 120 to charge the toner to a small degree. Then, the toner supply roller 122 applies the sufficiently agitated toner onto the rubber layer 131*a* of the developing roller 121*a* rotating in direction H to gradually form a toner layer on the rubber layer 131*a* in the direction of rotation.

The toner-charging roller 212 is irradiated, while rotating in direction H, with ultraviolet light in the light irradiation range of the ultraviolet irradiator 143 disposed outside the developing chamber 120. The irradiation causes radicalization of the charging layer 194 in the light irradiation range.

The radicalized part is transported to the contact part (nip part) of the developing roller 121*a* between the toner-charging roller 212 where the toner layer on the developing roller 121*a* is restricted in thickness and charged through contact.

Thereafter, the charged toner layer is specified to be transported to a position opposite the photosensitive drum 112 and electrostatically attracted (supplied) onto the electrostatic latent image on the photosensitive drum 112, to develop (visualize) the electrostatic latent image as a toner image.

As described in the foregoing, the developing section 210 is specified so that the ultraviolet irradiator 143, located outside the toner-charging roller 212, shines ultraviolet light onto the charging layer 194.

Therefore, it is specified that the irradiation energy of the ultraviolet light can be efficiently used to activate the charging material (photochromic compound) in the charging layer 194 to form radicals.

In other words, in a configuration where ultraviolet light is emitted from a light source inside a toner-charging roller as in the developing section 111 shown in FIG. 6, ultraviolet light needs to be shone onto the charging material via a base applied on the charging material.

Therefore, the ultraviolet light is partially absorbed or scattered by the base, resulting in a low efficiency in the use of the ultraviolet light (efficiency in radicalization) and an increased energy (electrical power) consumption by the ultraviolet irradiator 143.

Further, it is preferable to provide a fan motor for cooling purposes or take other precautionary measures to avoid temperature rises in the toner-charging roller. However, such a configuration entails problems, such as an increased number of parts and an increased size of the developing section.

It is preferable to use, as a base for the charging material, material highly transparent to light, such as glass or transparent resin; however, these materials are difficult to improve in durability against vibration and fall and to reduce in costs.

By contrast, the developing section 210 is specified to utilize the ultraviolet light with high efficiency by means of direct irradiation of the charging layer 194 with the ultraviolet light from the ultraviolet irradiator 143 and resultant prevention of absorption and scattering by the base. The specification allows for reductions in power consumption by the ultraviolet irradiator 143.

Further, no transparent material needs to be used for the base; a strong and inexpensive material, such as metal, can be used instead. The arrangement allows for improvement of the toner-charging roller 212 in terms of durability and reductions in manufacturing costs.

Further, no fan motor for cooling purposes needs to be provided to avoid temperature rises in the toner-charging roller 212, allowing for prevention of an increased number of parts and increased manufacturing costs and also for reductions in size of the developing section 210.

Further, in the developing section 210, since the cleaning blade has a lower hardness than (or an equal hardness to) the charging layer 194, the surface of the charging layer 194 is protected from damage (carving).

The settings allows for stable toner charging over an extended period of time.

Further, the toner-charging roller 212 is specified to rotate in direction H ("backward rotation"), i.e., in the same direction as the developing roller 121*a*. In other words, the toner-charging roller 212 is specified to move in an opposite direction to the developing roller 121*a* in the nip part. The specification enables the toner-charging roller 212 to rotate in such a manner that the toner on the developing roller 121*a* returns to the interior of the developing section 111 (developing chamber 120) and thereby prevents the toner from scattering in the device.

Further, unlike a situation where the toner-charging roller 212 and the developing roller 121*a* move in the same direction in the nip part, the toner on the developing roller 121*a* can be charged on a continuously renewed part of the toner-charging roller 212 (charging layer 194).

This enables the toner to be sufficiently charged even when a part of the toner-charging roller 212 malfunctions. The toner can be charged uniformly, and the scattering of the toner is well controlled.

In the present embodiment, aluminum is specified for use as the core metal layer 221. However, the core metal layer 221 may be made of any other materials.

Further, it is preferable if the core metal layer 221 is made of a material that is not transparent to (nor reflect) ultraviolet light. Examples include metals whose surface has undergone a delustering process. The arrangement prevents ultraviolet light from permeating and/or reflecting at the core metal layer 221 and producing radicals from the charging layer 194 outside the light irradiation range and allows for extensions of the lifetime of the charging layer 194 (the lifetime of the charging material).

Further, the charging material radicalized under ultraviolet irradiation returns to ground state after a certain period of time. Therefore, it is preferred if the ultraviolet light from the ultraviolet irradiator 143 is shone as closely as possible to the nip part between the toner-charging roller 212 and the developing roller 121*a*. In other words, it is preferable if the light irradiation range of the ultraviolet irradiator 143 is located close to the nip part.

The arrangement enables highly concentrated radicals to be sent to the nip part.

Further, it is known that if it is specified that a charging material that is yet to completely return to ground state is resupplied to the light irradiation range of the ultraviolet irradiator 143, the efficiency in charging the toner drops. Further, in such a case, since the charging material is kept radicalized, the lifetime of the charging material is shortened.

Accordingly, it is preferable if the developing section 210 is specified so that the charging material radicalized in the light irradiation range of the ultraviolet irradiator 143 will have returned to ground state (inactive state) by the time it reenters the light irradiation range at the end of a single rotation after exiting from the light irradiation range with the rotation of the toner-charging roller 212. The specification is possible by adjusting the rotation speed of the toner-charging roller 212 by means of the control section 172 shown in FIG. 12.

The arrangement can prevent drops in charging efficiency and shorter lifetime of the charging material and maintain the amount of charging material in an excited state in the light irradiation range at a fixed value. Thus, the charge of the toner is maintained at a predetermined value (fixed value).

Figure 25:
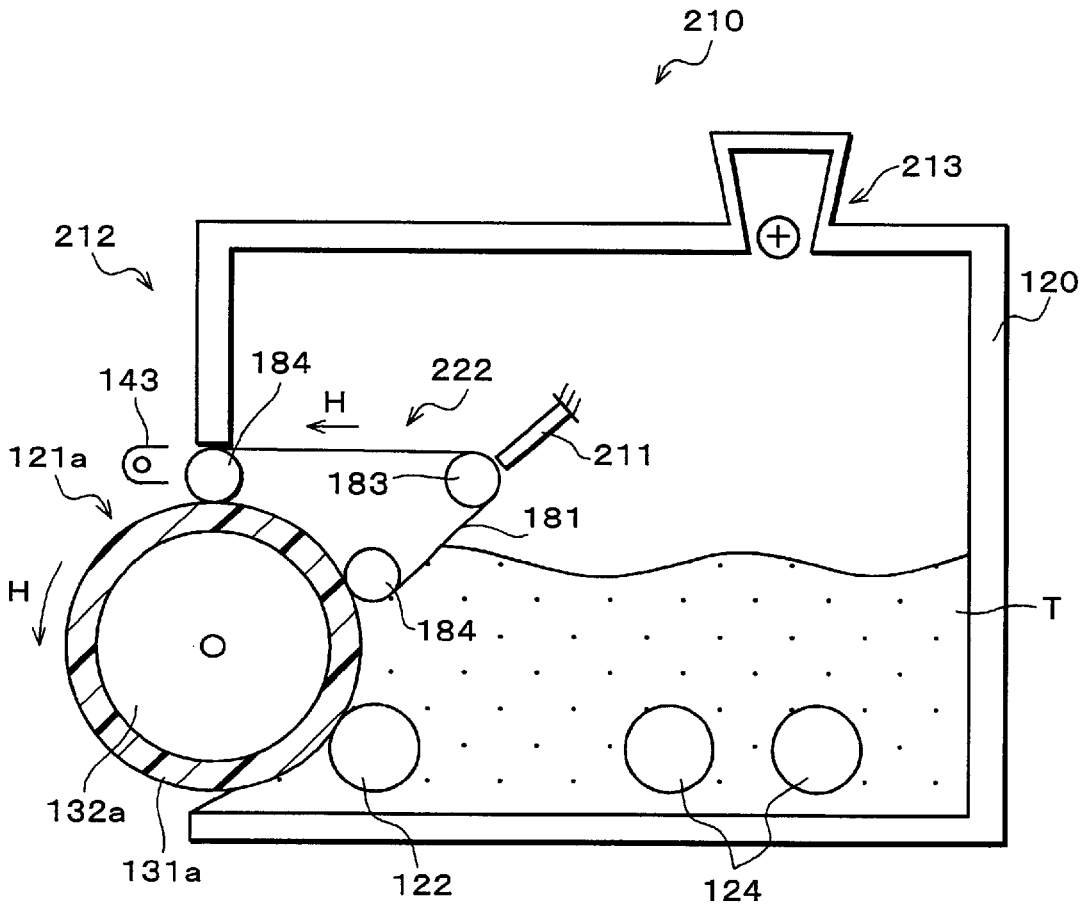
FIG. 25 is an explanatory view showing a configuration of the developing section provided with a toner-charging belt in the printing device in accordance with embodiment 8 of the present invention.

Further, the developing section 210 may be configured to include a toner-charging section 222 shown in FIG. 25 in lieu of the toner-charging roller 212.

As shown in this figure, the toner-charging section (charging section) 222 is specified to include the toner-charging belt 181, the drive roller 183, and the non-driven roller 184 shown in FIGS. 14 and 15, with the toner-charging belt 181 rotating in direction H, i.e., the same direction as the developing roller 121*a*.

In this arrangement, the width of the nip between the toner-charging belt 181 and the developing roller 121*a* can be set to any given value in design. Therefore, the radicals in the toner-charging belt 181 can be readily caused to contact the toner on the developing roller 121*a* for an extended period of time. Thus, more opportunities are created for exchange of electrons between the radicals and toner (increased efficiency in utilizing the radical reaction), and the charging properties of the toner can be improved.

Figure 26:
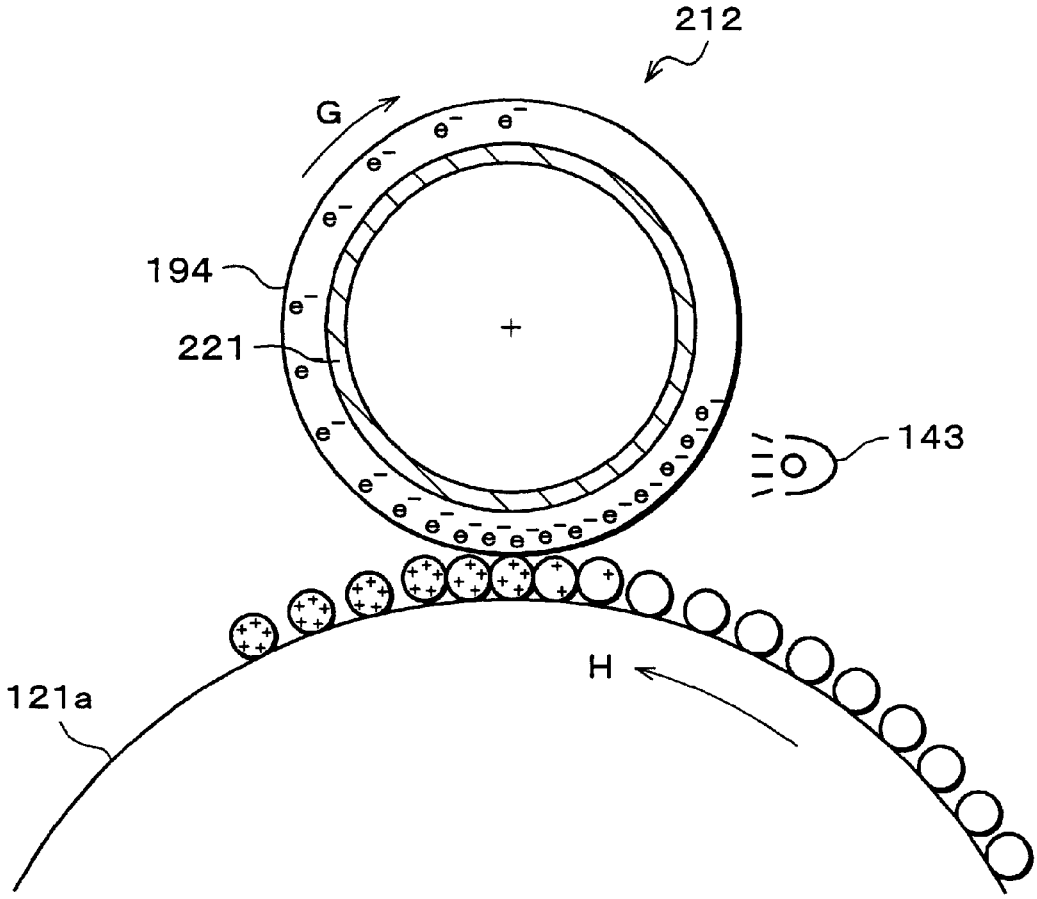
FIG. 26 is an explanatory view showing an alterative mechanism of charge through contact performed in the developing section of FIG. 20.

Further, in the present embodiment, it is specified that the toner-charging roller 212 and the toner-charging belt 181 rotate in direction H ("backward rotation"), i.e., the same direction as the developing roller 121*a*. However, alternatives are possible. One of them is to rotate the toner-charging roller 212 (toner-charging belt 181) in the direction (G) opposite to the developing roller 121*a* as shown in FIG. 26.

Figure 27:
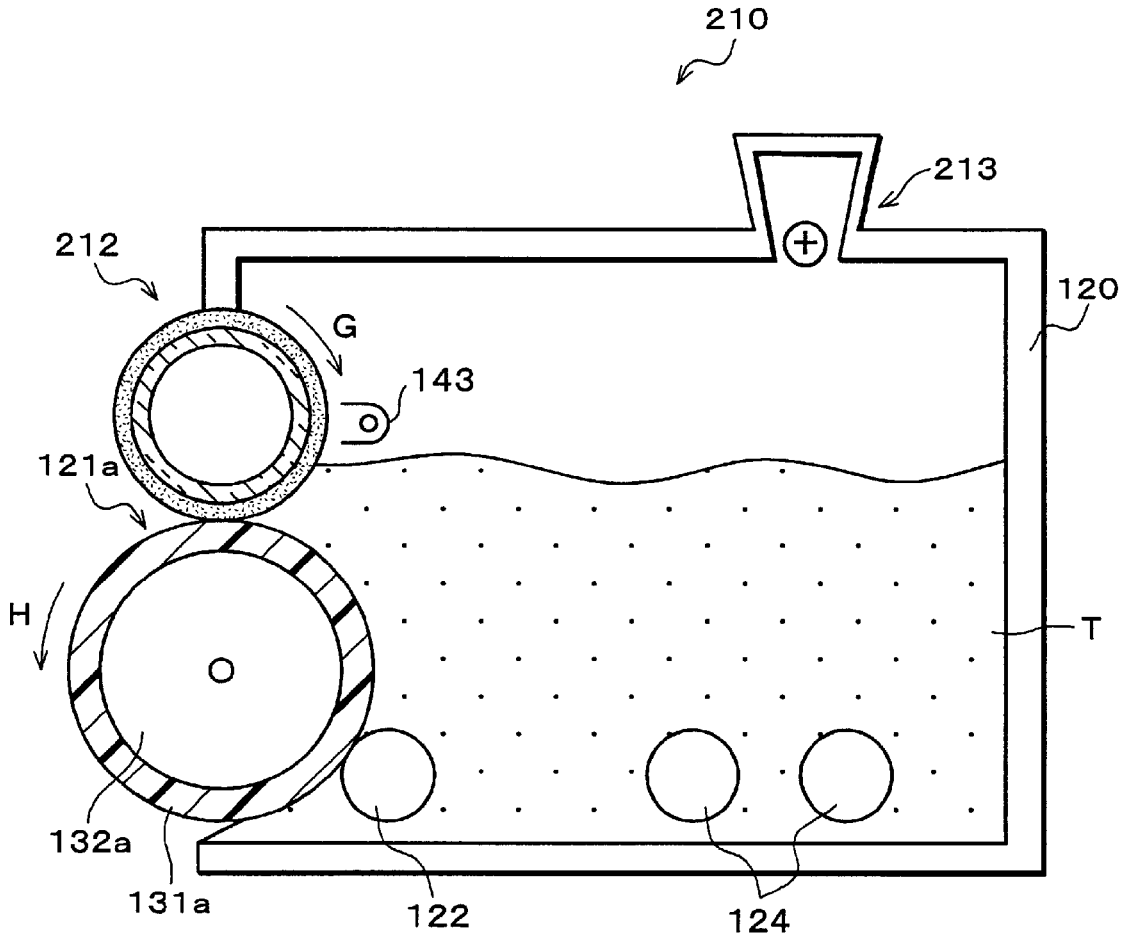
FIG. 27 is an explanatory view showing an alternative configuration of the developing section of FIG. 20 including an ultraviolet irradiator inside a developing chamber.
Figure 28:
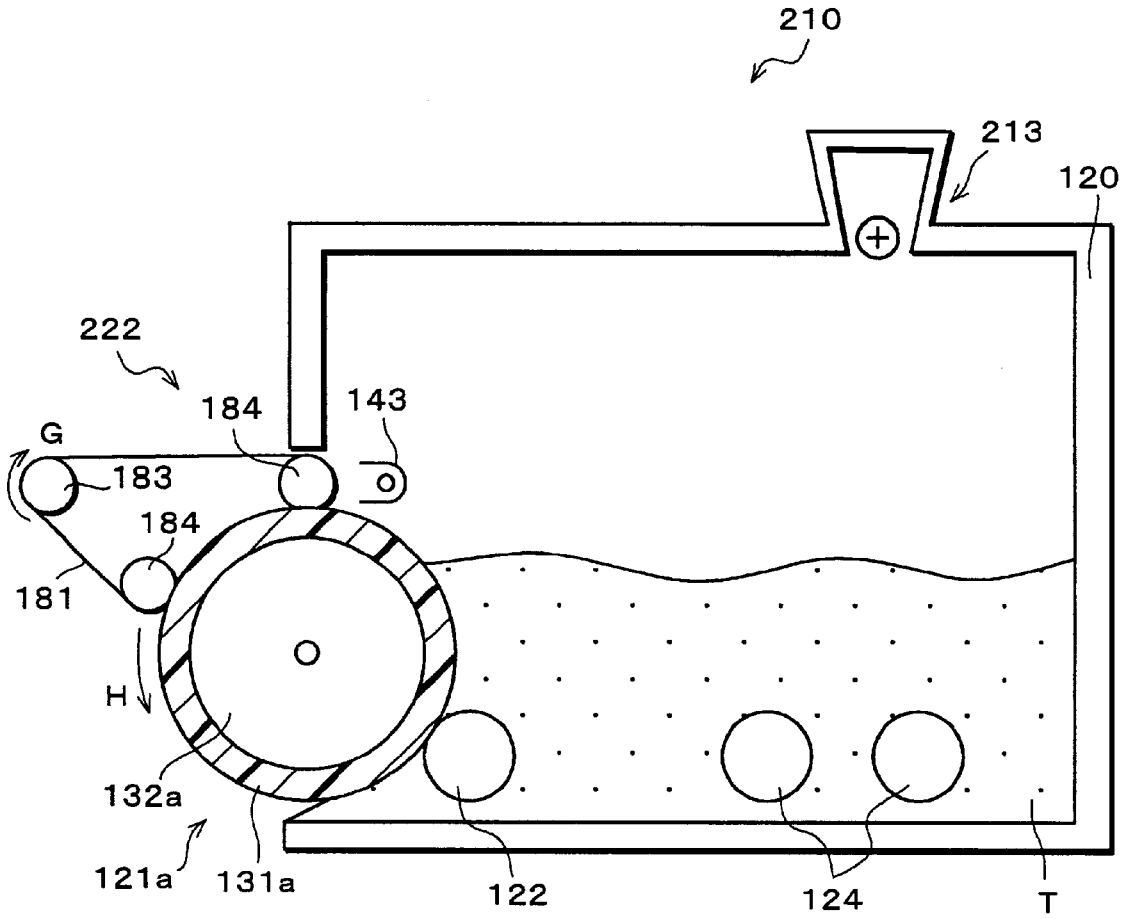
FIG. 28 is an explanatory view showing an alternative configuration of the developing section of FIG. 25 including an ultraviolet irradiator inside a developing chamber.
Figure 29:
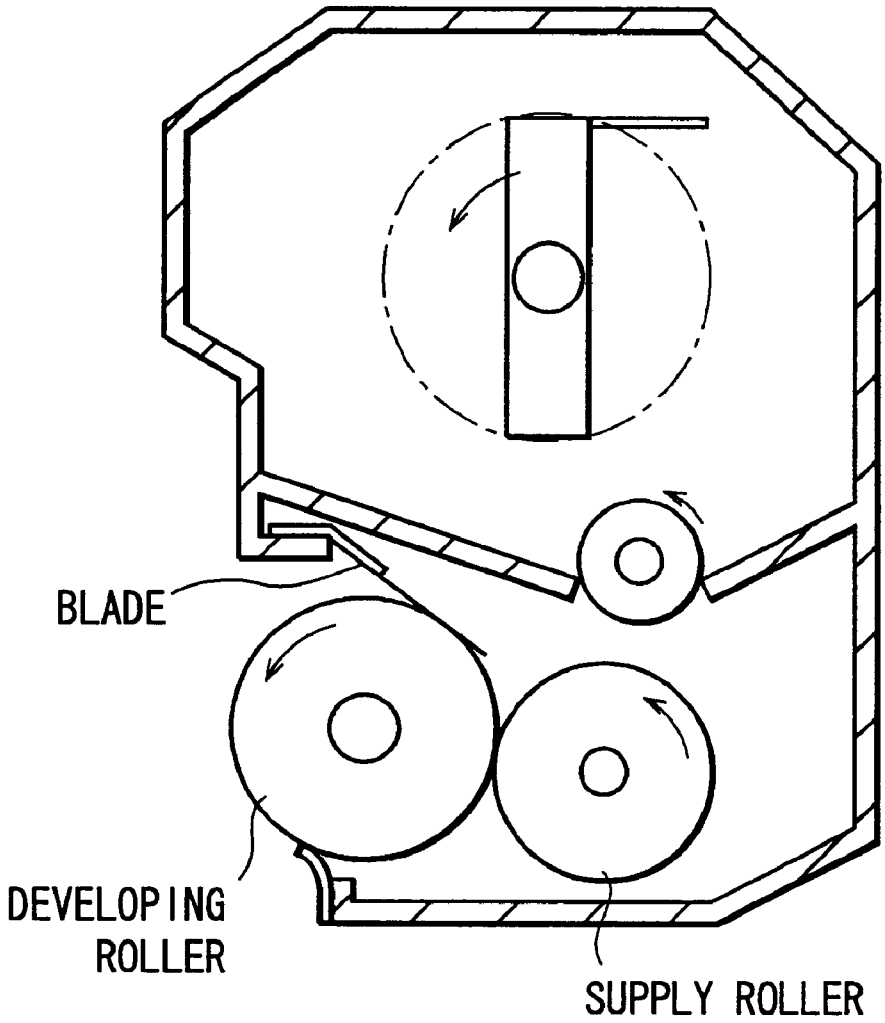
FIG. 29 is an explanatory view showing a configuration of a conventional developing device using single-component non-magnetic toner.
Figure 30:
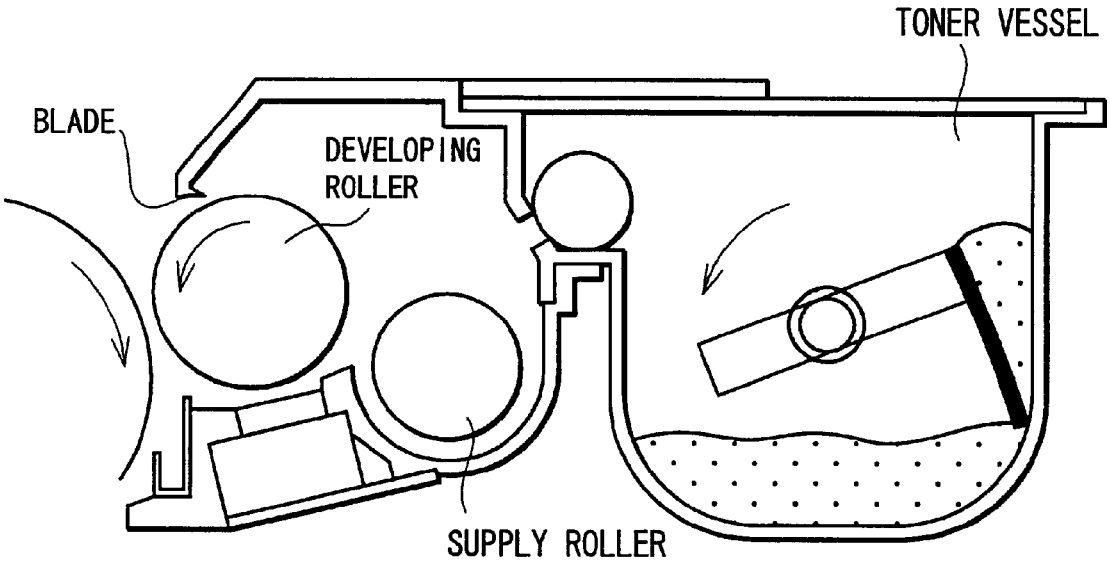
FIG. 30 is an explanatory view showing a configuration of a conventional developing device using double-component non-magnetic toner.

When this is the case, it is preferable if the ultraviolet irradiator 143 is located inside the developing chamber 120 as shown in FIGS. 27 and 28.

In the arrangement, the developing roller 121*a* and the toner-charging roller 212 (toner-charging belt 181) move in the same direction in the nip part.

Thus, the surface of the developing roller 121*a* is prevented from rubbing that of the toner-charging roller 212 (toner-charging belt 181). Therefore, the toner can be prevented from deterioration due to friction with the toner-charging roller 212 (toner-charging belt 181).

Further, in the arrangement, the air in the developing chamber 120 flows towards the nip part. Therefore, non-charged toner floating in the developing chamber 120 is carried by the air flow to the light irradiation range in the neighborhood of the nip part and adheres to the toner-charging roller 212 (toner-charging belt 181) where it is charged (precharged). Therefore, the charging properties of the toner can be improved.

Further, it is preferable if the developing bias voltage applied to the developing roller 121*a* to develop the electrostatic latent image on the photosensitive drum 112 has such a value that the toner, having passed through the nip part, does not adhere to the toner-charging roller 212 (does adhere to the developing roller 121*a*).

The setting eliminates the need to provide the cleaning blade 211 shown in FIG. 20, allowing for reductions in manufacturing costs and size of the developing section 210.

Further, it is preferable if the developing section 210 is specified so that the toner-charging roller 212 rotates at an equal or more speed than the developing roller 121*a*. The specification allows for increases in the amount of the charging layer 194 (the amount of radicals) that contacts the toner in the nip part and thereby improves the charging efficiency of the toner.

Further, in the developing section 210, the toner-charging roller 212 may be specified to rotate not faster than the developing roller 121*a*. The specification allows for increases in the amount of the toner that contact the radicals in the charging layer 194 in the nip part and thereby enables efficient use of the radicals.

In embodiment 4 to 8, the ultraviolet irradiator 143 is specified to shine ultraviolet light with a wavelength of 350 nm onto the sleeve 141 and the charging layer 194. However, the wavelength of the ultraviolet light shone by the ultraviolet irradiator 143 is not limited to 350 nm; it only needs to be 400 nm or less. Further, it is preferable if the wavelength of the ultraviolet light shone by the ultraviolet irradiator 143 is set to such a value that efficiently radicalizes the charging material in the sleeve 141 and the charging layer 194.

Further, wavelengths may be selected to well permeate the base rollers 142, 192 (transparent acrylic) constituting the base for the toner-charging rollers 123, 191, with the charging materials in the sleeve 141 and the charging layer 194 selected to efficiently radicalize the charging materials with the selected wavelengths.

Note that very high percentage of ultraviolet light with a wavelength of 350 nm permeates the base rollers 142, 192.

Further, in embodiments 4 to 8, non-conducting toner is used as the developing material charged by the toner-charging rollers 123, 191. However, alternatives are possible: for example, the toner-charging rollers 123, 191 can charge conducting toner, conducting ink, and ink mist as well.

Further, in embodiments 4 to 8, the electrostatic latent image on the photosensitive drum 112 is developed with toner charged by the toner-charging rollers 123, 191, etc. However, alternatives are possible: for example, toner can be charged by the toner-charging rollers 123, 191, etc. in a DTP (Direct Toning Process) printing device without using the photosensitive drum 112.

Such a printing device is configured, as an example, including a developing roller, a gate array, and opposite electrodes, wherein the toner on the developing roller is made to travel from the gates in an open state to the paper. The configuration is specified to print a desired image through suitable selection of open gates in accordance with the image data.

Further, embodiments 4 to 8 describes charging of the toner layer on the developing roller 121, 121*a* through contact as examples. However, the charging method is applicable to other charging step in the printing device. More specifically, the method is applicable to charge the photosensitive drum 112 using the charging roller 113, to discharge the photosensitive drum 112 using the transfer roller 114 during transfer, and to remove charge from the photosensitive drum 112 after image transfer.

Further, in embodiments 1 to 8, toner is charged using a charging roller containing a photochromic compound (p compound). It is also possible to use toner containing a p compound. According to this method, the chemical structure of the P compound is changed by shining light onto the toner in a developing chamber, to put it into a free radical state. The toner is then (positively) charged by the P compound in a free radical state ridding the toner of its electrons.

However, in this method, the toner needs to contain p compound, which prevents use of normal toner and invites higher operation costs. Further, in this method, to quickly and sufficiently charge toner, p compound needs to be used in an increased amount. However, use of increased amount of p compound, which is a crystalline material, reduces the thickness (contrast ratio) of the developed toner image and makes the toner brittle and likely to crush.

Throughout embodiments 1–8, recording paper was taken as an example of printing medium used in the printer. Alternatively, overhead projector transparencies and sheets of metal, plastic, and any other materials may be used as the recording medium with the printer in accordance with the present invention, as long as the developing material can be transferred onto them.

Further, the developing device in accordance with the present invention may be described as a developing device for use in an electrophotographic device, to develop an electrostatic latent image on a latent image carrier with charged toner, the developing device being specified to include:

a developing roller for causing toner to adhere to a latent image carrier;

a supply roller for supplying the toner to the developing roller; and a charging section for charging the toner on the developing roller, wherein:

the charging section includes: a charging roller provided to contact the developing roller and composed of charging material for charging the toner in contact under light irradiation; and a light irradiation section, provided inside the charging roller, for shining light onto a part of the charging roller where the charging roller contacts the developing roller; and the charging roller rotates in a predetermined direction with respect to the developing roller while the charging roller is charging the toner.

In this configuration, no friction is used to charge the toner, which prevents deterioration of the toner. Further, by rotating the charging roller, the part of the charging roller where the charging roller contacts the developing roller can be gradually renewed. In other words, the part of the charging roller that is involved in charging can be renewed. Therefore, the charging material on the charging roller can be prevented from deteriorating locally. Since the toner layer on the developing roller is efficiently charged, the toner can be prevented from scattering (falling off the developing roller) in the device after the charging process due to insufficient charge.

Alternatively, the developing device in accordance with the present invention may be described as a developing device for use in an electrophotographic device, to develop an electrostatic latent image on a latent image carrier with charged toner, the developing device being specified to include:

a developing roller for causing toner to adhere to a latent image carrier;

a supply roller for supplying the toner to the developing roller; and a charging section for charging the toner on the developing roller, wherein:

the charging section includes: a charging roller provided to contact the developing roller and composed of charging material for charging the toner in contact under light irradiation; and a light irradiation section, provided inside the charging roller, for shining light onto a part of the charging roller where the charging roller contacts the developing roller; and the charging roller halts relative to the developing roller while the charging roller is charging the toner (during a charging process).

In this configuration, no friction is used to charge the toner, which prevents deterioration of the toner. Further, there is no need to rotate the charging roller in synchronism with the developing roller, thereby making the charging process simple.

Alternatively, the developing device in accordance with the present invention may be described as a developing device for use in an electrophotographic device, to develop an electrostatic latent image on a latent image carrier with charged toner, the developing device being specified to include:

a developing roller for causing toner to adhere to a latent image carrier;

a supply roller for supplying the toner to the developing roller; and a charging section for charging the toner on the developing roller, wherein:

the charging section includes: a charging roller provided to rotate in a predetermined direction while in contact with the developing roller and composed of charging material for charging the toner in contact when the charging material changes into an excited state under light irradiation; and a light irradiation section, provided inside the charging roller, for shining light onto a part (nip part) of the charging roller where the charging roller contacts the developing roller; and the charging material returns to ground state when it reenters a light irradiation range formed by the light irradiation section after exiting from the range.

In this configuration, no friction is used to charge the toner, which prevents deterioration of the toner. Further, by rotating the charging roller, the part of the charging roller where the charging roller contacts the developing roller can be gradually renewed. In other words, the part of the charging roller that is involved in charging can be renewed. Therefore, the charging material on the charging roller can be prevented from deteriorating locally. Since the toner layer on the developing roller is efficiently charged, the toner can be prevented from scattering (falling off the developing roller) in the device after the charging process due to insufficient charge.

Further, the light irradiation range is defined as a range in a part where the charging roller contacts the developing roller under irradiation by the light irradiation section. The charging roller is specified to charge toner by means of the charging material in this range. Further, the charging material is specified to so that it is gradually renewed as the charging roller rotates.

In this configuration, it is specified that the charging material that is in an excited state in the light irradiation range will have returned to ground state by the time it reenters the range at the end of a single rotation after exiting from the light irradiation range with the rotation of the charging roller. Such a configuration can maintain the amount of the charging material in an excited state in the light irradiation range at a fixed level and thereby maintain the charge of the toner at a predetermined value potential.

Alternatively, the developing device in accordance with the present invention may be described as a developing device for use in an electrophotographic device, to develop an electrostatic latent image on a latent image carrier with charged toner, the developing device being specified to include:

a developing roller for causing toner to adhere to a latent image carrier;

a supply roller for supplying the toner to the developing roller; and a charging section for charging the toner on the developing roller, wherein:

the charging section includes: a charging roller provided to rotate in a predetermined direction while in contact with the developing roller and composed of charging material for charging the toner in contact when the charging material changes into an excited state under light irradiation; and a light irradiation section, provided inside the charging roller, for shining light onto a part (nip part) of the charging roller where the charging roller contacts the developing roller; and the charging material contains B-CIM and MBT, defined by chemical formulae (1) and (2), as a photopolymerization initiator and a chain-transfer agent.

In this configuration, no friction is used to charge the toner, which prevents deterioration of the toner. Further, by rotating the charging roller, the part of the charging roller where the charging roller contacts the developing roller can be gradually renewed. In other words, the part of the charging roller that is involved in charging can be renewed. Therefore, the charging material on the charging roller can be prevented from deteriorating locally. Since the toner layer on the developing roller is efficiently charged, the toner can be prevented from scattering (falling off the developing roller) in the device after the charging process due to insufficient charge.

Further, in this configuration, the charging material contains B-CIM and MBT; therefore, the toner on the developing roller can be charged in a satisfactory manner.

Alternatively, the developing device in accordance with the present invention may be described as a developing device for use in an electrophotographic device, to develop an electrostatic latent image on a latent image carrier with charged developing material, the developing device being specified to include:

a transport section for causing developing material to adhere to a latent image carrier;

a supply roller for supplying the developing material to the transport section; and a charging section for charging the developing material on the transport section, wherein:

the charging section includes: a charging belt provided to contact the transport section and composed of charging material for charging the developing material in contact under light irradiation; and a light irradiation section, provided inside the charging belt, for shining light onto a part of the charging belt where the charging belt contacts the transport section.

In this configuration, no friction is used to charge the developing material, which prevents deterioration of the developing material. Further, a charging belt is used in place of a charging section, allowing more versatility in designing the shape of the charging section. Thus, the developing device can be reduced in size.

Further, the charging method through contact in accordance with the present invention may be described as a method of charging developing material (toner) on a developing roller through contact to cause the toner to adhere to an electrostatic latent image produced on a latent image carrier in an electrophotographic device, the method including the step of:

charging toner by shining light from the inside of a charging roller onto a part where a charging roller composed of charging material that changes into an excited state under light irradiation to charge toner in contact contacts a developing roller having toner, wherein the charging step includes the step of rotating the charging roller relative to the developing roller in a predetermined direction.

Alternatively, the charging method through contact in accordance with the present invention may be described as a method of charging developing material (toner) on a developing roller through contact to cause the toner to adhere to an electrostatic latent image produced on a latent image carrier in an electrophotographic device, the method including the step of:

charging toner by shining light from the inside of a charging roller onto a part where a charging roller composed of charging material that changes into an excited state under light irradiation to charge toner in contact contacts a developing roller having toner, wherein the charging step includes the step of halting (fixing) the charging roller relative to the developing roller.

Alternatively, the charging method through contact in accordance with the present invention may be described as a method of charging developing material (toner) on a developing roller through contact to cause the toner to adhere to an electrostatic latent image produced on a latent image carrier in an electrophotographic device, the method including the step of:

charging toner by shining light from the inside of a charging roller onto a part where a charging roller rotating in a predetermined direction and composed of charging material that changes into an excited state under light irradiation to charge toner in contact contacts a developing roller having toner, wherein the charging step is specified so that the charging material returns to ground state when the charging material reenters a light irradiation range after exiting from the range.

Alternatively, the charging method through contact in accordance with the present invention may be described as a method of charging developing material (toner) on a developing roller through contact to cause the toner to adhere to an electrostatic latent image produced on a latent image carrier in an electrophotographic device, the method including the step of:

charging toner by shining light from the inside of a charging roller onto a part where a charging roller rotating in a predetermined direction and composed of charging material that changes into an excited state under light irradiation to charge toner in contact contacts a developing roller having toner, wherein the charging material contains B-CIM and MBT, defined by chemical formulae (1) and (2), as a photopolymerization initiator and a chain-transfer agent.

Alternatively, the charging method through contact in accordance with the present invention may be described as a method of charging developing material (toner) on a developing roller through contact to cause the toner to adhere to an electrostatic latent image produced on a latent image carrier in an electrophotographic device, the method including the step of:

charging toner by shining light from the inside of a charging belt onto a part where a charging belt composed of charging material that changes into an excited state under light irradiation to charge toner in contact contacts a developing roller having toner.

As described in the foregoing, in the present invention, as a developing device for visualizing an electrostatic latent image carried and transported on the latent image carrier and a charging method through contact for application thereto, a charged member for developing an electrostatic latent image to produce a visual image is caused to contact charging means and then charged by light shone by irradiation means onto the charging means.

When this is the case, the charged member is charged by means of light shone by the irradiation means onto the charging means; therefore, there is no need to charge the charged member by means of rubbing of the developing roller with the layer-thickness-restricting blade. Therefore, the stress on the charged member due to mechanical rubbing can be suppressed, and deterioration of the charged member can be prevented. In addition, the charged member can be prevented from fusing with the charging means (including the developing roller and the layer-thickness-restricting blade) due to rubbing heat. Thus, the developing device will have improved reliability.

The charged member may be charged in the following manner, with a strong emphasis on activeness in the charging.

Arrange the charging means so that it contains a photochromism compound, a photopolymerized compound, a photooxidative substance, or another material that changes its molecular structure under light irradiation by the irradiation means in such a manner to charge the charged member; the charged member will be actively charged due to structural changes of the molecules in the charging means, allowing for further improvement in reliability of the developing device.

The charged member may be charged in the following manner, with a strong emphasis on uniformity in the charging.

Arrange the charged member so that it contacts the charging means and at least thereafter moves off the contact surface of the charging means; the amount of contact of the charged member to the contact surface of the charging means (and thus the charge) will be restricted, and the stress on the charged member will be better suppressed, enabling effective prevention of deterioration of the charged member.

The charged member may be charged in the following manner, with a strong emphasis on ensuring an amount of light shone by the irradiation means in the charging.

Arrange the irradiation means so that it shines light on the charging means from a position opposite to the charged member; the amount of light from the irradiation means will be prevented from dropping due to the charged member, and the irradiation means will be prevented from becoming dirty with the charged member.

The charged member may be charged in the following manner, with a strong emphasis on reductions in cost of the irradiation means. Provide wavelength altering means between the charging means and the irradiation means to alter the wavelengths of the light shone by the irradiation means onto the charging means; there will be no need to prepare irradiation means to shine light with the most suitable wavelengths onto the charging means. Existent irradiation means can be used to alter the wavelengths of light, allowing for reductions in cost of the irradiation means.

The charged member may be charged in the following manner, with a strong emphasis on uniformity in the charging.

Arrange the charging means so that its surface where it contacts the charged member is movable; the surface of the charging means where it contacts the charged member is renewable, allowing for improvement in charging properties and reliability of the charged member.

Besides, the charged member uniformly contacts the contact surface of the charging means. Therefore, the stress on the charged member is uniformly suppressed, allowing for more effective prevention of deterioration of the charged member.

Especially when toner is used as the charged member, the toner is less damaged, offering solutions to unique problems of toner.

Further, if the developing roller is positioned opposite to the charging means with toner transported to a gap between the developing roller and the charging means, the thickness of the toner layer is restricted between the developing roller and the charging means, and it is ensured that the toner whose layer thickness is restricted is charged by the charging means, allowing for improvement in charge performance of the toner.

In addition, when the thickness of the toner layer transported to the gap between the developing roller and the charging means is restricted by layer-thickness-restricting means in the charging means or the like, the toner whose layer thickness is restricted can be charged to an optimum level and in a stable manner. Also, the toner can adhere to the electrostatic latent image in an optimum amount and in a stable manner.

When the thickness of the toner layer is restricted by the double role of the charging means, the dual role of the member contributes to reductions in cost.

By contrast, when the thickness of the toner layer is restricted by layer-thickness-restricting means or the like upstream to the charging means with respect to the transport direction of the toner, there is no particular need to rub the toner to charge it with layer-thickness-restricting means or the like. Toner damage can greatly reduced by specifying the layer-thickness-restricting means to apply, through rubbing, such a pressure that only the thickness of the toner layer is restricted.

Further, when cylindrical, light-transparent charging means is used, toner can uniformly contact the whole external circumferential surface of the charging means, allowing further improvement in charging performance of the toner.

Further, the developing device in accordance with the present invention (the present developing device) is a developing device for use in an electrophotographic device, to develop an electrostatic latent image on a latent image carrier with charged developing material, the developing device being characterized in that it is specified to include:

a charging section composed of charging material radicalized under light irradiation; and a light irradiation section for shining light onto the charging section, wherein the developing material is charged by causing the radicalized charging material to contact the developing material.

The present developing device is a developing device for use in a copying machine, printer, facsimile, or other electrophotographic printing device, to develop an electrostatic latent image with toner, ink, or other developing material. Here, the electrostatic latent image refers to an image produced on a photosensitive body or paper (recording paper) according to a potential distribution.

Further, the present developing device is specified to charge developing material used in the development of an electrostatic latent image, so as to develop it in a satisfactory manner.

Especially, the present developing device includes: a charging section composed of charging material radicalized under light irradiation; and a light irradiation section for shining light onto the charging section. The present developing device is specified to charge the developing material by causing the radicalized charging material to contact the developing material.

Here, radicalizing charging material refers to turning the charging material into radicals (reactive active species) by exciting it and thus changing it in structure. In other words, the charging material is activated on molecular levels and changed into radicals which is an isomer.

The radical is a strong oxidizer and removes an electron from material that comes into contact with it. The radicalized charging material is specified to remove electrons from developing material that comes into contact and thus charge the developing material to a desired charge level.

The present developing device is specified in this manner so that the charging material is radicalized under light irradiation and used to charge the developing material.

Hence, in the present developing device, the developing material can be charged without experiencing frictional forces; therefore, the developing material is prevented from deteriorating due to frictional heat, and so is the device from becoming dirty with the developing material that has softened due to frictional heat.

Especially, when toner is used as the developing material for the present developing device, image quality can be prevented from deteriorating due to melting of the developing material, and so can the device from developing malfunction.

Further, preferably, the present developing device includes a transport section for holding and transporting the developing material to the latent image carrier. Also preferably, the charging section is specified so that the radicalized charging material is brought into contact with the developing material held in the transport section.

In this configuration, only the developing material held in the transport section, that is, nothing more than the developing material used in an immediately subsequent development session is charged. Charging of the developing material stored in the present developing device (not to be used in an immediately subsequent development session) can be prevented, allowing for improvement of charging efficiency. Further, the stored developing material can be maintained at a fixed potential.

Further, preferably, in the present developing device, the transport section has a shape similar to that of a roller that transports the developing material on its surface. Thus, the transport section can be formed easily.

Further, preferably, the charging section is constituted by a roller-like-shaped member including a base roller and a charging layer of charging material formed thereon, and the transport section and the charging section are disposed so as to contact each other.

Further, in this configuration, preferably, the base roller is made of a rigid body to enable the charging section and the transport section to contact each other in stable manner.

Further, in this configuration, the charging section may be a belt-like-shaped member including a base film and a charging layer of charging material formed thereon. The configuration allows for more versatility in designing the charging section and reductions in size of the present developing device.

Further, when the charging section is shaped like a roller or a belt, the light irradiation section may be positioned either inside or outside the charging section. If the light irradiation section is positioned inside the charging section, the overall size of the developing device can be reduced.

If the light irradiation section is positioned outside the charging section, the light irradiation section can shine light directly onto the charging section. Such positioning prevents absorption and scattering by the base and thereby results in highly efficient use of the light, allowing for reductions in power consumption of the light irradiation section.

Further, the base does not need to be made of transparent material to light and, instead, can be made of strong, inexpensive material, such as metal. The positioning therefore improves durability and reduces manufacturing cost of the charging section.

Besides, since temperature does not rise in the charging section, no cooling device, such as a fan motor, is required. The positioning thereby prevents the number of parts and manufacturing cost from rising and allows for reductions in size of the present developing device.

Further, preferably, in this configuration, the charging section is specified so as to rotate in a predetermined direction relative to the transport section, while charging the developing material. If the charging section is stationary, it always contacts the transport section in the same position and charges the developing material with the same portion of the charging material repeatedly. Therefore, it is preferable to supply new charging material to be charged, by rotating the charging section.

Further, in the configuration where the light irradiation section is positioned outside the charging section, preferably, it is specified so that light is shone on the charging section upstream to the position where the charging section contacts the transport section (upstream to the charging section with respect to the direction of rotation).

Further, the radicalized charging material under light irradiation returns to ground state after some time. Therefore, preferably, the light irradiation section is specified to shine light onto the charging section near the position where the transport section contacts the charging section. The configuration enables highly dense radicals can be introduced to the place where the light irradiation section contacts the charging section.

Further, preferably, the base film and base roller are composed of a material that neither is permeable to nor reflects the light from the light irradiation section (for example, metals whose surface has undergone a delustering process). The configuration can prevent ultraviolet light from permeating or reflecting on the base and radicalize the charging section other than the light irradiation range and also allow for extension of the lifetime of the charging material.

Further, the charging section may be specified to rotate either in the same direction as the transport section ("backward rotation") or in the opposite direction to the transport section ("forward rotation").

If the charging section rotates in the opposite direction to the transport section, the transport section and the electron producing section moves in the same direction when viewed locally in the contact part. Therefore, friction can be suppressed between the developing material on the transport section and the charging section.

Meanwhile, if the charging section and the transport section rotate in the same direction, the transport section and the electron producing section move in an opposite direction when viewed locally in the contact part. In other words, they rotate in such a way that the charging section returns the developing material on the transport section back to the inside of the developing device. Therefore, an unnecessary portion of the developing material, remaining on the transport section, can be transported back to the inside of the device for reuse and allows for better suppression of scattering of the developing material inside the device.

Further, the developing material on the transport section can be charged on a continuously renewed part of the charging section, which enables the developing material to be sufficiently charged even when a part of the charging section malfunctions. This allows for better suppression of scattering of the developing material inside the device.

Further, the charging section may be specified to rotate either at speed not less than that of the rotation of the transport section or at speed not more than that of the rotation of the transport section.

If the charging section is specified to rotate at speed not more than that of the rotation of the transport section, an increased amount of developing material contacts the radicals of the charging section in the contact part, resulting in efficient use of radicals.

By contrast, if the charging section is specified to rotate at speed not less than that of the rotation of the transport section, the developing material contacts an increased amount of radicals in the contact part, resulting in efficient charging of the toner.

Further, if the light irradiation section is positioned inside the charging section (either shaped like a roller or a belt), the light irradiation section is preferably specified to shine light onto the contact part of the transport section and the charging section. In this configuration, the light irradiation range (the range irradiated with light from the light irradiation section) falls in the contact part of the charging section and the transport section. In the charging section, the charging material in this range charges the developing material.

Further, when this is the case, the charging section is preferably specified to rotate in a predetermined direction relative to the transport section, while charging the developing material.

The rotation of the charging section enables the part of the charging section where it contacts the transport section to renewed gradually. In other words, the part of the charging section used in the charging can be renewed; therefore, in the charging section, the charging material can be prevented from locally deteriorating.

Therefore, the developing material on the transport section can be charged efficiently, and the developing material can be prevented from scattering (falling off the transport section) in the device after the charging due to insufficient charging.

Further, in this configuration, preferably, the contact part of the charging section and the transport section is wider than the light irradiation range formed by the light irradiation section.

In this configuration, the thickness of the developing material layer can be restricted in the contact part before the developing material reaches the light irradiation range. Therefore, the charging is performed on the developing material layer with a restricted thickness. The restriction of the thickness prevents charging of the developing material in excessive amounts and thus enables the developing material to be charged efficiently.

Further, in this configuration, as to the two regions outside the light irradiation range in the contact part of the light irradiation section and the charging section, i.e., the regions in the contact part located external to the two ends of the light irradiation section, the region located upstream to the transport section with respect to the direction of rotation is preferably wider than the other region located downstream.

If the downstream region is made wider, the thickness of the developing material can not sufficiently restricted in the upstream region before the charging.

Further, after the charging, since the developing material is all charged in one polarity, if the developing material is pressed in the downstream region, the developing material may be possibly scattered due to its particles electrically repelling one another.

By providing a wider upstream region, the thickness of the developing material can be sufficiently restricted, and the developing material can be prevented from scattering.

Further, again, in this configuration, the charging section may be specified to rotate either in the same direction as the transport section ("backward rotation") or in the opposite direction to the transport section ("forward rotation").

In the case of "backward rotation," it is also preferable to specify the charging section to rotate at an equal to triple the speed of the transport section. Specifying the charging section to rotate in this range allows for charging efficiency to be in good conditions.

Further, in this configuration, if the transport section is provided with a supply roller for supplying the developing material, the charging section is preferably located between right above the transport section and the supply roller.

In other words, the developing material on the transport section, when charged, has its layer thickness being restricted by the contact with the charging section and partly falls off the transport section. If the charging section is located downstream as compared to right above the transport section (downstream to the transport section with respect to the direction of rotation), a part of the developing material falls on the side where the latent image carrier exists and causes the electrophotographic device to become dirty.

Accordingly, the fallen developing material is preferably specified to return to the inside of the developing device by locating the charging section in the foregoing range.

Further, in this configuration, preferably, the charging section and the supply roller are spaced from each other by such a distance, to prevent the developing material fallen off the contact part of the charging section and the light irradiation section from directly adhering to the supply roller.

If the charging section is located at a very short distance from the supply roller, the developing material fallen due to the restriction of the layer thickness directly adheres to the supply roller and continuously charged, causing non-uniform charging. The foregoing positioning allows the fallen developing material to return to the developing material container where it is mixed with yet-to-be charged developing material and loses some of its charge. Thus, the developing material can be uniformly charged.

Further, in a configuration where the light irradiation section is positioned inside the charging section (shaped like either a roller or a belt) to shine light onto the contact part of the transport section and the charging section, the charging section may be specified to halt relative to the transport section, while charging the developing material.

In this configuration, there is no need to rotate the charging section in synchronism with the transport section. Therefore, the charging process is simplified.

Further, if the charging section is stationary while charging, the same portion of the charging material always charges the developing material, causing local deterioration of the charging material used in the charging. Accordingly, in this configuration, preferably, the charging section is specified to rotate by a predetermined angle to replace the charging material used in the charging, after the developing device has preformed a predetermined number of charging sessions, after the transport section has rotated a predetermined turns, or after the electrophotographic device has printed a predetermined number of pages.

The configuration can prevent local deterioration of the charging material. The predetermined number of sessions, turns, or pages, which serves as a yardstick for the rotation of the charging roller, is specified according to the quality and amount of the light shone, the amount (mix ratio) and kind of the charging material, etc.

Further, when the charging is stopped, the charging section may be rotated either in the same direction as the transport section or in the opposite direction to the transport section. As described in the foregoing, if it is rotated in the opposite direction to the transport section, a residual, unnecessary portion of the developing material on the transport section can be returned to the inside of the device, and scattering of the developing material can be prevented.

Further, in this configuration, if the charging section is rotated by such an angle that the charging material can be replaced in the light irradiation range of the light irradiation section, since the charging material is replaced, local deterioration of the charging material can be prevented in a satisfactory manner.

Further, it is also preferable to set the angle by which the charging section rotates to such a value that the part of the charging section where it contacts the transport section is replaced. In other words, when the charging section is stopped during a charging session, the part of the charging section where it contacts the transport section wears because of friction between the transport section and the developing material. Therefore, by replacing the worn part, the developing material can be charged in a satisfactory manner. Further, the thickness of the developing material can be restricted by the charging section in a satisfactory manner.

Further, irrespective of whether the light irradiation section (shaped like a roller or a belt) is positioned inside or outside the charging section, if the charging section is specified to rotate in a predetermined direction with respect to the transport section while the developing material is being charged, the charging material on the charging section is preferably specified to have returned to ground state by the time the charging material reenters the light irradiation range formed by the light irradiation section after exiting from the range.

In this configuration, the amount of charging material that is in a radical state (excited state) in the light irradiation range can be maintained at a fixed level, which always maintains the charge of the developing material at a predetermined potential.

Further, the charging material can be prepared from a photopolymerization initiator and a chain-transfer agent. In this case, the probability of changing into an excited state is determined by the mix ratio of these components.

Therefore, in this configuration, it is preferable to specify the rotation speed of the charging section, the amount of light shone by the light irradiation section, or the amount of developing material on the transport section transported to the contact part (the amount of developing material used in charging) according to the mix ratio of the photopolymerization initiator and the chain-transfer agent so that the charging material reentering the light irradiation range is in ground state. This readily enables the charging material to be in ground state upon reentering the light irradiation range.

Further, if the charging section is of a belt or similar shape, the light irradiation section is preferably an absolute-contact-type light irradiator positioned inside the charging section to shine light onto a part of the charging belt (or the charging section of a belt-like shape) where it contacts the transport section.

Further, the absolute-contact-type light irradiator may be an organic EL (organic electroluminescence) with 250 nm to 350 nm wavelengths. The organic EL does not damage the charging belt due to its heat even when it is provided in absolute contact with the charging belt. This allows for further reductions in size of the present developing device.

Further, the organic EL is preferably specified to be provided in absolute contact with the interior of the charging section and thereby shine light on the whole contact part of the transport section and the charging belt. The extension of the width of the light irradiation range to the same levels as that of the contact part allows for further reductions of the intensity of the light emitted by the light irradiation section.

In other words, the duration of irradiation is equal to the width of the contact part in millimeters divided by the rotation speed of the transport section in millimeters per second. To reduce the intensity of light ($w/cm^2$), the width of the contact part (the width of the light irradiation range) is increased, since a greater width of the contact part increases the duration of irradiation of the developing material.

Further, the positioning of the organic EL inside the charging belt allows for further reductions in size of the developing device and can prevent the developing material fallen off the transport section from causing the organic EL to become dirty.

Further, the charging belt is endless (cyclic) and preferably specified to rotate in a predetermined direction while in contact with the transport section.

By rotating the charging belt, the contact part of the charging belt and the transport section can be gradually renewed.

In other words, since the part of the belt used in the charging of the charging belt can be renewed, the charging material on the charging belt can be prevented from deteriorating locally. Therefore, the developing material on the transport section can be efficiently charged, and the developing material can be prevented from scattering (falling off the transport section) in the device after the charging due to insufficient charging.

Further, when the charging belt is rotated, preferably, the organic EL which is provided in absolute contact with the interior of the charging belt is used as one of rotation axes. Thus, the organic EL is equipped with another function as a rotation axis, allowing for simplification of the device.

Further, the charging belt is specified to rotate with the friction with the transport section.

In the configuration, the charging belt is driven for rotation by the transport section that is in turn driven by a drive device (for example, a motor). No mechanism is needed to drive the charging belt, which allows for further simplification of the configuration of the developing device.

Further, in the present developing device, preferably, the charging material on the charging section contains B-CIM and MBT expressed by chemical formulae (1) and (2) below, as a photopolymerization initiator and a chain-transfer agent.

B-CIM:$C_{42}H_{28}Cl_2N_4$
2,2′-BIS(2-CHLOROPHENYL)-4,4′,
5,5′-TETRAPHENYL-1,2′-BIIMIDAZOLE (1)

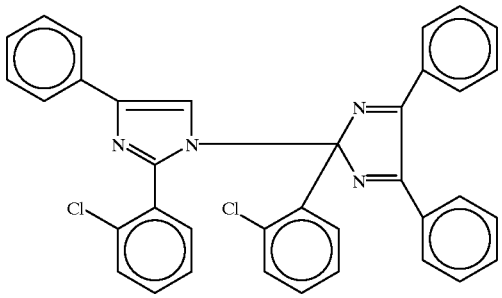

MBT:$C_7H_5NS_2$
2-Mercaptobenzochlazole (2)

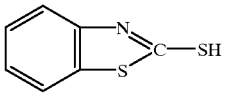

In this configuration, since a material containing B-CIM and MBT is used as the charging material, the developing material on the transport section can be charged in a satisfactory manner.

Further, the mix ratio of B-CIM and MBT in the charging material is preferably specified to such a value that the developing material on the transport section can be sufficiently charged. Here, the sufficiently charged developing material refers to developing material with such charge that ensures development of the electrostatic latent image (5 $\mu$C/g to 25 $\mu$C/g).

Further, to achieve such charge, the mix ratio of B-CIM and MBT is preferably specified in a range of 1:0.25 to 1:2.25 in moles.

Further, in this configuration, the present developing device is preferably provided with a control section for controlling the amount of light shone by the light irradiation section or the number of turns of rotation of the charging section, to adjust the charge of the developing material on the transport section.

In other words, when the developing material is charged only insufficiently by the charging material with a predetermined (suitable) mix ratio, the control section increases the charge of the developing material either by increasing the amount of light emitted by the light irradiation section or by decreasing the rotation speed of the charging section. Moreover, if the developing material on the transport section is charged excessively, the control section decreases the charge of the developing material by decreasing the amount of light emitted by the light irradiation section or by increasing the rotation speed of the charging section.

Further, the present developing device is preferably provided with a remover section for removing developing material adhering to the charging section. The remover section is provided for the purpose of scraping an excessive amount of developing material attracted onto the charging section and transports it back to the inside of the present developing device. The remover section is preferably made of a material having a lower hardness than (or an equal hardness to) the charging section so that it does not damage the surface of the charging section.

Further, in a configuration where a part of the charging section is located outside the present developing device, since the developing material can be prevented to some degree from scattering in the electrophotographic device, it is particularly preferable to provided the foregoing remover section.

Further, the printing device in accordance with the present invention includes a latent image carrier, a latent image forming section for forming an electrostatic latent image on the latent image carrier according to image data, and the present developing device. Since the printing device includes the present developing device, the developing material is prevented from deteriorating due to friction, and the device is prevented from becoming dirty with the softened developing material.

Further, the charging method through contact in accordance with the present invention (the present charging method) is a method of charging, through contact, developing material with which an electrostatic latent image produced on a latent image carrier in an electrophotographic device is developed, the method including the step of charging the developing material by shining light onto charging material that is radicalized under light irradiation and causing the radicalized charging material to contact the developing material.

The present charging method is a method of charging for use in the present developing device. In other words, in the present charging method, it is specified that the charging section is irradiated with light to produce radicals and charges the developing material with these radicals. Thus, with the present charging method, the developing material can be charged without experiencing frictional forces. Therefore, the developing material is prevented from deteriorating due to frictional heat and the device is prevented from becoming dirty with the developing material softened due to frictional heat.

Further, the present invention also relates to a developing device in image forming devices of an electrophotographic system, such as copying machines, printers, and facsimiles, and to a contact charging method employed by such a developing device, and more specifically, the present invention is intended to improve reliability of development.

Further, in general, image forming devices of an electrophotographic system, such as copying machines, printers, and facsimiles are adapted to successively supply (supplying action) a toner on the surface of the developing roller of the developing device in a direction of rotation of the developing roller carrying a toner on its surface, so as to develop an image on the surface (electrostatic latent image) of the photosensitive body carrying and transporting the electrostatic latent image. The toner on the developing roller is then subjected to the layer-thickness-restricting blade which is provided more upstream than the portion opposite the photosensitive body with respect to the direction of rotation of the developing roller, so as to restrict the thickness of the developer brush (toner) on the developing roller. The toner thus restricted is then transported through the developer path to the portion opposite the photosensitive body so as to be supplied to the electrostatic latent image on the surface of the photosensitive body.

In this case, the toner adheres to the developing roller or the layer-thickness-restricting blade by the charge which was given as a result of rubbing with these members. A double-component developing agent, which is a mixture of a toner and a carrier, is also available. However, charging the charged member such as toner by rubbing with the charging means such as the developing roller or the layer-thickness-restricting blade in the described manner not only results in severe deterioration of the charged member due to stress put on the charged member by the mechanical rubbing, but also causes the charged member to stick to the charging means (developing roller or layer-thickness-restricting blade) by the heat of rubbing. Further, the use of the double-component developing agent also causes stress due to mechanical rubbing not only on the charged member but on the carrier as well, and the carrier is also severely deteriorated as a result.

Further, the present invention takes advantage of photo-induction of charge on the charged member as described in the foregoing section "photo-induced charge at the contact interface between photopolymerized photosensitive layer and insulator", and the object of the present invention can be re-stated as providing a developing device which can prevent deterioration of the charged member and fusing of the charged member with respect to the charging means, and which can improve reliability of development, and providing a contact charging method for such a developing device. Further, the ultraviolet irradiator 143 may be referred to as a UV light irradiator or a UV light projector.

Further, the organic EL 182 as shown in FIG. 14 is preferably in close contact with the charging belt from inside and shine light over the entire contact portion (nip part) between the developing roller and the charging belt. That is, the radiation time is expressed by the following equation. Radiation time=(nip width [mm])/(peripheral speed of developing roller [mm/sec]). It can be seen from this equation that the radiation time becomes longer with wider nip widths, and light density [w/cm$^2$] can be is made smaller in this case.

Further, in the case of a conventional developing device which develops a single-component non-magnetic toner, the toner is successively supplied from the supply roller in a direction of rotation onto the surface of the developing roller, and is then carried and transported by the rotation of the developing roller. The toner is charged by friction (frictional charging) with the layer-thickness-restricting blade which is provided more downstream of the supply roller in the direction of rotation of the developing roller, while its layer thickness is restricted thereby. The toner in this state is carried and transported to a portion opposite the photosensitive body which is provided further downstream in the direction of rotation, and electrostatically supplied to the electrostatic latent image on the surface of the photosensitive body, so as to be developed (visualized) as a toner image. A developing agent employing a magnetic single-component toner, which is a toner containing a magnetic powder, is also available.

However, in the conventional technique where the charged member such as toner is charged by friction with the charging member such as the layer-thickness-restricting blade, the charged member is mechanically rubbed with the charging means upon contact therewith with a large speed difference. That is, friction is generated as the charged member and the charging means come into contact with each other with a large speed difference. Here, a mechanical and/or thermal load, which is proportional to the speed difference between the charged member and the charging means, is applied on the charged member and the charging means. Thus, in the configuration where the charged member and the charging means are mechanically rubbed each other as they come into contact with a large speed difference, due to a large mechanical and/or thermal load, the charged member may be destroyed or deteriorated, or the charging characteristics of the charged member may be deteriorated by the charged member, which became soft by the heat of rubbing, fusing with the charging means or the developing roller.

Further, in the case of the double-component developing agent, the carrier constitutes the charging means, and the charged member is agitated with the carrier for the frictional charging. The mechanism of charging is the same as that of the charging with the single-component developing agent, and there is a large speed difference at the contact surface between the charged member and the carrier when they are agitated. As such, a mechanical and/or thermal load is applied on the charged member or the carrier, resulting in destruction of the charged member and the carrier, or deterioration of charging characteristics of the charged member, which is caused when the charged member, which became soft by the heat of rubbing, fuses with the carrier.

Therefore, a large mechanical and/or thermal load with respect to the charged member and the charging means is entailed in the frictional charging method for controlling the amount of charged toner by mechanically rubbing the charged member and the charging means by bringing them into contact with each other with a large speed difference.

Thus, the present invention takes advantage of the photo-induced charging, and the object of the present invention can be re-stated as providing a developing device and a contact charging method used therefor which can reduce a mechanical and/or thermal load with respect to the charged member and the charging means, so as to prevent deterioration of the charged member and fusing of the charging means, and to improve reliability of development.

Further, the developing section 210 as shown in FIG. 20 can be regarded as a member for improving charging efficiency by suppressing flying (scattering) of the charged member in the device by rotating the charging means in a counter direction with respect to the direction of rotation of the developing roller. Further, one feature of the developing section 210 is to provide the light irradiation means outside of the developing device, so as to simplify the light irradiation means.

Further, the developing section 210 as shown in FIG. 27 may include the light irradiation means within the developing device, and the irradiation means may be rotated in the opposite direction to the direction of rotation of the developing roller, so as to stabilize charging of the developing agent, to make replacement of the irradiation means easier, and to reduce the quantity of light of the light source of the irradiation means.

Further, it can be said that the developing section 111*a* as shown in FIG. 16 uses a single-component non-magnetic toner T as the charged member, and includes: the developing chamber 120 of a container-shape for storing the toner T; the developing roller 121*a* which is rotatably provided on a position opposite the photosensitive drum 112; the toner supply roller 122, which is rotatably provided on the opposite side of the photosensitive drum 112 and side by side with its external circumferential surface facing the developing roller 121*a*, for supplying the toner T in the developing chamber 120 to the external circumferential surface of the developing roller 121*a*; the toner-charging roller 191, which is rotatably provided side by side with its external circumferential surface facing the photosensitive drum 112 on a position upstream with respect to a point of contact between the photosensitive drum 112 and the developing roller 121*a* and downstream with respect to a point of contact between the toner supply roller 122 and the developing roller 121*a*, the toner-charging roller 191 being provided as charging means for charging the toner T in the developing chamber 120 by contact; and an ultraviolet irradiator 143, which is provided as irradiation means for irradiating the toner-charging roller 191 with UV light so as to induce charging of the toner T by the UV light.

Further, it can be said that the developing process by the developing section 111*a* includes the steps of: successively supplying in advance the toner T onto the surface of the developing roller 121*a* of the developing section 111*a* in a direction of rotation from the toner supply roller 122, with respect to the photosensitive drum 112 which carries and transports an electrostatic latent image; transporting the toner T on the surface of the developing roller 121*a* between the developing roller 121*a* and the toner-charging roller 191 which are in a uniform motion; and shining light on the toner-charging roller 191 from the ultraviolet irradiator 143 which is provided inside the toner-charging roller 191, while restricting the thickness of the toner on the developing roller 121*a*, so as to induce electrons by the toner-charging roller 191 to charge the toner T to a predetermined amount. The toner in this state is further transported to a portion opposite the photosensitive drum 112 downstream in the direction of rotation, so as to be electrostatically supplied to the electrostatic latent image on the surface of the photosensitive drum 112 to be developed (visualized) as a toner image.

The developing roller 121*a* is made of a cylindrical conductive elastic material, and may be driven to rotate at 50 mm/s to 150 mm/s. Further, the toner supply roller 122 is made of a cylindrical foaming elastic material, and may be driven to rotate at the same speed as the developing roller 121*a*.

Further, the toner-charging roller 191 is configured such that the conducting ITO 193, and the charging layer 194 which becomes radically active by irradiation of UV light are coated on the cylindrical base roller 192 made of transparent acrylic resin which transmits UV light. Also, the toner-charging roller 191 may be driven to rotate at the same speed as the developing roller 121*a*.

Further, it can be said that the charging roller 113 is for charging the photosensitive drum 112 so as to form an electrostatic latent image on the external circumferential surface of the photosensitive drum 112, and the transfer roller 114 is for transferring the developed toner image on the external circumferential surface of the photosensitive drum 112 onto a sheet, and the pair of fixing rollers 115 are for fixing the transferred toner image on the sheet from the both sides. Further, the LSU 116 may be adapted so that the electrostatic latent image is focused on the external circumferential surface of the photosensitive drum 112 by the laser beam L.

Further, in order to prevent the toner from adhering on the charging means by being transferred from the developing roller, which might occur when the toner which has entered the contact surface between the developing roller and the charging means separates away from the contact surface, it is preferable that the surface roughness of the developing roller 121*a* be in a range of 0.5 $\mu$m and 2 $\mu$m, and that of the toner-charging roller 191 0.3 $\mu$m or less.

Further, in the configuration as shown in FIG. 19, the light having a wavelength of 700 nm which was emitted from the visible light irradiator 145 is converted to UV light having a wavelength of 350 nm by the wavelength converter element 147 before it strikes the charging means (charging layer 194). Therefore, it is not required to additionally provide an ultraviolet irradiator for emitting UV light with the wavelength of 350 nm which is optimum for the charging means, and the wavelength can be reduced in ½ using the already available visible light irradiator 145, thus reducing cost of the irradiation means.

Further, the developing section 210 as shown in FIG. 20 may carry out development in the following manner. That is, the toner which accumulated in the developing chamber is agitated with a mixing paddle. The toner, after being agitated sufficiently, is deposited in a thin layer on the developing roller by the supply roller made of an foaming rubber elastic material. The toner in the form of a thin toner layer on the developing layer is then transported to the point of contact with the charging member (charging layer 194). As a result, the toner comes into contact with the charging member. The charging member is irradiated with light by the irradiation means so as to bring about a radical reaction of the B-CIM within the photochromic layer (charging layer). That is, the B-CIM, upon irradiation of light, is brought to a state for charging the toner.

The charging member, with the induced radical reaction at the contact nip between the charging member and the developing roller, charges the toner by withdrawing electrons from the toner in the form of a thin layer on the developing roller. The charged toner past the contact nip point between the developing roller and the charging member is developed on the photosensitive body, which is an image carrier. In this charging of toner, the toner which was not transported to the develop point by the developing roller but attracted to the charging member is scraped off into the developing chamber by the cleaning blade which is in contact with the charging member, thereby suppressing deficiencies such as flying of toner in the machine.

Further, since the charging member of the developing section 210 is rotated is a counter direction with respect to the direction of rotation of the developing roller, excess toner is scraped off into the developing chamber, and there will be no deficiencies such as aggregation or flying of toner in the device.

Further, in the case where the charging member is configured in the form of a belt, the contact nip between the charging member and the developing roller can be set to have any width. This allows more transfer of electrons between the toner and the charging member having the photochromic layer with the induced radical reaction, thus improving the efficiency of utilizing the radical reaction. That is, chargeability of toner can be improved.

Further, one of the features of the developing section 210 as shown in FIG. 20 is that the irradiation means (ultraviolet irradiator 143) for initiating a radical reaction of the photochromic material radiates light from outside of the charging member. This allows efficient use of a radiated light energy from the irradiation means for radically activating the photochromic material, thus improving efficiency of radical reaction. That is, it becomes possible to reduce the energy consumed by the irradiation means itself.

Otherwise, not only power consumption is increased, but the temperature inside the charging member is increased. Further, in order to prevent such increase in temperature, it becomes necessary to provide a fan motor, which, however, increases the number of components and the size of the machine. Further, in a configuration where the light is shone from the rear side of the charging member, the charging member carrying the photochromic material requires a base material which is made of a highly light-transmissive material such as glass or transparent resin. However, with such a material, it was difficult to overcome the problem of durability against vibrations or falling, or the problem of cost.

Such a problem of durability against vibrations or falling, or the problem of cost can be solved by radiating light from the side of the outer surface of the charging member as in the developing section 210, because it allows for a wider selection of material for the base material of the charging member.

By the irradiation of light by the irradiation means from the side of the outer surface of the charging member as in the developing section 210, it is possible to reduce power consumption and the number of components, and therefore the cost, in addition to providing a wider selection of the base material and reducing the size of the developing chamber itself. Further, the cylindrical charging member as the developing section 210 has the configuration as shown in FIG. 20, which should be taken as just one example.

In the developing section 210, the irradiation section shines light from the side of the outer surface of the charging member. Therefore, by using the core metal layer which employs a material which does not reflect the transmitted light through the photochromic layer to areas other than the area of irradiation, or which does not transmit the light, it is possible to effectively utilize the radical reaction in the photochromic layer, thus extending life of the photochromic material.

Further, with regard to the charging member of the developing section 210 including the photochromic material B-CIM and the chain-transfer agent MBT, a radical reaction is induced by irradiation of light by the irradiation means, and the B-CIM is radically activated as a result. The radical reaction which is induced by the irradiation of light has the electron withdrawing action only when the toner comes into contact with the outer surface of the charging member, with the result that the toner is charged.

The photo-induced radical reaction of the B-CIM of the photochromic material slows down with time. It is therefore preferable to shine light in the vicinity of the point of contact between the charging member and the developing roller as close as possible. Because of this, the radical reaction in the photochromic layer is highly active before it passes the contact nip point between the charging member and the developing roller. Beyond the contact nip point between the charging member and the developing roller, the activity of radicals slows down gradually. By the time when the irradiation means radiates light again, the radical activity of the photochromic material has been completely gone and is in an inactive state again.

Also, as to the rotational speed of the charging member, it is set such that the light is shone again only after the radical activity by the irradiation of light by the irradiation means returns to an inactive state. When the light is shone before the radical activity returns to the inactive state completely, the efficiency of charging toner suffers.

Further, in such a case, the photochromic material itself will always be in an active state, which may shorten life of the photochromic material. The foregoing problem is caused unless the rotational speed of the charging member is set to carry out the next round of light irradiation only after the photochromic material which was radically activated by the irradiation of light by the irradiation means returns to the inactive state.

Further, in the developing section 210, the charging member is rotated in a counter direction with respect to the direction of rotation of the developing roller. This allows the toner to be brought into contact with the surface layer of the charging member both actively and evenly. The toner charged by the charging member is not only evenly charged but the chargeability of the toner is also improved.

Further, FIG. 24 and FIG. 26 can be regarded as schematic drawings which illustrate how the developing agent (toner) is charged at the point of contact between the charging layer (photochromic layer) 194 of the toner charging roller 212 and the developing roller 121*a*, and how charge is induced or accepted in the charging layer 194.

Further, it can be said that the developing section 210 as shown in FIG. 27 and FIG. 28 is composed of the toner supplement roller, the agitating roller, the supply roller, the developing roller, the charging member, and the irradiation section for radiating UV light. Further, the photosensitive drum 112 may be realized by a conducting elastic member.

Further, one of the features of the developing section 210 as shown in FIG. 27 is that the irradiation means for initiating a radical reaction of the photochromic layer of the charging member shines light from outside of the charging member, and that the core metal layer of the charging member is made of a material which does not transmit light from the irradiation means. This allows efficient use of a radiated light energy from the irradiation means for radically activating the photochromic material, thereby improving efficiency of radical reaction. Further, it is preferable that the core metal layer be made of a metal which has been mat-glazed on the surface. This allows efficient use of a radiated light energy from the irradiation means for radically activating the photochromic material, thereby improving efficiency of radical reaction. That is, it becomes possible to reduce the energy consumed by the irradiation means itself.

Further, by setting the rotational speed of the charging member equal to or greater than the rotational speed of the developing roller, the charge-induced photochromic layer by the irradiation means comes into contact more often with the developing agent which is carried by the developing roller, thus improving charging efficiency of the developing agent.

Further, by setting the rotational speed of the charging member slower than the rotational speed of the developing roller, the induced charge on the photochromic layer by the irradiation means effectively comes into contact with the developing agent which is carried by the developing roller. This prevents unnecessary irradiation of the photochromic layer to increase the amount of charged developing agent, i.e., it is possible to reduce the quantity of radiated light.

Further, the charging member may be rotated in the opposite direction to the direction of rotation of the developing roller. In this way, it is possible to precharge not only uncharged toner which is successively transported on the developing roller but also uncharged toner which is floating in the developing chamber. As a result, charging of toner can be improved.

Further, all the toner which came into contact with the charging member and charged thereby is transferred to the developing roller at the contact portion between the charging member and the developing roller. The reason for this transfer is that the developing roller is biased so as to enable developing the electrostatic latent image on the photosensitive body into a visible image. The toner which accepted charge by the charging member this way is attracted to the developing member and transported thereby. Thus, the charging member does not require the cleaning blade.

Further, the present invention can be described in terms of the following first through twentieth developing devices. That is, the first developing device is a developing device which employs photo-induced charging to visualize an electrostatic latent image which is carried and transported by an latent image carrier, and includes: a charged member for developing the electrostatic latent image into a visible image; charging means for charging the charged member by giving photoelectrons; and irradiation means for shining light on the charging means, wherein the irradiation means for shining light on the charging means is provided outside of the developing device, and includes cleaning means which is in contact with the external peripheral surface of the charging means which is provided inside the developing device.

With this configuration, since the irradiation means for shining light on the charging means is provided outside of the developing device, less irradiation energy is required for the light irradiation means, compared with the case where light is shone from inside of the charging means. Further, the heat of radiation from the light source of the irradiation means is not confined in the developing device, thus realizing stable development. Further, by the provision of the cleaning means which is always in contact with the external peripheral surface of the charging means which is provided inside the developing device, the charged toner is prevented from leaking out of the developing device.

Further, the second developing device, in the first developing device, has a configuration in which the charging means is in the form of a cylinder or a belt, and includes the photochromic layer and the core metal layer from the side of the irradiation means. With this configuration, since the photochromic layer makes up the outer surface of the charging means, stable charging of toner is possible.

Further, the third developing device, in the second developing device, has a configuration in which the core metal layer is a rigid body when the charging means is in the form of a belt. With this configuration, since the charging member and the developing roller are stably in contact with each other, stable charging of toner is possible. In addition, the configuration of the developing device can be made simpler and smaller.

Further, the fourth developing device, in the second developing device, has a configuration in which the core metal layer is in the form of a film when the charging means has the belt shape. This allows the charging means to be designed into any shape, thus providing more options as to position of the developing device in the machine. In addition, any width can be set for the contact nip between the developing roller and the charging means.

Further, the fifth developing device, in the second developing device, has a configuration in which the photochromic layer includes a mixture of B-CIM and MBT as a main component, and has a thickness in a range of 1 $\mu$m and 100 $\mu$m.

The photochromic layer of the charging means cannot carry out stable charging of toner with the photochromic material alone, which, however, is made possible by including MBT, which is a chain-transfer material. Further, with the thickness of the foregoing range, toner can be charged even more stably.

Further, the sixth developing device, in the second developing device, has a configuration in which the core metal layer is made of a material which does not reflect the radiated light by the irradiation means to areas other than the area of irradiation, or which does not transmit the radiated light. With this configuration, there is no charging of toner, intentionally or unintentionally, in areas other than the charging area, and therefore life of the photochromic layer, which is the charging means, can be extended.

Further, the seventh developing device, in the first developing device, has a configuration in which the irradiation means shines light immediately before the charging means comes into contact with the developing roller which makes up the developing means. With this configuration, there is no charging of toner, intentionally or unintentionally, in areas other than the charging area, and therefore life of the photochromic layer, which is the charging means, can be extended.

Further, the eighth developing device, in the first developing device, has a configuration in which the charging means rotates in a counter direction to the direction of rotation of the developing roller. With this configuration, the toner in the developing chamber can be prevented from flying in the machine (printing device having the developing device).

Further, the ninth developing device has a configuration in which the rotational speed of the charging means is set to such a period that the radical reaction of the photochromic material B-CIM, which is induced by the radical activation of the charging means by radiated light of the light irradiation means is completely returned to the original state before the next irradiation is carried out. With this configuration, the charging means does not require a charge removing mechanism, thus making the developing device smaller.

Further, the tenth developing device has a configuration in which the cleaning means, made of an elastic material, has hardness which is equal to or greater than that of the photochromic layer of the charging member. With this configuration, stable charging of toner is possible without scraping the photochromic layer of the charging means.

Further, the eleventh developing device is a developing device which employs photo-induced charging to visualize an electrostatic latent image which is carried and transported by an latent image carrier, and includes: a charged member for developing the electrostatic latent image into a visible image; charging means for charging the charged member by giving photoelectrons; and irradiation means for shining light on the charging means, wherein the irradiation means for shining light on the charging means is provided inside of the developing device, and among developing agent which is transported by the developing roller of the developing device and developing agent which is floating in the device, the developing agent which is transported by the charging means is charged by the irradiation means and the charging means.

With this configuration, since the light source is provided outside of the charging roller, less heat accumulates in the photochromic member. Further, it is not required to provide a light-transmitting transparent plain tube, which was required when light is shone from the inside of the charging means, thus providing a wider selection of material for the plain tube.

Further, the twelfth developing device, in the eleventh developing device, has a configuration in which the charging means rotates in the opposite direction to the direction of rotation of the developing roller. With this configuration, it is possible to precharge not only the developing agent which is carried by the developing roller but also an uncharged developing agent which is floating in the device. As a result, the developing agent can be charged efficiently.

Further, the thirteenth developing device, in the eleventh developing device, has a configuration in which the irradiation means radiates light immediately before the developing roller making up the developing device comes into contact with the charging means. The photo-induced radical reaction attenuates with time and therefore it is more effective to carry out irradiation immediately before as close as charging.

Further, the fourteenth developing device, in the eleventh developing device, has a configuration in which the charging means is in the form of a cylinder or a belt, and includes the photochromic layer and the core metal layer from the side of the irradiation means. With this configuration, since the photochromic layer makes up the outer surface of the charging means, stable charging of toner is possible.

Further, the fifteenth developing device, in the fourteenth device, has a configuration in which the core metal layer is a rigid body when the charging means is in the form of a cylinder. With this configuration, since the charging member and the developing roller are stably in contact with each other, stable charging of toner is possible. In addition, the configuration of the developing device can be made simpler and smaller.

Further, the sixteenth developing device, in the fourteenth developing device, has a configuration in which the core metal layer is in the form of a film when the charging means has the belt shape. This allows the charging means to be designed into any shape, thus providing more options as to position of the developing device in the machine. In addition, any width can be set for the contact nip between the developing roller and the charging means.

Further, the seventeenth developing device, in the fourteenth developing device, has a configuration in which the photochromic layer includes a mixture of B-CIM and MBT as a main component, and has a thickness in a range of 1 $\mu$m and 100 $\mu$m. The photochromic layer of the charging means cannot carry out stable charging of toner with the photochromic material alone, which, however, is made possible by including MBT, which is a chain-transfer material. Further, with the thickness of the foregoing range, toner can be charged even more stably.

Further, the eighteenth developing device, in the fourteenth developing device, has a configuration in which the core metal layer is made of a material which does not reflect the radiated light by the irradiation means to areas other than the area of irradiation, or which does not transmit the radiated light. With this configuration, there is no charging of toner, intentionally or unintentionally, in areas other than the charging area, and therefore life of the photochromic layer, which is the charging means, can be extended.

Further, the nineteenth developing device, in the eleventh developing device, has a configuration in which the rotational speed of the charging means is equal to or greater than that of the developing roller. The charge-induced photochromic layer by the irradiation means has more chance of coming into contact with developing agent, including the developing agent transported by the developing roller, thus increasing the amount of charged toner (increasing the chance of accepting charge).

Further, the twentieth developing device, in the eleventh developing device, has a configuration in which the rotational speed of the charging means is less than that of the developing roller. With this configuration, when the developing agent carried by the developing roller is transported to the charge-induced photochromic layer by the irradiation means, the induced charge effectively comes into contact with the developing agent. This prevents unnecessary irradiation of the photochromic layer to increase the amount of charged developing agent, i.e., it is possible to reduce the quantity of radiated light.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A developing device for visualizing an electrostatic latent image held and transported on a latent image carrier, comprising:

a charged member for developing an electrostatic latent image to a visual image;

charging means for charging the charged member through contact; and irradiation means for shining light onto the charging means to charge the charged member by means of the light shone.

2. The developing device as defined in claim 1, wherein:

the charging means contains a material changing its molecular structure under light irradiation by the irradiation means in such a manner to charge the charged member.

3. The developing device as defined in claim 1, wherein:

the charged member and the charging means contact each other; and at least after the contact, the charged member moves off a contact surface of the charging means.

4. The developing device as defined in claim 1, wherein:

the irradiation means is provided so as to shine light onto the charging means from a position opposite to the charged member.

5. The developing device as defined in claim 1, further comprising:

wavelength altering means for, provided between the charging means and the irradiation means, altering wavelengths of the light shone by the irradiation means onto the charging means.

6. The developing device as defined in claim 1, wherein:

the charging means includes transport means for enabling a contact surface with respect to the charged member to be moved.

7. The developing device as defined in claim 1, wherein:

toner is used as the charged member.

8. The developing device as defined in claim 7, further comprising a developing roller located opposite to the charging means, wherein:

the toner is transported to a position between the developing roller and the charging means.

9. The developing device as defined in claim 8, wherein:

the charging means includes a layer-thickness-restricting means for restricting a thickness of a layer of the toner transported to the position between the developing roller and the charging means.

10. The developing device as defined in claim 9, wherein:

the charging means doubles as the layer-thickness-restricting means.

11. The developing device as defined in claim 9, wherein:

the layer-thickness-restricting means is positioned upstream to the charging means with respect to a transport direction of the toner.

12. The developing device as defined in claim 8, wherein:

the charging means is cylindrical and transparent to light.

13. A charging method through contact for use in a developing device for visualizing an electrostatic latent image held and transported on a latent image carrier, the method being used in a developing device for charging a charged member with which the electrostatic latent image is developed into a visual image, by causing the charged member to contact charging means and irradiation means to shine light onto the charging means.

14. A developing device, for use in an electrophotographic device, for developing an electrostatic latent image on a latent image carrier with charged developing material, the device comprising:

a charging section including charging material radicalized under light irradiation; and a light irradiation section for irradiating light onto the charging section, wherein the device is specified to charge the developing material by causing the radicalized charging material to contact the developing material.

15. The developing device as defined in claim 14, further comprising a transport section for holding and transporting the developing material to the latent image carrier, wherein the charging section is specified so as to cause the radicalized charging material to contact the developing material held by the transport section.

16. A method of charging, through contact, developing material for developing an electrostatic latent image produced on a latent image carrier in an electrophotographic device, comprising the step of:

charging the developing material by shining light onto charging material that is radicalized under light irradiation and causing the radicalized charging material to contact the developing material.

* * * * *